US006805434B2

(12) United States Patent
Hayashi et al.

(10) Patent No.: US 6,805,434 B2
(45) Date of Patent: Oct. 19, 2004

(54) LIQUID SUPPLYING SYSTEM, LIQUID SUPPLY CONTAINER, CAPILLARY FORCE GENERATING MEMBER CONTAINER, INK JET CARTRIDGE AND INK JET RECORDING APPARATUS

(75) Inventors: Hiroki Hayashi, Kanagawa-ken (JP); Shozo Hattori, Tokyo (JP); Hajime Yamamoto, Kanagawa-ken (JP); Eiichiro Shimizu, Kanagawa-ken (JP); Yasuo Kotaki, Kanagawa-ken (JP); Hiroshi Koshikawa, Kanagawa-ken (JP); Kenji Kitabatake, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/290,486

(22) Filed: Nov. 8, 2002

(65) Prior Publication Data

US 2003/0067519 A1 Apr. 10, 2003

Related U.S. Application Data

(62) Division of application No. 09/559,382, filed on Apr. 27, 2000, now Pat. No. 6,550,898.

(30) Foreign Application Priority Data

Apr. 27, 1999 (JP) ..... 11-120615
Apr. 27, 1999 (JP) ..... 11-120804
Apr. 12, 2000 (JP) ..... 2000-110907

(51) Int. Cl.[7] ..... M41J 2/75
(52) U.S. Cl. ..... 347/85
(58) Field of Search ..... 347/84, 85, 86, 347/87

(56) References Cited

U.S. PATENT DOCUMENTS 5,509,140 A 4/1996 Koitabashi et al. ..... 347/86

(List continued on next page.)

FOREIGN PATENT DOCUMENTS

EP 562733 9/1993

(List continued on next page.)

OTHER PUBLICATIONS

U.S. application No. 09/559,390, filed Apr. 27, 2000.

(List continued on next page.)

*Primary Examiner*—Anh T. N. Vo
(74) *Attorney, Agent, or Firm*—Fitzpatrick, Cella, Harper & Scinto

(57) ABSTRACT

A liquid supplying system comprises a capillary force generating member accommodating container which stores therein a capillary force generating member for retaining liquid, and is provided with a liquid supply portion for supplying outward the liquid retained in the capillary force generating member, and an air vent through which the capillary force generating member is in fluid communication with ambience; and a liquid reservoir container which is provided with a liquid reservoir portion for storing therein the liquid to be supplied to the capillary force generating member accommodating container, and a communication path portion for supplying the liquid to the capillary force generating member accommodating container, and forms therein a virtually sealed space except for the presence of the communication path portion; wherein the capillary force generating member is provided with a layer in which the primary direction in which fiber strands therein are arranged is substantially horizontal, and this layer is in the region connecting the liquid supply portion and communication path portion; and wherein the communication path portion is positioned at a level higher than the liquid supply portion, and lower than the top surface of the capillary force generating member.

14 Claims, 28 Drawing Sheets

U.S. PATENT DOCUMENTS

| | | | | |
|---|---|---|---|---|
| 5,603,577 | A | 2/1997 | Suzuki et al. | 400/124.1 |
| 5,621,446 | A | 4/1997 | Tanaka et al. | 347/85 |
| 5,623,291 | A | 4/1997 | Morandotti et al. | 347/7 |
| 5,657,058 | A | 8/1997 | Mochizuki et al. | 347/7 |
| 5,657,065 | A | 8/1997 | Lin | 347/93 |
| 5,742,312 | A | 4/1998 | Carlotta | 347/87 |
| 5,784,088 | A | 7/1998 | Ujita et al. | 347/86 |
| 5,852,457 | A | 12/1998 | Kotaki et al. | 347/86 |
| 5,980,031 | A | 11/1999 | Sasaki et al. | 347/85 |
| 6,022,102 | A * | 2/2000 | Ikkatai et al. | 347/85 |
| 6,116,725 | A | 9/2000 | Kato et al. | 347/86 |
| 6,145,972 | A | 11/2000 | Udagawa et al. | 347/86 |
| 6,293,663 | B1 | 9/2001 | Koshikawa et al. | 347/86 |
| 6,350,025 | B1 | 2/2002 | Morita et al. | 347/86 |
| 6,390,601 | B1 | 5/2002 | Morita et al. | 347/49 |
| 6,402,308 | B1 | 6/2002 | Hattori et al. | 347/86 |
| 6,443,567 | B1 | 9/2002 | Hayashi et al. | 347/85 |
| 6,454,400 | B1 | 9/2002 | Morita et al. | 347/86 |

FOREIGN PATENT DOCUMENTS

| | | |
|---|---|---|
| EP | 0 580 433 | 1/1994 |
| EP | 0 581 531 | 2/1994 |
| EP | 0 691 207 | 1/1996 |
| EP | 0 738 605 | 10/1996 |
| EP | 0 756 935 | 2/1997 |
| EP | 845362 | 6/1998 |
| EP | 860286 | 8/1998 |
| EP | 894630 | 2/1999 |
| EP | 908830 | 4/1999 |
| EP | 0 925 935 | 6/1999 |
| EP | 0 956 958 | 11/1999 |
| EP | 0 956 959 | 11/1999 |
| EP | 0 967 082 | 12/1999 |
| EP | 1 013 447 | 6/2000 |
| EP | 1 013 448 | 6/2000 |
| EP | 0 053 875 | 11/2000 |
| JP | 07-068776 | 3/1995 |
| JP | 09-174867 | 7/1997 |
| JP | 10-193634 | 7/1998 |
| JP | 10-278295 | 10/1998 |
| JP | 11-10906 | 1/1999 |
| JP | 11-91123 | 4/1999 |

OTHER PUBLICATIONS

U.S. application No. 09/546,910, filed Apr. 10, 2000.
U.S. application No. 09/559,383, filed Apr. 27, 2000.
U.S. application No. 09/559,389, filed Apr. 27, 2000.
U.S. application No. 09/559,390, filed Apr. 27, 2000.

* cited by examiner (i)

(j)

LIQUID SUPPLYING SYSTEM, LIQUID SUPPLY CONTAINER, CAPILLARY FORCE GENERATING MEMBER CONTAINER, INK JET CARTRIDGE AND INK JET RECORDING APPARATUS

This application is a division of application Ser. No. 09/559,382, filed Apr. 27, 2000.

FIELD OF THE INVENTION AND RELATED ART

The present invention relates to a liquid supplying system preferably used in the field of an ink jet recording apparatus and the like, a negative pressure generating member container and a liquid container used for the system, an ink jet cartridge and an ink jet recording apparatus employing the system, and an ink container. More specifically, the present invention relates to a liquid supplying system in which a portion or portions of containers are exchangeable.

In the field of an ink jet recording apparatus, there have been proposed various ink containers which apply negative pressure to an ink jet head. The most common structure among these proposals is a structure with utilizes the capillary force of porous material; more specifically, a structure comprising an external shell, a piece of porous material, preferably sponge or the like, compressed into the shell in a manner to entirely fill the internal space of the shell, and an air venting hole, or an air vent, through which air is drawn into an ink storing portion to enhance the ink supplying performance during printing.

However, usage of a porous member as an ink retaining member creates a problem in that it makes ink storage ratio per unit volume rather low in order to solve this problem, the inventors of the present invention has proposed, in an official journal EP0580433, an ink container comprising a virtually sealed ink storing chamber, that is, an ink container sealed except for the presence of a connective path to a capillary force generating member storing chamber. This ink container is used in the state in which the capillary force generating member storing chamber is open to the atmospheric air. They have proposed another invention in an official journal EP0581531. According to this invention, an ink storing chamber is rendered replaceably connectable to an ink container with the above described structure.

In the case of the above described ink container, ink is supplied from the ink storing chamber to the capillary force generating member storing chamber through gas-liquid exchange, or a process in which gas is drawn into the ink storing chamber as the ink in the ink storing chamber is drawn out. Therefore, it has merit in that during this gas-liquid exchange, ink can be supplied under the condition in which the negative pressure remains approximately stable. In addition, from the viewpoint of exchangeability, the ink container disclosed in the official journal is EP0581531 is a technically superior ink container.

On the other hand, the inventors of the present invention have proposed, in an official journal EP0691207, an ink container which employs fiber made of olefinic resin (for example, polypropylene, polyethylene, or the like) which possesses thermal-plasticity, as the material for the capillary force generating member in the above described ink container. This ink container is superior in terms of the stability of the ink stored therein. It is also superior in terms of recyclability, because the external shell of the ink container, and the material for the internal fibrous member, are made of the same type of material.

Further, the inventors of the present invention have proposed, in an official journal EP0738605, a liquid storage container, which is characterized in that it comprises an external sheet in the form of an approximately polygonal prism, and an internal storing portion which is identical or similar in shape to the internal space of the shell, and is capable of deforming in response to the drawing of the liquid therein from the container, and that the thickness of the walls of the internal storing portion in the form of an approximately polygonal prism is rendered less at the corner portions than at the center portions of the walls. In this liquid storage container, the storing portion properly contracts as the liquid is drawn out (gas-liquid exchange does not occur), and therefore, the liquid can be supplied while using negative pressure. Thus, compared to a conventional ink storing member in the form of a pouch, this liquid storage container does not need any restriction in terms of the position where it is placed. Therefore, it can be placed on a carriage. Further, ink is directly stored in the storing portion, and therefore, the invention may be valued as an excellent invention in terms of exchangeability, and also in terms of improvement in ink storage ratio.

SUMMARY OF THE INVENTION

As described above, in the case of an ink container of a type in which a capillary force generating member container such as the above described one, and a correspondent ink storing chamber, are disposed adjacent to each other, when the ink in an ink storage chamber, the internal volume of which is fixed at a predetermined volume, is supplied into the capillary force generating member storage chamber, gas-liquid exchange occurs to allow gas to be drawn into the ink storage chamber.

In order to pursue more ideal conditions for an ink container which has the above described excellent structure, the inventors of the present invention paid attention to the gas-liquid exchange mechanism, and how the ink in the ink storage chamber is drawn out during the gas-liquid exchange, recognizing the following two points.

The first point regards the ambient air drawn into the ink storage chamber through gas-liquid exchange. When the ink in the ink storage chamber is supplied into the capillary force generating member storage chamber through gas-liquid exchange, the ambient air is drawn into the ink storage chamber by an amount equivalent to the amount of the ink drawn out as the ink is supplied. Therefore, a state in which the air from the outside and the ink coexist in the ink storage chamber is effected. This air in the ink storage chamber expands due to the charges which occur to the ambience in which a printer is used (for example, daily temperature fluctuation), sometimes forcing the ink in the ink storage chamber into the capillary force generating member storage chamber. Thus, in the past, a buffer space as large as possible was sometimes secured in the capillary force generating member storage chamber, more specifically, in the capillary force generating member itself, in consideration of the amount by which the ink moves, relative to the expansion ratio, and also in consideration of the various environments in which the ink container is used.

Based on the above described recognition, the inventors of the present invention produced an ink container, the ink storage chamber of which was replaceably connectable to the capillary force generating member storage chamber, and which employed a wad of fiber of olefinic resin as the capillary force generating member, as shown in FIG. 1, (*a*) is a drawing for depicting a capillary force generating member storage container 1004 as the capillary force generating member storage chamber in the state in which an exchange liquid storage container 1007 shown in FIG. 1, (*b*), as an exchangeable ink storage chamber, has been removed. In FIG. 1, (*a*), a referential numeral 1001 designates a capillary force generating member formed of mixed strands of polypropylene and polyethylene; 1002, ink supplying opening; 1003, an air vent; 1005, a connective path portion to be connected to the exchange liquid storage container 1007 for forming a joint path; and a referential numeral 1006 designates a buffer chamber in connection with the air vent. A referential character L designates the interface between the liquid and gas (hereinafter, "gas-liquid interface"). After the liquid in the exchange liquid storage container 1007 is used up, and the exchange liquid storage container 1007 is removed, the interface L is in the connective opening. In other words, a portion of the capillary force generating member, which is exposed at the connective path portion, constitutes a region in which no ink is present. On the other hand, FIG. 1, (*b*) depicts the state in which the exchange liquid storage container 1007 has been connected to the capillary force generating member storage container 1004. The exchange liquid storage container 1007 holds ink in the shell 1009, and the internal space of the shell 1009 is virtually airtightly sealed, except for the presence of the ink outlet 1008. In this state in which the exchange liquid storage container 1007 is connected, and ink is within the exchange liquid storage container 1007, a gas-liquid interface La in the connective path portion 1005 is exists at a level above the top end of the joint path; the interface L has risen compared to the state illustrated in FIG. 1, (*a*); in other words, more ink is held in the capillary force generating member.

When the ink container shown in FIG. 1, (*b*), was subjected to an ambience which changed in the same manner as in the actual ambience in which the ink container was used, it could be observed that as the number n of the cycle increased, the magnitude ΔLn of the range of the movement of the gas-liquid interface Ln in terms of the gravity direction (different between the highest and lowest positions $L_H$ and $L_L$ of the interface in terms of the gravity direction) increased. It was also observed that as a process in which the ink in the exchange liquid storage container was used up and a fresh exchange liquid storage container was connected was repeated, the space, in the capillary force generating member, which was in connection to the air vent and held mainly air, that is, the space $V_B$ above the gas-liquid interface L, reduced. As the space $V_B$ reduced as the result of the repetition of the container exchange and ambient change, as described above, it occurred that even the region which was originally secured as the buffer space always retained ink, raising a possibility that the region no longer could function as the buffer space, allowing, in the worst case, ink to leak out of the air vent or ink outlet hole.

It was possible to think that the above described problem is caused by the following characteristics of an ink absorbent material formed of fibrous material instead of porous material such as foamed urethane, that is, the conventional material:

(1) The amount of the pressure loss resulting from ink movement is small because of the large amount of void ratio.

(2) There is only a small amount of difference in the contact angle of ink, relative to a strand of fiber, between when the ink advances and when ink retreats.

(3) In the case of the ink absorbent material formed of fiber, capillary force is generated even in the gap between adjacent strands of fiber, and therefore, compared to the ink absorbent material formed by removing some of the cell walls after urethane was made to foam, there is little regional variation in the strength of capillary force, in terms of the size of the urethane sponge cell (approximately 80–120 μm), throughout the ink absorbent material.

Thus, the inventors of the present invention studied the aforementioned problems while paying keen attention to the above described characteristics of fiber, and discovered, as a result, that when fiber strands were arranged in parallel in the gravity direction (direction perpendicular to the horizontal direction in which the gas-liquid interface is formed), that is, when the directions of the fiber strands were made parallel to the gravity direction, the ratio at which the above described phenomenon occurred increased.

On the other hand, the second point concerns the route, through the capillary force generating member, of the ink introduced into the capillary force generating member storage chamber from the ink storage chamber.

To describe with reference to FIG. 1, (*b*), in the case of a conventional ink container, the connective hole 1005 is located adjacent to the bottom wall of the capillary force generating member storage container 1004, and the aforementioned ink delivery hole 1002 located away from the connective hole 1005 to deliver ink from the capillary force generating member storage container 1004 is also located adjacent to the bottom wall of the capillary force generating member storage container 1004 (or in the bottom wall), as is the connective hole 1005.

Therefore, among the typical routes through which the ink in the exchange liquid storage container 1007 reaches the ink delivery hole 1002 through the connective hole 1005 and the capillary force generating member 1001, the shortest route is route A shown in FIG. 1, (*b*), whereas the longest path is route B shown in FIG. 1, (*b*).

After being drawn out of the exchange liquid storage container 1007 through the connective hole 1008, the ink flows toward the ink delivery hole 1002, while remaining in contact with the capillary force generating member 1001. However, when there exist various routes different in length, it is quite natural that the ink which follows route B, which offers a larger number of opportunities for the ink to make contact with the capillary force generating member 1001, will to be more affected by the capillary force generating member 1001 compared to the ink which follows route A.

Further, the capillary force generating member 1001 has the following nature: it physically adsorbs a substantial amount of the constitutional components in the ink, as if trapping them like a filter, and also chemically adsorbs them by reacting with them.

Therefore, a body of ink which follows route B in which it is more affected by the capillary force generating member 1001, and another body of ink which follows route A in which it is less affected by the capillary force generating member 1001, become different in their components.

On the other hand, in recent years during which demand for sturdiness has been increasing, the countermeasures for the above described problem have been taken. For example, thin ink, that is, ink with one sixth the normal density, was used to reduce the graininess of each recording dot; a solvent capable of preventing recording dots, which were different in color and where they were formed, from mixing (bleeding) into the regions beyond their intended boundaries, was added; a solvent capable of improving ink in terms of fixation to recording medium was added; or pigments were used. When countermeasures such as those listed above were taken, the difference in the ink routes sometimes created an appearance of subtle unevenness across an image being recorded, in terms of color tone, ink fixation, and frictional resistance.

The present invention is based on the aspects of the ink container, which were recognized for the first time by the inventors of the present invention, for example, the relationship between the fiber strand direction and the direction in which the gas-liquid interface is formed, and the ink movement route in the capillary force generating member. The first object of the present invention is to provide an ink container which is capable of effectively preventing ink leakage, and also is capable of reliably supplying ink so that an image of stable quality can be formed, while being of a type which comprises a capillary force generating member storage chamber such as the above described one, and an ink storage chamber located immediately adjacent to the capillary force generating member storage chamber, In other words, the present invention is to provide an ink container and an ink supplying system, which are superior in terms of practical usage.

The second object of the present invention is to provide, based on the recognition of the above described first aspect, an ink container which is suitable for using fibrous material as the material for the capillary force generating member, and does not leak ink when subjected to ambient change, while being of the type which comprises a capillary force generating member storage chamber such as the above described one, and an ink storage chamber located immediately adjacent to the capillary force generating member storage chamber.

The fourth object of the present invention is to provide, based on the recognition of the above described second aspect, and by controlling the variation in the ink route through the negative pressure generating member, an ink container which can reliably supply ink so that images of stable quality can be formed, while being of the type which comprises a capillary force generating member storage chamber such as the above described one, and an ink storage chamber located immediately adjacent to the capillary force generating member storage chamber.

The remaining objects of the present invention are to provide various inventions related to the above described liquid supplying methods, and head cartridges or the like, which are compatible with the above described liquid supplying system.

The present invention for accomplishing the above described various objects is based on a completely innovative concept, which could not be found in the past, and more specific means of the invention will be understood from the structure which will be described hereinafter.

The liquid supply system in accordance with the present invention for accomplishing the aforementioned first object is characterized in that it comprises: a capillary force generating storage container which contains a capillary force generating member, and has an air vent for forming gas routes from the internal space of the ink container to the outside, through the liquid supplying portion for supplying outward the liquid retained in the capillary force generating member, and a capillary force generating member; and a liquid storage container, which has a liquid storing portion for storing the liquid to be supplied to the capillary force generating member storage container, and a connective path portion for supplying the liquid to the capillary force generating member storage chamber, and is virtually airtightly sealed except for the location of the connective path portion, in that the capillary force generating member is provided with a layer of fiber strands in which the primary directions of the fiber strands, that is, the direction in which the strands are more or less parallelly arranged, coincides with the horizontal direction, and this layer is located in the region connecting the liquid supplying portion and the top portion of the connective path portion, and in that the position of the connective path portions is higher than the position of the liquid supply portion, and is below the position of the top surface of the capillary force generating member.

According to the above described liquid supplying system, as liquid is supplied to the capillary force generating member through the joint between the capillary force generating member storage chamber and liquid supply container, gas-liquid exchange occurs mainly through this connective path portion. Therefore, the gas-liquid interface within the capillary force generating member develops, normally, in the top end portion of this connective path portion. Therefore, if the aforementioned layer of fiber strands, in which the primary strand direction approximately coincides with the horizontal direction, is positioned in this top end portion of this connective path portion, the gas-liquid interface can be stabilized even in an ambience such as the above described one.

Further, in the liquid supplying system in accordance with the present invention, which is structured a described above, in order keep within a predetermined range, the length of the route, from the connective path portion to the liquid supplying portion, which the ink follows as it flows through the capillary force generating member, the position of the connective path portion is rendered higher than the position of the liquid supplying portion. Therefore, the difference, among different ink routes, in the amount of the effect to which the components in the liquid are subjected as the liquid flows from the connective path portion to the liquid supplying portion, is smaller.

Thus, it is possible to provide an ink container and an ink supplying system which are superior in practically, that is, an ink container and an ink supplying system which are capable of effectively preventing ink leakage, and reliably supplying ink so that images with stable quality can be formed, while the ink container remaining as an ink container of the aforementioned type which comprises a capillary force generating member storage chamber and an ink storage chamber positioned adjacent thereto.

In addition to the above described structure, if the fibrous layer is expanded into a part of the region directly above the region occupied originally by the fibrous layer, it is possible to cause the fibrous layer to maintain the functions such as those described above, even if the gas-liquid interface rises due to the change in the amount of the liquid supplied into the capillary force generating member storage container.

Further, if the capillary force generating member is formed as a combination of a plurality of smaller pieces of capillary force generating material, and these smaller pieces are arranged so that the interfaces among these small pieces are located above the fibrous layer, the stability of the gas-liquid interface can be improved. In other words, the interfaces among the plurality of the smaller pieces of the capillary force generating material also have an effect of regulating the ink flow direction, that is, an effect of causing the ink to flow in the desirable direction.

Further, when the capillary forces at the interfaces among the smaller pieces of fibrous material are stronger than the capillary forces in these pieces, the degree by which the movement of the gas-liquid interface is impeded by the interfaces among the smaller pieces of the fibrous material is greater than the degree by which the movement of the gas-liquid is impede by the internal portions of the smaller pieces. Therefore, it is possible to secure the space above the interfaces among the smaller pieces of fibrous material, as the buffering space, by assuring with the use of one of the functions of the interfaces among the smaller pieces of fibrous material, that is, the ability to impede the movement of the gas-liquid interface, so that the gas-liquid interface does not move above the interfaces among the smaller pieces of the fibrous material.

Further, among the aforementioned plurality of smaller pieces of fibrous material, if those on the bottom side are stronger in capillary force than those on the top side, the interfaces among the smaller pieces of fibrous material more effectively prevents the gas-liquid interface from moving above the interfaces among the smaller pieces of fibrous material.

Further, among the aforementioned plurality of smaller pieces of fibrous material, if those on the top side are greater in hardness than those on the bottom side, those on the bottom side deform more, increasing the capillary force in those on the bottom side, when those on the top side and those on the bottom side are compressed against each other.

Further, if a liquid supply container is provided with a liquid storage portion which deforms as the liquid within the liquid storage is drawn out, and which is capable of generating negative pressure, the change in the amount of the liquid supplied into a capillary force generating member storage container can be reduced by absorbing, by the deformation of the liquid storage portion, the fluctuation in the internal pressure of the liquid storage portion caused by the changes in the ambience in which a liquid supplying system is used, to more effectively prevent the gas-liquid interface from shifting. As will be described later in the section in which the embodiments of the present invention are described, it is desired that the deformable liquid storage portion is covered with a shell to prevent the volume of the liquid storage portion from exceeding a predetermined upper limit, and also to control the liquid storage portion so that its shape remains desirable as it deforms.

Further, in the liquid supplying system in accordance with the present invention, the liquid supply container may be structured so that it can be removably connected to the capillary force generating member storage container. In such a case, after the liquid in one liquid supply container runs out, the capillary force generating member storage chamber portion of the liquid supplying system can be repeatedly used by replacing the empty liquid supply container with another liquid supply container which is full of liquid.

The capillary force generating member in accordance with the present invention does not have a structure like urethane in which capillaries are sharply constricted in some areas. Therefore, even if the substance which has dissolved from the structural components or debris into the liquid becomes trapped in the capillary force generating member, no change occurs to the liquid supplying performance. Thus, according to the present invention, the capillary force generating member can control the movement of the gas-liquid interface movement even after a long period of usage.

On the other hand, the liquid supplying system in accordance with the present invention for accomplishing the aforementioned second object is characterized in that in the liquid supplying system which comprises a liquid supply container, in the sealed space of which a liquid storage space for storing liquid is provided, and a capillary force generating member storage chamber which is in connection with the liquid storage portion through the joint between the liquid supply container and capillary force generating member storage chamber, and contains a capillary force generating member, liquid is supplied through gas-liquid exchange, that is, a process in which the liquid in the liquid storage portion is drawn out into the capillary force generating member storage chamber by introducing gas into the liquid storage portion through the aforementioned joint, and the capillary force generating member is provided with a layer of fiber strands which is located along the interface between the gas and liquid in the capillary force generating member during a liquid supplying operation, and in which the fiber strands are arranged more or less in parallel to the adjacent strands in the approximately horizontal direction, in terms of the primary direction.

Assuming that a member which contains fibrous material is used as the capillary force generating member, and liquid enters this fibrous portion, if the direction of the advancement of the liquid is perpendicular to the longitudinal direction of the fiber strands, the fiber strands function to resist the advance of the liquid, whereas if the direction of the advance of the liquid coincides with the longitudinal direction of the strands, the resistance produced by the fiber strands is small. Therefore, if the fiber strands in this member are arranged in a specific direction (primary direction), it is possible to control the directionality of the liquid flow in this member; the liquid flows more efficiently in the direction parallel to the primary direction of the fiber strand arrangement than in the direction perpendicular to the primary direction of the fiber strand arrangement.

Therefore, it is possible to prevent the liquid supplied into the capillary force generating member storage container through gas-liquid exchange from flowing, while dispersing, straight toward the interface between the gas and liquid, by providing the capillary force generating member with a layer, in which the primary direction in which the fiber strands are arranged is approximately horizontal, and the location of which coincides with the interface between the gas and liquid while the liquid is supplied into the capillary force generating member through the gas-liquid exchange in the capillary force generating member, so that the interface between the gas and liquid can be stabilized.

The liquid supplying system in another embodiment of the present invention for accomplishing the second object is characterized in that a layer in which the primary direction of the fiber strands is approximately horizontal is positioned in the region of the capillary force generating member, adjacent to the top end of the connective path portion formed as the liquid supply container is connected to the capillary force generating member storage container.

As liquid is supplied to the capillary force generating member through the connective path portion between the capillary force generating member storage container and liquid supply container, gas-liquid exchange occurs mainly through this connective path portion. Therefore, normally, the gas-liquid interface in the capillary force generating member occurs in the region adjacent to the top portion of this connective path portion. Thus, if the fiber strands in this region adjacent to the top end of the connective path portion are arranged in the approximately horizontal direction, the gas-liquid interface stabilizes.

The liquid supplying system in another embodiment of the present invention for accomplishing the aforementioned second object is characterized in that the capillary force generating member is provided with a layer in which the fiber strands possesses directionality, that is, a layer as a liquid movement controlling portion for regulating the liquid movement in the capillary force generating member, With the provision of this type of liquid movement controlling portion, it is possible to control the direction of the liquid movement in the capillary force generating member so that the liquid is moved in the desired direction, in order to enhancing the liquid delivery from the liquid supplying system, and to prevent the liquid from leaking from the portion other than the liquid delivery opening of the liquid supplying system.

The liquid supplying system in another embodiment of the present invention for accomplishing the aforementioned second object is characterized in that a layer in which the fiber strands possesses directionality in arrangement is provided so that the fiber strands arranged in the primary direction keep horizontal the gas-liquid interface in the capillary force generating member, during a liquid supplying operation.

It is conceivable that if the amount of the liquid which is naturally supplied from the liquid supply container to the capillary force generating member storage container due to the changes in the temperature or ambient pressure of the environment in which the liquid supplying system is used (or naturally supplied from the capillary force generating member storage container to the liquid supply container) changes, the gas-liquid interface shifts in the gravity direction. During this shift, if the gas-liquid interface is not horizontal, a portion or portions of the gas-liquid interface which have deformed in the gravity direction further deform, reaching the top surface of the capillary force generating member, or the bottom side of the liquid delivery opening. On the other hand, when the gas-liquid interface is horizontal, the entirety of the gas-liquid interface moves, remaining flat and horizontal, and therefore, ratio of the amount of the gas-liquid interface movement relative to the amount of the change in the amount of the liquid supplied to the capillary force generating member storage container is smaller compared to when the gas-liquid interface is not horizontal. Thus, by making the gas-liquid interface horizontal with the provision of a layer formed of fiber, it is possible to prevent liquid leaking from the top surface of the capillary force generating member due to the upward movement of the gas-liquid interface, or liquid from failing to be supplied to the liquid delivery opening due to the downward movement of the gas-liquid interface.

Further, when the capillary force generating member storage container is provided with a delivery opening for drawing out ink, in addition to the connective path portion to the liquid supply container, by providing the region of the capillary force generating member connecting the delivery opening and the top end of the connective path portion, with a layer in which the primary direction in which the fiber strands are arranged is approximately horizontal, it is possible to prevent the flow of the liquid guided from the liquid supply container to the delivery opening through the capillary force generating member as the gas-liquid interface in the capillary force generating member moves downward from the delivery opening or the top end of the connective path portion, from worsening.

In other words, where liquid flows is in the region below the gas-liquid interface, and therefore, as the gas-liquid interface moves below the top end of the delivery opening, the liquid does not flow into the region above the gas-liquid interface. Thus, the mount of the liquid which flows along this surface reduces compared to when the liquid flows on both sides of the gas-liquid interface, worsening the flow. Similarly, as the gas-liquid interface moves below the top end of the connective portion, the amount of the liquid which flows the opening surface of the connective portion reduces, and therefore, the liquid flow worsens. Therefore, if a fibrous layer, in which the primary direction in which the fiber strands are arranged is approximately horizontal, is provided in the region connecting the top end of the connective portion and the top end of the delivery opening, it is difficult for the gas-liquid interface to move in the direction perpendicular to the fiber strand arrangement direction, and therefore, it is possible to prevent the liquid flow from worsening.

Further, if an air introduction path for introducing the atmospheric air is provided in the internal surface of the wall which constitutes the connective path portion between the capillary force generating member storage container and liquid storage portion, the gas-liquid interface develops at the top end portion of the air vent. In this case, therefore, it only has to be at the top end portion of the air introduction path where the layer in which the primary direction in which the fiber strands are arrange is approximately horizontal is disposed.

Further, the liquid supplying system in accordance with the present invention for accomplishing the third object of the present invention is characterized in that in a liquid supplying system comprising: a capillary force generating member storage container which stores therein a capillary force generating member for retaining liquid, and is provided with a liquid delivery portion for delivering outward the liquid retained in the capillary force generating member, and an air vent through which the capillary force generating member is exposed to the atmospheric air, and a liquid storage container which is provided with a liquid storage portion for storing therein the liquid to be supplied to said capillary force generating member storage container, and a connective path portion for supplying the liquid to the capillary force generating member storage container, and forms therein a virtually sealed space except for the presence of the connective path portion, the connective path portion is positioned higher than the liquid delivery portion, and lower than the top surface of the capillary force generating member.

In the liquid supplying system structured as described above, the connective path portion is positioned at a level higher than the liquid delivery portion, so that the length of the liquid route from the connective path portion to the liquid delivery portion, in the capillary force generating member, falls in a desired range. Therefore, the difference in the effects to which the ingredients of liquid are subjected, which occurs because of the difference in the route taken by the liquid as it flows from the connective path portion to the liquid delivery portion, can be reduced.

Further, the present invention is such an invention that provides a capillary force generating member storage container, a liquid supply container, an ink jet head cartridge, an ink jet recording apparatus, and ink container, which are capable of accomplishing the above described objects.

The liquid supplying container in accordance with the present invention is characterized in that it is a liquid supply container to be connected to a capillary force generating member storage container storing a capillary force generating member provided with a layer in which the primary direction in which the fiber strands are arranged is approximately horizontal, and comprises: a liquid storage portion forming a virtually sealed space therein; a delivery portion through which the liquid stored in the liquid storage portion is drawn out, and which constitutes a connective path portion at which the liquid supply container is connected to capillary force generating member storage container; and a sealing means for airtightly sealing the delivery portion, wherein the connective path portion is positioned at level below the top end of the fibrous layer of the capillary force generating member.

The capillary force generating member storage container in accordance with the present invention is characterized in that it is a capillary force generating member storage contained, which comprises: a connective path portion for drawing liquid from an external liquid supplying means; a liquid delivery means for delivering liquid to an external portion different from the liquid supplying means; and which stores therein a capillary force generating member for temporarily retaining liquid, and is provided with an air vent through which the internal space is connected to the atmospheric air, wherein gas-liquid exchange for receiving liquid by drawing gas into liquid supplying means occurs, and wherein the capillary force generating member is provided with a layer in which the primary direction in which fiber strands therein are arranged is approximately horizontal, and this layer is at the interface between the gas and liquid in the capillary force generating member, at which the gas-liquid exchange occurs for supplying liquid.

The capillary force generating member storage container in another embodiment of the present invention is characterized in that it is a capillary force generating member storage container, which comprises: a capillary force generating member for retaining liquid; a liquid delivery portion for delivering outward the liquid retained in the capillary force generating member; an air vent through which the capillary force generating member is exposed to the atmospheric air; and a connective path portion at which the capillary force generating member storage container is connected to the connective path portion of a liquid storage container which forms a virtually sealed space except for the presence of the connective path portion for supplying liquid to the capillary force generating member, and in which the connective path portion is positioned at a level higher than the position of the liquid delivery portion, and below the top surface of the capillary force generating member.

Further, an ink jet head cartridge in accordance with the present invention is characterized in that it is an ink jet head cartridge which comprises a liquid supplying system for supplying liquid, and a liquid ejection recording head portion which receives liquid from the liquid supplying system, and records by ejecting the liquid, and in which the liquid supplying system is the liquid supplying system described, above, and the recording head receives liquid from the liquid delivery portion of the capillary force generating member storage container.

An ink jet recording apparatus in accordance with the present invention is characterized in that it is an ink jet recording apparatus which comprises an ink jet head cartridge which records by ejecting liquid, and a carriage which removably holds the ink jet head cartridge supported in a manner to be reciprocally movable along the surface of recording medium;

wherein the ink jet head cartridge is provided with the liquid supplying system disclosed in above, and a liquid election recording head portion which receives liquid from the liquid delivery portion of the capillary force generating member storage container of this system, and records by ejecting the liquid, and in which the ink jet recording head cartridge is further provided with a head recovery unit for performing a recovery operation for the liquid ejection recording head portion.

The ink container in accordance with the present invention is compatible with the characteristics of the above described liquid supplying system. The ink container in accordance with the present invention is characterized in that it is an ink container which comprises: a liquid supply chamber, which has a liquid storage portion for storing liquid in the sealed space therein, and a capillary force generating member storage chamber, the internal space of which is connected to the internal space of the liquid storage portion through the connective path portion between the two chambers, and which contains a capillary force generating member, and supplies liquid through gas-liquid exchange, that is, a process in which gas is drawn into the liquid storage portion through the connective path portion so that the liquid in the liquid storage portion is drawn out into the capillary force generating member storage chamber, and in which the capillary force generating member is provided with a layer in which the primary direction in which fiber strands therein are arranged is approximately horizontal, and this layer is at the interface between the gas and liquid in the capillary force generating member, at which the gas-liquid exchange occurs for supplying liquid.

The ink container in another embodiment of the present invention is characterized in that it is an ink container which comprises: a capillary force generating member storage chamber which stores therein a capillary force generating member for retaining liquid, and is provided with a liquid delivery portion for delivering outward the liquid retained in the capillary force generating member, and an air vent through which the capillary force generating member is exposed to the atmospheric air; and a liquid storage container which is provided with a liquid storage portion for storing therein the liquid to be supplied to said capillary force generating member storage chamber, and a connective path portion for supplying the liquid to the capillary force generating member storage chamber, and forms therein a virtually sealed space except for the presence of the connective path portion; and in which the connective path portion is positioned at a level higher than the liquid delivery portion.

Further, the liquid supplying system in another embodiment of the present invention is characterized in that it is a liquid supplying system which comprises: a capillary force generating member storage container which stores therein a capillary force generating member for retaining liquid, and is provided with a liquid delivery portion for delivering outward the liquid retained in the capillary force generating member, and an air vent through which the capillary force generating member is exposed to the atmospheric air; and a liquid storage container which is provided with a liquid storage portion for storing therein the liquid to be supplied to said capillary force generating member storage container, and a connective path portion for supplying the liquid to said capillary force generating member storage container, and forms therein a virtually sealed space except for the presence of the connective path portion; and in which the connective path portion is positioned at a level higher than the liquid delivery portion, and below the top surface of the capillary force generating member; and in which a capillary force generating member comprises: a first capillary force generating portion connected to the air vent; a second capillary force generating portion which generates a larger capillary force than the first capillary force generating portion, and is connected to the connective path portion; and a third capillary force generating portion which generates a larger capillary force than the second capillary force generating portion, and is connected to the liquid delivery portion; wherein the intersection between the interface between the first and second capillary force generating portions, and the wall in which the connective path portion is provided, is positioned at a level above the bottom end of the connective path portion; and wherein the interface between the second and third capillary force generating portions, and the wall in which the connective path portion is provided, is positioned at a level above the top end of the connective path portion, and above the bottom end of the connective path portion.

According to the above described structure, it is assured that liquid is retained in the capillary force generating member in which the route from the connective path portion to the liquid delivery portion is formed during a liquid supplying operation in which liquid is supplied from the liquid supply container through gas-liquid exchange, making it possible to realize a more stable ink supplying operation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described in detail with reference to the appended drawings.

In the description of the following embodiments of the present invention, the liquid used in the liquid supplying method and liquid supplying system in accordance with the present invention is described as ink. However, the choice of the liquid usable with the above method and system is not limited to ink; for example, it obviously includes processing liquid used for processing recording medium in the field of ink jet recording.

The "hardness" of a capillary force generating portion means the "hardness" of the capillary force generating portion when the capillary force generating member is in the liquid container. It is defined by the inclination (base unit: kgf/mm) of the amount of resiliency of the capillary force generating member relative to the amount of deformation. As for the difference in hardness between two capillary force generating members, a capillary force generating member which is greater in the inclination in the amount of resiliency relative to the amount of deformation is considered to be "harder capillary force generating member".

(First Embodiment)

Figure 2:
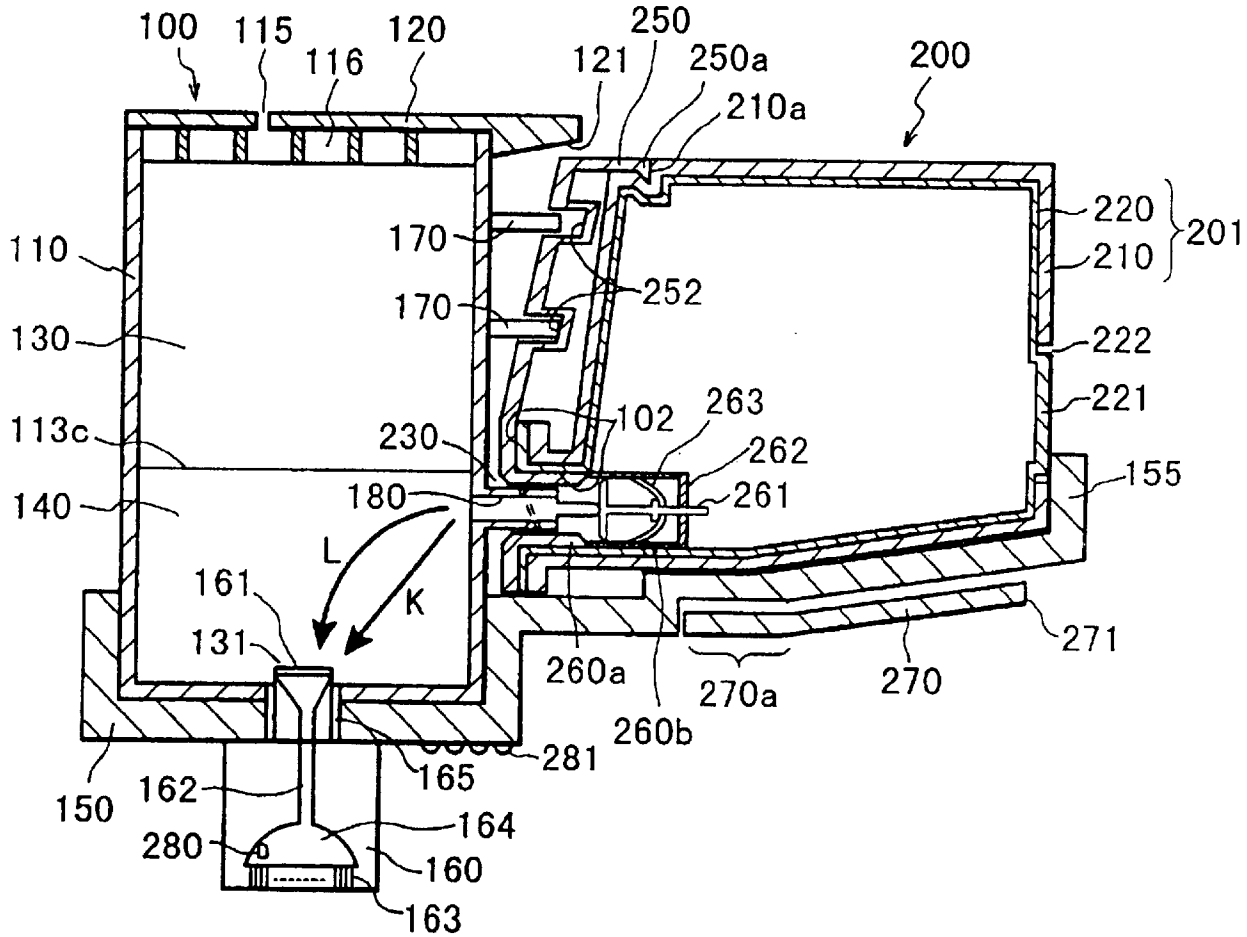
FIG. 2 is a sectional view of the ink jet head cartridge in the first embodiment of the present invention.

FIG. 2 is a sectional view of the ink jet head cartridge in the first embodiment of the present invention.

In this embodiment, each of the structural components of the ink jet head cartridge in accordance with the present invention, and the relationship among these components, will be described. Since the ink jet head cartridge in this embodiment was structured so that a number of innovative technologies, which were developed during the making of the present invention, could be applied to the ink jet cartridge which was being invented, the innovative structures will also be described as the overall description of this ink jet head cartridge is given.

Referring to FIG. 2, the ink jet head cartridge in this embodiment comprises an ink jet head unit 160, a holder 150, a negative pressure controlling chamber unit 100, an ink container unit 200, and the like. The negative pressure controlling chamber unit 100 is fixed to the inward side of the holder 150. Below the negative pressure controlling chamber unit 100, the ink jet head is attached to the outward side of the bottom wall portion of the holder 150. Using screws or interlocking structures, for ease of disassembly, to fix the negative pressure controlling chamber unit 100 and ink let head unit 160 to the holder 150 is desirable in terms of recycling, and also is effective for reducing the cost increase which is incurred by the structural modification or the like. Further, since the various components are different in the length of service life, the aforementioned ease of disassembly is also desirable because it makes it easier to replace only the components which need to be replaced. It is obvious, however, that they may be permanently connected to each other by welding, thermal crimping, or the like. The negative pressure controlling chamber unit 100 comprises: a negative pressure controlling chamber shell 110, which is open at the top; a negative pressure controlling chamber cover 120 which is attached to the top portion of the negative pressure controlling chamber shell 110 to cover the opening of the negative pressure controlling chamber shell 110; two pieces of absorbent material 130 and 140 which are placed in the negative pressure controlling chamber shell 110 to hold ink by impregnation. The absorbent material pieces 130 and 140 are filled in vertical layers in the negative pressure controlling chamber shell 110, with the absorbent material piece 130 being on top of the absorbent material piece 140, so that when the ink jet head cartridge is in use, the absorbent material pieces 130 and 140 remain in contact with each other with no gap between them. The capillary force generated by the absorbent material piece 140, which is at the bottom, is greater than the capillary force generated by the absorbent material piece 130 which is at the top, and therefore, the absorbent material piece 140 which is at the bottom is greater in ink retainment. To the ink jet head unit 160, the ink within the negative pressure controlling chamber unit 100 is supplied through an ink supply tube 165.

The opening 131 of the ink supply tube 160, on the absorbent material piece 140 side, is provided with a filter 161, which is in contact with the absorbent material piece 140, being under the pressure. The ink container unit 200 is structured so that it can be removably mounted in the holder 150. A joint pipe 180, which is a portion of the negative pressure controlling chamber shell 110 and is located on the ink container unit 200 side, is connected to the joint opening 230 of the ink container unit 200 by being inserted thereinto. The negative pressure controlling chamber unit 100 and ink container unit 200 are structured so that the ink within the ink container unit 200 is supplied into the negative pressure controlling chamber unit 100 through the joint portion between the joint pipe 180 and joint opening 230. Above the joint pipe 180 of the negative pressure controlling chamber shell 110, on the ink container unit 200 side, there are ID members 170 for preventing the ink container unit 200 from being incorrectly installed, which project from the surface of the holder 150, on the ink container unit 200 side.

The negative pressure controlling chamber cover 120 is provided with an air vent 115 through which the internal space of the negative pressure controlling chamber shell 110 is connected to the outside; more precisely, the absorbent material piece 130 filled in the negative pressure controlling chamber shell 110 is exposed to the outside air. Within the negative pressure controlling chamber shell 110 and adjacent to the air vent, there is a buffering space 116, which comprises an empty space formed by a plurality of ribs projecting inwardly from the inward surface of the negative pressure controlling chamber cover 120, on the absorbent material piece 130 side, and a portion of the absorbent material piece 130, in which no ink (liquid) is present.

On the inward side of the joint opening 230, a valve mechanism is provided, which comprises a first valve body 260*a*, a second valve body 260*b*, a valve plug 261, a valve cover 262, and a resilient member 263. The valve plug 261 is held within the second valve body 260*b*, being allowed to slide within the second valve body 260*b* and also being kept under the pressure generated toward the first valve body 260*a* by the resilient member 263. Thus, unless the joint pipe 180 is inserted through the joint opening 230, the edge of the first valve plug 261, on the first valve body 260*a* side, is kept pressed against the first valve body 260*a* by the pressure generated by the resilient member 263, and therefore, the ink container unit 200 remains airtightly, as well as liquid-tightly, sealed.

As the joint pipe 180 is inserted into the ink container unit 200 through the joint opening 230, the valve plug 261 is moved by the joint pipe 180 in the direction to separate it from the first valve body 260*a*. As a result, the internal space of the joint pipe 180 is connected to the internal space of the ink container unit 200 through the opening provided in the side wall of the second valve body 260*b*, breaking the airtightness of the ink container unit 200. Consequently, the ink in the ink container unit 200 begins to be supplied into the negative pressure controlling chamber unit 100 through the joint opening 230 and joint pipe 180. In other words, as the valve within the joint opening 230 opens, the internal space of the ink storage portion of the ink container unit 200, which remained airtightly sealed, becomes connected to the negative pressure controlling chamber unit 100 only through the aforementioned opening.

It should be noted here that fixing the ink jet head unit 160 and negative pressure controlling chamber unit 100 to the holder 150 with the use of easily reversible means, such as screws, as is done in this embodiment, is desirable because the two units 160 and 100 can be easily replaced according to the lengths of their expected service lives.

More specifically, in the case of the ink jet head cartridge in this embodiment, the provision of an ID member or a plurality of ID members on each ink container makes it rare that an ink container for containing one type of ink is connected to a negative pressure controlling chamber for an ink container for containing another type of ink. Further, should the ID member provided on the negative pressure controlling chamber unit 100 be damaged, or should a user deliberately connect an ink container to a wrong negative pressure controlling chamber unit 100, all that is necessary is to replace only the negative pressure control chamber unit 100 as long as it is immediately after the incident. Further, if the holder 150 is damaged by falling or the like, it is possible to replace only the holder 150.

It is desirable that the points, at which the ink container unit 200, negative pressure controlling chamber unit 100, holder 150, and ink jet head unit 160, are interlocked to each other, are chosen to prevent ink from leaking from any of these units when they are disassembled from each other.

In this embodiment, the ink container unit 200 is held to the negative pressure controlling chamber unit 100 by the ink container retaining portion 155 of the holder 150. Therefore, it does not occur that only the negative pressure controlling chamber unit 100 becomes disengaged from the other units, inclusive of the negative pressure controlling chamber unit 100, interlocked among them. In other words, the above components are structured so that unless at least the ink container unit 200 is removed from the holder 150, it is difficult to remove the negative pressure controlling chamber unit 100 from the holder 150. As described above, the negative pressure controlling chamber unit 100 is structured so that it can be easily removed only after the ink container unit 200 is removed from the holder 150. Therefore, there is no possibility that the ink container unit 200 will inadvertently separate from the negative pressure controlling chamber unit 100 and ink leak from the joint portion.

The end portion of the ink supply tube 165 of the ink jet head unit 160 is provided with the filter 161, and therefore, even after the negative pressure controlling chamber unit 100 is removed, there is no possibility that the ink within the ink jet head unit 160 will leak out. In addition, the negative pressure controlling chamber unit 100 is provided with the buffering space 116 (inclusive of the portions of the absorbent material piece 130 and the portions of the absorbent material piece 140, in which no ink is present), and also, the negative pressure controlling chamber unit 100 is designed so that when the attitude of the negative pressure controlling chamber unit 100 is such an attitude that is assumed when the printer is being used, the interface 113*c* between the two absorbent material pieces 130 and 140, which are different in the amount of the capillary force, is positioned higher than the joint pipe 180 (preferably, the capillary force generated at the interface 113*c* and its adjacencies becomes greater than the capillary force in the other portions of the absorbent material pieces 130 and 140) Therefore, even if the structural conglomeration comprising the holder 150, negative pressure controlling chamber unit 100, and ink container unit 200, changes in attitude, there is very little possibility of ink leakage. Thus in this embodiment, the portion of the ink jet head unit 160, by which the ink jet head unit 160 is attached to the holder 150, is located on the bottom side, that is, the side where the electric terminals of the holder 150 are located, so that the ink jet head unit 160 can be easily removed even when the ink container unit 200 is in the holder 150.

Depending upon the shape of the holder 150, the negative pressure controlling chamber unit 100 or ink jet head unit 160 may be integral with, that is, inseparable from, the holder 150. As for a method for integration, they may be integrally formed from the beginning of manufacture, or may be separately formed, and integrated thereafter by thermal crimping or the like so that they become inseparable.

Figure 3:
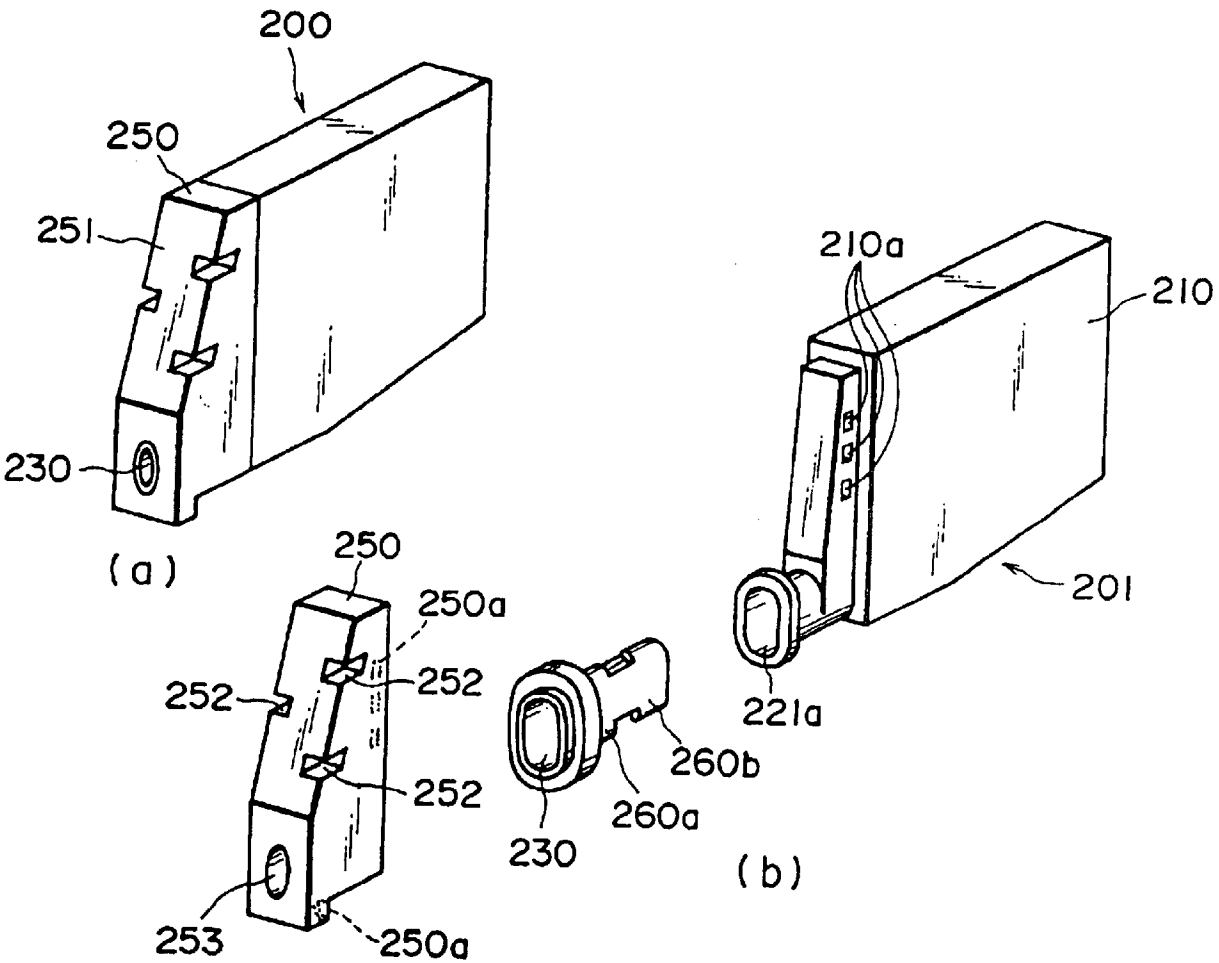
FIG. 3 is a perspective drawing for depicting the ink container shown in FIG. 2.

FIG. 3 is a perspective view for describing the ink container unit 200 illustrated in FIG. 2. FIG. 3, (*a*), is a perspective view of the ink container unit 200, and FIG. 3, (*b*), is a perspective view of the disassembled ink container unit 200.

Referring to FIGS. 2, 3(*a*), and 3(*b*), the ink container unit 200 comprises an ink storage container 201, and the ID member 250. The ID member 250 is a member for preventing installation mistakes which occur during the joining of ink container unit 200 to negative pressure controlling chamber unit 100. This ID member 250 is provided with the above described first valve body 260*a*, which is used as a structural part of a valve mechanism for controlling the ink flow within the joint opening 230. This valve mechanism opens or closes by being engaged with the joint pipe 180 of the negative pressure controlling chamber unit 100.

The front side of the ID member 250, that is, the side which faces the negative pressure controlling chamber unit 100, is slanted backward from the point slightly above the supply outlet hole 253, forming a slanted surface 251. More specifically, the bottom end, that is, the joint opening 230 side, of the slanted surface 251 is the front side, and the top end, that is, the ink storing container 201 side, of the slanted surface 251 is the rear side. The slanted surface 251 is provided with ID member slots 252*a*, 252*b* and 252*c* for preventing the wrong installation of the ink container unit 200. Also in this embodiment, the ID member 250 is positioned on the front surface (surface with the supply outlet), that is, the surface which faces the negative pressure controlling chamber unit 100, of the ink storage container 201.

The ink storage container 201 is a hollow container in the form of an approximately polygonal prism, and is enabled to generate negative pressure. It comprises the external shell 210, and the internal. pouch 220, which are separable from each other. The internal pouch 220 is flexible, and is capable of changing in shape as the ink held therein is drawn out. Also, the internal pouch 220 is provided with a pinch-off portion (welding seam portion) 221, at which the internal pouch 220 is attached to the external shell 210; the internal pouch 220 is supported by the external shell 210. Adjacent to the pinch-off portion 221, the air vent 222 of the external shell 210 is located, through which the outside air can be introduced into the space between the internal pouch 220 and external shell 210.

Figure 14:
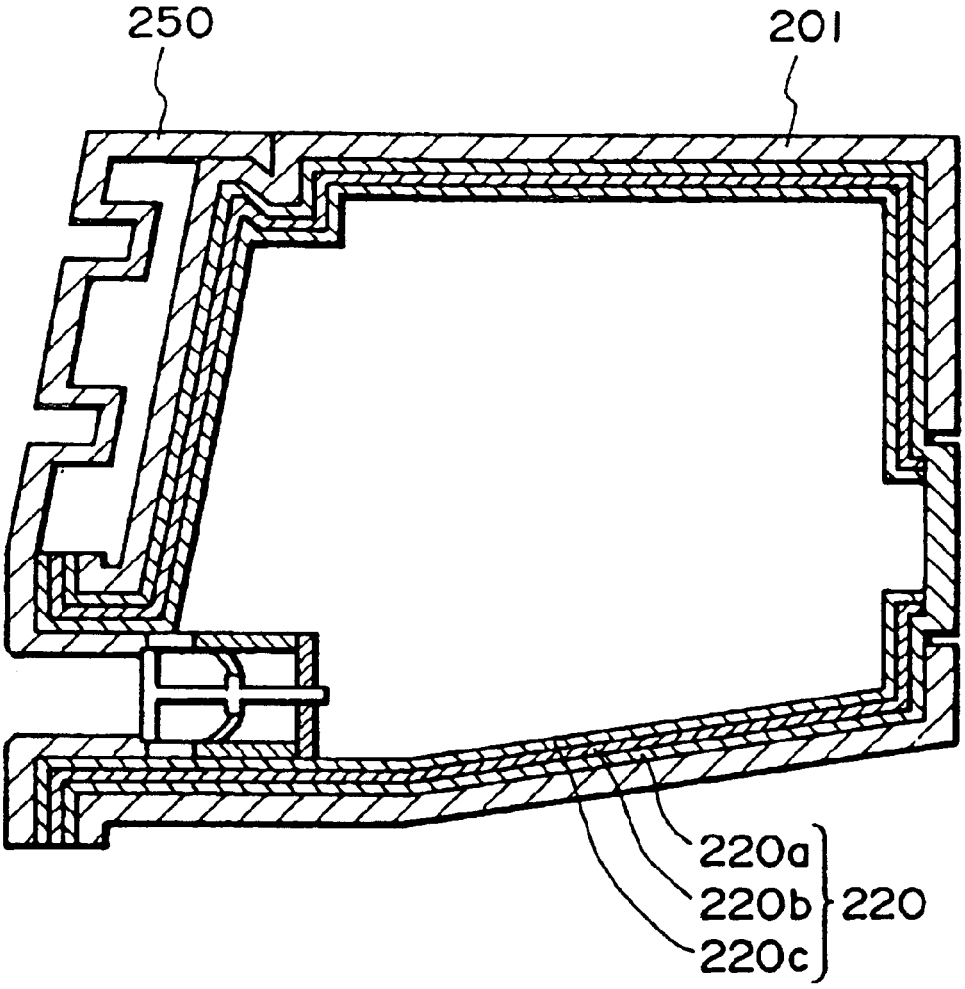
FIG. 14 is a sectional view of an ink container unit comprising an internal ink pouch with a three layer structure.

Referring to FIG. 14, the internal pouch 220 is a laminar pouch, having three layers different in function: a liquid contact layer 220*c*, or the layer which makes contact with the liquid; an elastic modulus controlling layer 220*b*; and a gas barrier layer 220*a* superior in blocking gas permeation. The elastic modulus of the elastic modulus controlling layer 220*b* remains virtually stable within the temperature range in which the ink storage container 201 is used; in other words, the elastic modulus of the internal pouch 220 is kept virtually stable by the elastic modulus controlling layer 220*b* within the temperature range in which the ink storage container 201 is used. The middle and outermost layers of the internal pouch 220 may be switched in position; the elastic modulus controlling layer 220*b* and gas barrier layer 220*a* may be the outermost layer and middle layer, respectively.

Structuring the internal pouch 220 as described above makes it possible for the internal pouch 220 to synergistically display each of the individual functions of the ink-resistant layer 220*c*, elastic modulus controlling layer 220*b*, and gas barrier layer 220*a*, while using only a small number of layers. Thus, the temperature sensitive properties, for example, the elastic modulus, of the internal pouch 220 is less likely to be affected by the temperature change. In other words, the elastic modulus of the internal pouch 220 can be kept within the proper range for controlling the negative pressure in the ink storage container 201, within the temperature range in which the ink storage container 201 is used. Therefore, the internal pouch 220 is enabled to function as the buffer for the ink within the ink storing container 201 and negative pressure controlling chamber shell. Consequently, it becomes possible to reduce the size of the buffering chamber, that is, the portion of the internal space of the negative pressure controlling chamber shell 110, which is not filled with ink absorbing material, inclusive of the portion of the absorbent material piece 130, in which ink is not present, and the portion of the absorbent material piece 140, in which ink is not present. Therefore, it is possible to reduce the size of the negative pressure controlling chamber unit 100, which in turn makes it possible to realize an ink jet head cartridge 70 which is superior in operational efficiency.

In this embodiment, polypropylene is used as the material for the liquid contact layer 220*c*, or the innermost layer, of the internal pouch 220, and cyclic olefin copolymer is used as the material for the elastic modulus controlling layer 220*b*, or the middle layer. As for the material for the gas barrier layer 220*a*, or the outermost layer, EVOH (ethylene-vinyl acetate copolymer: EVA resin) is used. It is desired that functional adhesive resin is mixed in the elastic modulus controlling layer 220*b*, because such a mixture eliminates the need for an adhesive layer between the adjacent functional layers, reducing the thickness of the wall of the internal pouch 220. As for the material for the external shell 210, polypropylene is used, as it is used for the material for the innermost layer of the internal pouch 220. Polypropylene is also used as the material for the ID member 250.

The ID member 250 is provided with a plurality of ID member slots 252, which are arranged at the left and right edges of the front surface, corresponding to the plurality of ID members 170 for the prevention of the incorrect installation of the ink container unit 200, and the joint opening 230 which engages with the joint pipe 180. It is fixed to the ink storage container 201. The installation mistake preventing function is provided by the installation mistake prevention mechanism, which comprises the plurality of ID members 170 provided on the negative pressure controlling chamber unit 100 side, and the ID member slots 252 provided by the ID member 250 corresponding to the positions of the ID members 170. Therefore, the ID members and ID member slots can be made to perform various functions, by changing the shapes and positions of the ID members 170 and ID member slots 252.

The ID member slots 252 of the ID member 250, and the joint opening 230, are located in the front surface of the ink container unit 200, that is, the front side in terms of the direction in which the ink container unit 200 is installed or removed. They are parts of the ID member 250. Further, by forming the ID member slots 252 and joint opening 230 as different portions of a single member, the accuracy in the positional relationship between the joint opening 230 and ID member slots 252 can be improved. The interferences caused by the ID members 170 and the joint pipe 130 during the installation make it possible to prevent the container from being incorrectly installed. Further, by forming the ink storage container 201 and ID member 250 with the use of blow molding and injection molding, respectively, in other words, by forming the ink container unit 200 as a two-piece component, the ID member 250 can be formed so that the joint opening 230 and ID member slots 252 are precisely positioned relative to each other.

If the ID member slots 252 are directly formed as the portions of the wall of the ink storage container 201 by blow molding, the separation of the internal pouch 100 wall, or the inner layer of the ink storage container 201, which sometimes affects the negative pressure generated by the ink container unit 200, is affected. Separately forming the ID member 250 and ink container portion 201, and then attaching the ID member 250 to the ink containing portion 202, as the ink container unit 200 in this embodiment is structured, eliminates the aforementioned effect, making it possible to generate and maintain stable negative pressure in the ink storing container 201.

The ID member 250 is joined with both the external shell 210 and internal pouch 220 of the ink storage container 201. More specifically, the ID member 250 is joined with the internal pouch 220 by welding between the sealing surface 102 of the internal pouch 220, which corresponds to where the ink is drawn out of the ink storage container 201, and the surface portion of the ID member 250, which corresponds to the sealing surface 102. Since the material for the external shell 210 is the same material, or polypropylene, for the innermost layer of the internal pouch 220, it is possible to weld between the ID member 250 and internal pouch 220, along the periphery of the joint opening 230.

With the above described arrangement, the ink delivery opening portion of the ink storage container 201 is completely sealed, and therefore, the ink leakage or the like which occurs at the seal portions between the ID member 250 and ink storage container 201 during the installation or removal of the ink container unit 200 is prevented. It is desired that when the joining is done with welding as it is in the case of the ink container unit 200 in this embodiment, the material for the layer which provides the joining surface of the internal pouch 220, and the material for the ID member 250 are the same, in order to improve the sealing performance of the seam.

As for the joining of the external shell 210 and ID member 250 to each other, the engagement portion 210*a* provided in the upwardly facing surface of the external shell 210, is engaged with the clicks (unillustrated) provided in the top portion of the ID member 250, and the engagement portions 210*b* and 210*c* provided in the laterally facing surfaces of the external shell 210 are engaged with the click portions 210*b* and 210*c* on the ID member 250 side, which almost immovably fixes the ID member 250 to the external shell 210. The phrase "almost immovably fixing" means fixing with the use of a desirable structural arrangement characterized in that it comprises a combination of a projection and a recess, or the like, which can be easily engaged or interlocked, and also can be easily disengaged. By almost immovably fixing the ID member 250 to the ink storing container 201 as described above, the shock generated by the contact between the ID member 170 and ID member slots 252 during the installation or removal can be absorbed, preventing the occurrences of damage to the ink container unit 200 and negative pressure controlling chamber unit 100.

Further, by partially and yet almost immovably fixing the ID member 250 to the ink storing container 201 as described above, it becomes easier to disassemble the ink container unit 200, improving efficiency in recycling. Forming the engagement indentation as the engagement portion 210*a* in the upward facing wall of the external shell 210 as described above makes it possible to simplify the structure of the ink storing container 201, for its production with the use of blow molding, which in turn makes it easier to simplify the molds, and also to control the film thickness.

In addition, when joining the external shell 210 and ID member 250 to each other, it is desired that the points at which the ID member 250 is welded to the external shell 210 to fix the ID member 250 to the external shell 210, includes the position adjacent to the top portion of the joint opening 230. This arrangement assures that the ID member 250 is fixed so that the center of the ID member 250 vertically lines up with the axial line of the joint opening 230 (major axis of the joint opening 230). Therefore, it is possible to increase the integrity of the ink container unit 200 against the force generated in the aforementioned axial direction during the installation. Further, since a small amount of rotational movement is allowed, it is possible to stabilize the installation of the ink container unit 200.

Further, regarding the ink storing container 201, the portion covered by the ID member 250 is recessed, and the ink delivery portion projects. Therefore, the projecting portions on the front surface of the ink container unit 200 can be covered by fixing the ID member 250 to the ink storing container 201. The relationship between the engagement portions 210*a* of the external shell 210 and the click portions 250*a* of the ID member 250 in terms which is projecting and which is recessed may be reversal. It is desired that the points at which the ID member 250 is almost immovably fixed to the ink container unit 200 are located in a manner to encircle the sealing surface 102 of the internal pouch 220. This placement renders the welding seam between the ID member 250 and the ink container unit 200 strong enough to withstand the force which applies to the ID member 250 during the installation or removal of the ink container unit 200. Also, the positions of the ink storing container 201 and ID member 250 can be regulated in terms of both the vertical and horizontal directions. The method for joining the ink storage container 201 and ID member 250 to each other does not need to be limited to those methods presented in the above description of the embodiments; other methods may be used.

Slanting the bottom wall of the ink storage container 201 so that the position of the ink containing portion engagement portion 155 side of the bottom wall of the ink storing container 201 becomes higher than that of the front end of the ink storing container 201, as in this embodiment, prevents the ink container unit 200 from rubbing against the holder 150 more than necessary during its rotational motion. Therefore, the ink container unit 200 can be smoothly installed or removed.

Figure 17:
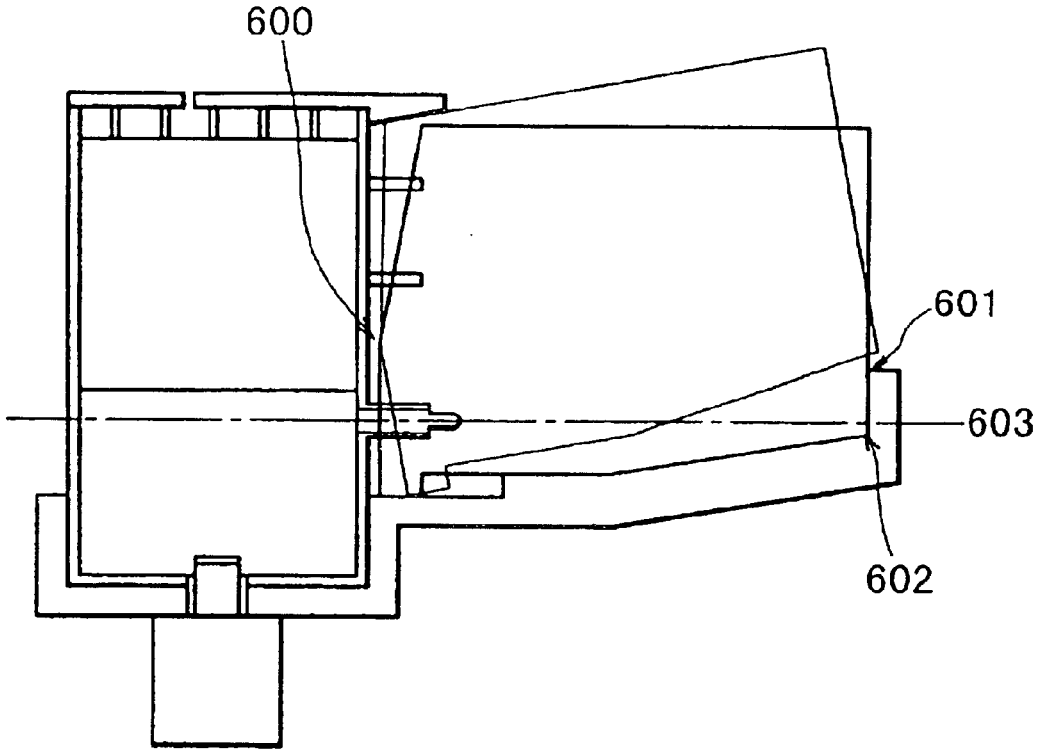
FIG. 17 is a drawing for describing the relationship between the rotational center and the engagement portions during the operation in which the ink container unit is installed into, or removed from, the holder.

Referring to FIGS. 2 and 17, the bottom wall of the ink storing container 201 is slanted and is engaged with the ink containing unit engagement portion 155 of the holder 150, by the bottom rear portion, that is, the portion opposite to the ink outlet side. The holder 150 and ink container unit 200 are structured so that when removing the ink container unit 200 from the holder 150, the portion of the ink storing container 201, which is in contact with the ink containing portion engagement portion 155, can be moved upward. In other words, when the ink container unit 200 is removed, the ink container unit 200 is rotated by a small angle. During the installation or removal of the ink container unit 201 which slightly rotates, depending upon the relationship between the distance from the rotational center of the ink container unit 200 to the bottom rear corner of the ink container unit 200 corresponding to the ink containing unit engagement portion 155, and the distance from the same rotational center to the ink containing unit engagement portion 155, the ink container unit 200 heavily rubs against the ink container engagement portion 155, causing various problems; for example, a substantially greater amount of force is required to install or remove the ink container unit 200, which sometimes causes problems such as deformation of the engagement portions on both the ink container unit 200 side and holder 150 side.

Referring to FIGS. 2 and 17, in this embodiment, the joint opening 230 of the ink jet head cartridge is located in the bottom portion of the sidewall of the ink storage container 201, on the negative pressure controlling chamber unit side, and the bottom portion of another wall of the ink storage container 201, that is, the wall opposite to the wall in which the joint opening 230 is located is engaged with the ink container engagement portion 155; in other words, the bottom rear portion of the ink storage container 201 is engaged with the ink storage container engagement portion 155. Also, the ink storage container engagement portion 155 extends upward from the bottom wall of the holder 150, so that the position of the top portion of the ink storage container engagement portion 155 becomes approximately the same as the position 603 of the horizontal center line of the joint opening 230, in terms of the vertical direction. With this arrangement, it is assured that the horizontal movement of the joint opening 230 is regulated by the ink storing container engagement portion 155 to keep the joint opening 230 correctly connected with the joint pipe 180. In this embodiment, in order to assure that the joint opening 230 is correctly connected with the joint pipe 180 during the installation of the ink container unit 200, the top end of the ink storing container engagement portion 155 is positioned at approximately the same height as the upper portion of the joint opening 230, and the ink container unit 200 is removably installed into the holder 150 by rotating the ink container unit 200 about a portion of the front surface of the ink container unit 200 on the joint opening 230 side. During the installation or removal of the ink container unit 200, the portion of the ink container unit 200 which remains in contact with the negative pressure controlling chamber unit 100 functions as the rotational center for the ink container unit 200. As is evident from the above description, making the bottom wall of the ink storing container 201 of the ink jet head cartridge slanted upward toward its bottom rear portion as described above reduces the difference between the distance from the rotational center 600 to the top end 601 of the ink storing container engagement portion, and the distance from the rotational center 600 to the bottom end 602 of the ink storing container engagement portion. Therefore, the portions of the ink container unit 200, which make contact with the holder 150, and the portions of the holder 150, which make contact with the ink container unit 200, are prevented from strongly rubbing against each other. Therefore, the ink container unit 200 can be smoothly installed or removed, By shaping the ink storing container 201 and holder 150 as described above, it is possible to keep relatively small the size of the portion of the bottom rear portion of the ink storing container 201, which rubs against the ink storing container engagement portion 155 during the installation or removal of the ink container unit 200, and the size of the portion of the ink storing container engagement portion 155, which rubs against the bottom rear portion of the ink storing container 201, even if the joint opening 230 is enlarged, in terms of its height direction, to deliver ink at a greater volumetric rate. Therefore, the ink container unit 200 is prevented from uselessly rubbing against the ink storing container engagement portion 155 during the installation of the ink container unit 200 into the holder 150, and yet, it is assured that the ink container unit 200 remains firmly attached to the holder 150.

When the distance from the rotational center 600, about which the ink container unit 200 rotates during its installation or removal, to the bottom end 602 of the ink container engagement portion, is greater than the distance from the same rotational center 600 to the top end 601 of the ink container engagement portion, by an excessive margin, the force necessary for the installation or removal of the ink container unit 200 is excessively large, and therefore, it sometimes occurs that the top end 601 of the ink container engagement portion is shaved, or the ink storing container 201 deforms. Thus, the difference between the distance from the rotational center 600, about which the ink container unit 200 rotates during its installation or removal, to the bottom end 602 of the ink container engagement portion, and the distance from the same rotational center 600 to the top end 601 of the ink container engagement portion, should be as small as possible within a range in which the ink container unit 200 is retained in the holder 150 with a proper degree of firmness while affording smooth installation or removal of the ink container unit 200.

If the position of the rotational center 600 of the ink container unit 200 is made lower than the position of the center of the joint opening 230, the distance from the rotational center 600, about which the ink container unit 200 rotates during its installation or removal, to the top end 601 of the ink container engagement portion, becomes longer than the distance from the same rotational center 600 to the bottom end 602 of the ink container engagement portion. Therefore, it becomes difficult to accurately hold the ink storing container 201 at a point which is at the same height as the center of the joint opening 230. Thus, in order to accurately position the vertical center of the joint portion 230, it is desired that the position of the rotational center 600 of the ink container unit 200 is higher than the position of the vertical center of the joint opening 230.

If the structure of the ink container unit 200 is changed so that the position of the rotational center 600 of ink container unit 200 becomes higher than the position 603 of the vertical center of the joint opening 230, the portion of the ink container unit 200, which corresponds to the ink container engagement portion 155, becomes thicker, requiring the height of the ink storing container engagement portion 155 to be increased. As a result, there will be an increased possibility that the ink container unit 200 and holder 150 will be damaged. Thus, it is desired, in view of the smoothness of the installation or removal of the ink container unit 200, that the position of the rotational center 600 of the ink container unit 200 is close to the vertical center of the joint opening 230. The height of the ink container engagement portion 155 of the holder 150 has to be properly determined based only on the ease of the installation or removal of the ink container unit 200. However, if the height of the ink container engagement portion 155 is increased so that the position of its top end becomes higher than that of the rotational center 600, the length by which the ink container unit 200 contacts the ink container engagement portion 155 of the holder 150 becomes greater, which in turn increases the sizes of the portions on both sides, which rub against each other. Therefore, in consideration of the deterioration of the ink container unit 200 and holder 150, the height of the ink container engagement portion 155 is desired to be is such that the position of its top end is lower than that of the rotational center 600.

In the ink jet head cartridge in this embodiment, the elastic force for keeping the position of the ink storing container 201 fixed in terms of the horizontal direction is the force generated by the resilient member 263 for pressing the valve plug 261. However, the configuration for generating the above resiliency does not need to be limited to the one in this embodiment: the bottom rear end, or the engagement portion, of the ink storing container 201, the surface of the ink storage container engagement portion 155, on the ink storing container side, the negative pressure controlling chamber unit 100, or the like, may be provided with an elastic force generating means for keeping the position of the ink storing container 201 fixed in terms of the horizontal direction.

Next, the internal structure of the negative pressure controlling chamber unit 100 will be described.

In the negative pressure controlling chamber unit 100, the absorbent material pieces 130 and 140 are disposed in layers as members for generating negative pressure, the former being on top of the latter. Thus, the absorbent material piece 130 is exposed to the outside air through the air vent 115, whereas the absorbent material piece 140 is airtightly in contact with the absorbent material piece 130, at its top surface, and also is airtightly in contact with the filter 161 at its bottom surface. The position of the interface between the absorbent material pieces 130 and 140 is such that, it is higher than the position of the uppermost portion of the joint pipe 180 as a liquid passage. Further, the interface between the absorbent material pieces 130 and 140 is approximately horizontal when the ink jet head cartridge is placed in the same attitude as the ink jet head cartridge is, in use.

The absorbent material pieces 130 and 140 are formed of fibrous material, and are held in the negative pressure controlling chamber shell 110, so that in the state in which the ink jet head cartridge 70 has been properly installed into the printer, its fibers extend in substantially the same, or primary, direction, being angled (preferably, in the virtually horizontal direction as they are in this embodiment) relative to the vertical direction.

As for the material for the absorbent material pieces 130 and 140, the fibers of which are arranged in virtually the same direction, short (approximately 60 mm) crimped mixed strands of fiber formed of thermoplastic resin (polypropylene, polyethylene, and the like) are used. In production, a wad of such strands is put through a carding machine to parallel the strands, is heated (heating temperature is desired to be set higher than the melting point of polyethylene, which is relatively low, and lower than the molding point of polypropylene, which is relatively high), and then, is cut to a desired length. The fiber strands of the absorbent material pieces in this embodiment are greater in the degree of alignment in the surface portion than in the center portion, and therefore, the capillary force generated by the absorbent members is greater in the surface portion than in the center portion. However, the surfaces of the absorbent material pieces are not as flat as a mirror surface. In other words, they have a certain amount of unevenness which results mainly when the slivers are bundled; they are three dimensional, and the intersections of the slivers, at which they are welded to each other, are exposed from the surfaces of the absorbent material pieces. Thus, in strict terms, the interface 113*c* between the absorbent material pieces 130 and 140 is an interface between the two uneven surfaces, allowing ink to flow by a proper amount in the horizontal direction along the interface 113*c* and also through the adjacencies of the interface 113*c*. Thus, by making a structural arrangement so that the interface 113*c* between the absorbent material pieces 130 and 140 is located above the uppermost portion of the joint pipe 180, preferably, above and close to the uppermost portion of the joint pipe 180 as in this embodiment, the position of the interface between the ink and gas in the absorbent material pieces 130 and 140 during the gas-liquid exchange, which will be described later, can be made to coincide with the position of the interface 113*c*. As a result, the negative pressure in the head portion during the ink supplying operation can be stabilized.

Figure 15:
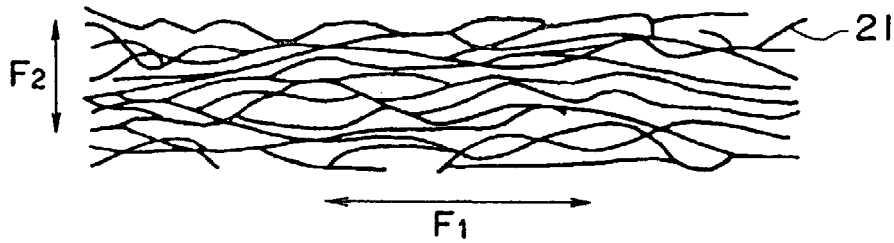
FIG. 15 is a drawing for depicting the structure of the fibrous absorbent member stored in the negative pressure generating chamber shell.

Referring to FIG. 15, if attention is paid to the directionality of the strands of fiber in any portion of the fibrous absorbent material piece, it is evident that plural strands of fiber are extended in a direction F1, or the longitudinal direction of the absorbent material piece, in which the strands have been arranged by a carding machine. In terms of the direction F2 perpendicular to the direction F1, the strands are connected to each other by being fused to each other at their intersections during the aforementioned heating process. Therefore, the absorbent material pieces 130 and 140 are not likely to break when the absorbent material pieces 130 and 140 are stretched in the direction F1. However, the fiber strands which are not likely to separate when pulled in the direction F1 can be easily separated at the intersections at which they have been fused with each other if the absorbent material piece 130 or 140 is stretched in the direction F2.

Since the absorbent material pieces 130 and 140 formed of the fiber strands possess the above described directionality in terms of the strand arrangement, the primary fiber direction, that is, the fiber direction F1, is different from the fiber direction F2 perpendicular to the direction F1 in terms of how ink flows through the absorbent pieces, and also in terms of how ink is statically held therein.

Figure 16:
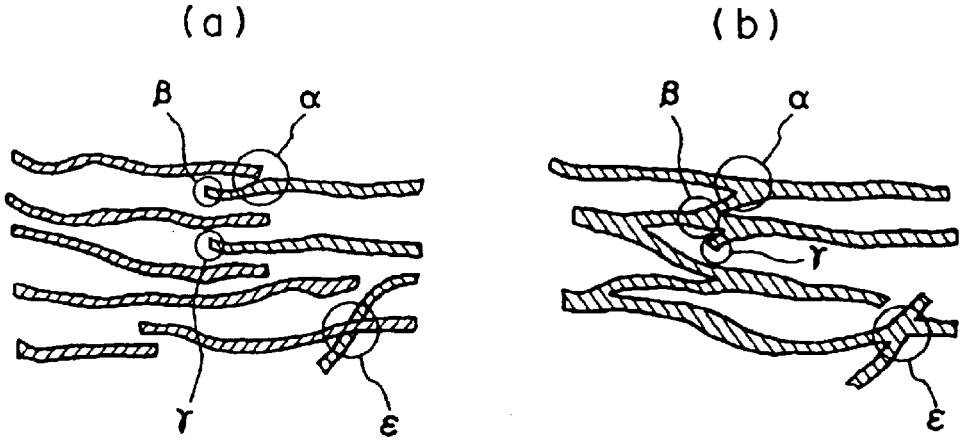
FIG. 16 is a drawing for depicting in more detail the structure of the fibrous member illustrated in FIG. 15.

To look at the internal structures of the absorbent material pieces 130 and 140 in more detail, the state of a wad of short strands of fiber crimped and carded as shown in FIG. 16, (*a*), changes to the state shown in FIG. 16, (*b*), as it is heated. More specifically, in a region α, in FIG. 16, (*a*), in which plural short strands of crimped fiber extend in an overlapping manner, more or less in the same direction, the fiber strands are likely to be fused to each other at their intersections, becoming connected as shown in FIG. 16, (*b*) and therefore, difficult to separate in the direction F1 in FIG. 15. On the other hand, the tips of the short strands of crimped fiber (tips β and γ in FIG. 21, (*a*)) are likely to three-dimensionally fuse with other strands like the tip β in FIG. 16, (*b*), or remain unattached like the tip γ in FIG. 16, (*b*). However, all the strands do not extend in the same direction. In other words, some strands extend in the nonconforming direction and intersect with the adjacent strands (region ϵ in FIG. 16, (*a*)) even before heat is applied, and as heat is applied, they fuse with the adjacent strands in the position they are in, (region ϵ in FIG. 16, (*b*)). Thus, compared to a conventional absorbent piece constituted of a bundle of unidirectionally arranged strands of fiber, the absorbent members in this embodiment are also far more difficult to split in the direction F2.

Figure 6:
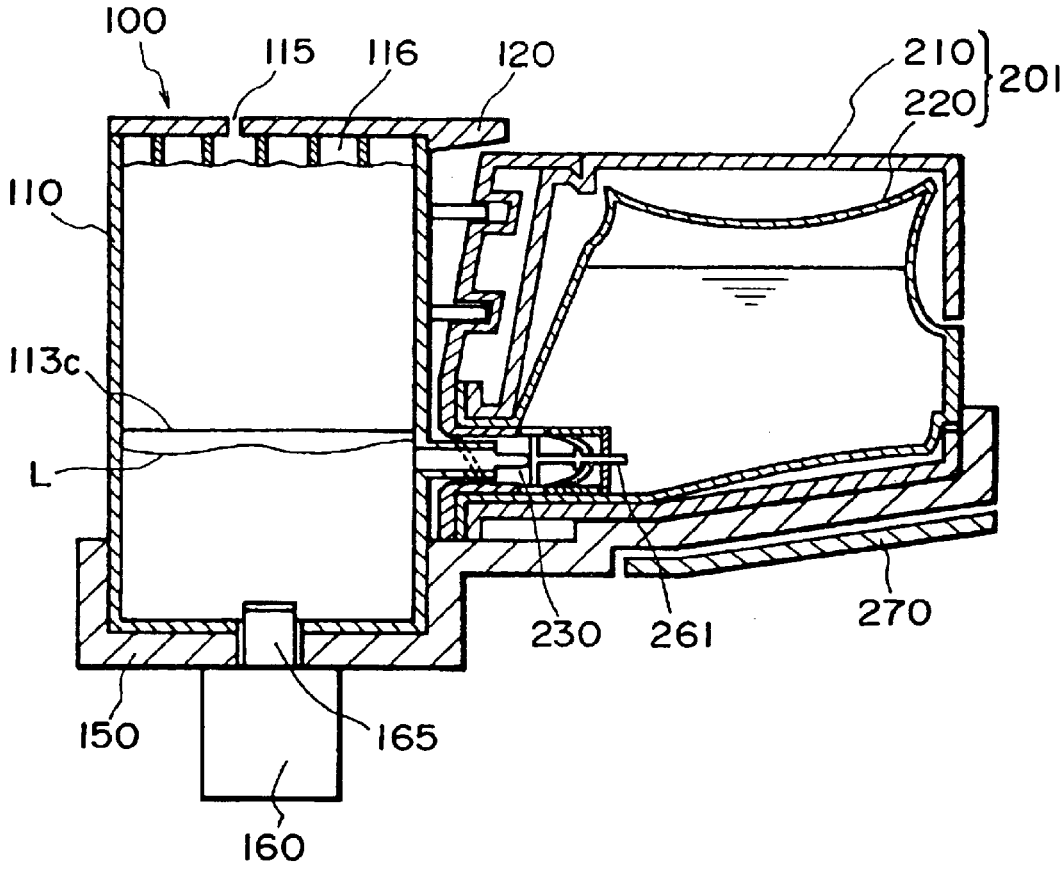
FIG. 6 is a sectional drawing for depicting the ink supplying operation of the ink jet head unit illustrated in FIG. 2.

Further, in this embodiment, the absorbent pieces 130 and 140 are disposed so that the primary fiber strand direction F1 in the absorbent pieces 130 and 140 becomes nearly parallel to the horizontal direction and the line which connects the joint portion and the ink supply outlet. Therefore, after the connection of ink storing container 201, the gas-liquid interface L (interface between ink and gas) in the absorbent piece 140 becomes nearly horizontal, that is, virtually parallel to the primary fiber strand direction F1 as shown in FIG. 6, and even if changes occur to the interface L due to the ambient changes, the interface L returns to its original position by way of the interface 113*c*. Thus, the deviation of the gas-liquid interface in terms of the gravitational direction does not increase in proportion to the number of the cycles of the ambient change.

Thus, even when the ink container unit 200 is replaced with a fresh one because the ink storing container 201 has run out of ink, the gas-liquid interface remains virtually horizontal, at the same level as the gas-liquid interface level before the ink container exchange, and therefore, the size of the buffering space 116 does not decrease no matter how many times the ink container unit 200 is replaced.

All that is necessary in order to keep the position of the gas-liquid interface L stable in spite of the ambient changes during the gas-liquid exchange is that the fiber strands in the region, or layer, immediately above the joint between the negative pressure controlling chamber unit 100 and ink container unit 200 (in the case of this embodiment, above the position of the joint pipe 180), preferably inclusive of the adjacencies of the region immediately above the joint, are extended in the more or less horizontal direction. From a different viewpoint, all that is necessary is that the above described region, or layer, is between the ink delivery opening 131 and the joint between the negative pressure controlling chamber unit 100 and ink container unit 200. From another viewpoint, all that is necessary is that the position of this region is above the gas-liquid interface while gas-liquid exchange is occurring. To analyze the latter viewpoint with reference to the functionality of this region in which the fiber strands posses the above described directionality, this region contributes to keeping horizontal the gas-liquid interface in the absorbent piece 140 while the liquid is supplied through the gas-liquid exchange; in other words, the region contributes to regulate the changes which occur in the vertical direction in the absorbent material piece 140 in response to the movement of the liquid into the absorbent material piece 140 from the ink storing container 201.

The provision of the above described region or layer in the absorbent material piece 140 makes it possible to reduce the deviation of the gas-liquid interface L in terms of the gravity direction. Further, it is desired that the fiber strands in the aforementioned region or layer be arranged so that they extend in parallel in the aforementioned primary direction even at a horizontal plane of the absorbent material piece 140, because such an arrangement enhances the effect of the directional arrangement of the fiber strands in the more or less parallel manner in the primary direction.

Regarding the direction in which the fiber strands are extended, theoretically, when the general direction in which the fiber strands are extended is angled relative to the vertical direction, the above described effect can be provided, although the amount of effect may be small if the angle is small. In practical terms, as long as the above described angle was in a range of ±30° relative to the horizontal direction, the effect was clearly confirmed. Thus, the term "more or less" in the phrase "more or less horizontal" in this specification includes the above range.

In this embodiment, the fiber strands in the absorbent material piece 140 are extended more or less in parallel in the primary direction also in the region below and adjacent to the joint portion, preventing therefore the gas-liquid interface L from deviating in the region below the uppermost portion of the joint portion, as shown in FIG. 6, during the gas-liquid exchange. Therefore, it does not occur that the ink jet head cartridge fails to be supplied with a proper amount of ink due to the interruption of ink delivery.

More specifically, during the gas-liquid exchange, the outside air introduced through the air vent 115 reaches the gas-liquid interface L. As it reaches the interface L, it is dispersed along the fiber strands. As a result, the interface L is kept more or less horizontal during the gas-liquid exchange, it remains stable, assuring that the ink is supplied while a stable amount of negative pressure is maintained. Since the primary direction in which the fiber strands are extended in this embodiment is more or less horizontal, the ink is consumed through the gas-liquid exchange in such a manner that the top surface of the ink remains more or less horizontal, making it possible to provide an ink supplying system which minimizes the amount of the ink left unused, even the amount of the ink left unused in the negative pressure controlling chamber shell 110. Therefore, in the case of an ink supplying system such as the system in this embodiment which allows the ink containing unit 200, in which liquid is directly stored, to be replaced, it is easier to provide the absorbent material pieces 130 and 140 with regions in which ink is not retained. In other words, it is easier to increase the buffering space ratio, to provide an ink supplying system which is substantially more resistant to the ambient changes, while remaining smaller in the total volume of the buffer space 116, than a conventional ink supplying system.

When the ink jet head cartridge in this embodiment is the type of cartridge mountable in a serial type printer, it is mounted on a carriage which is shuttled. As this carriage is shuttled, the ink in the ink jet head cartridge is subjected to the force generated by the movement of the carriage, more specifically, the component of the force in the direction of the carriage movement. For example, in the case of an ink jet head cartridge in which a plurality of ink container units are mounted side by side in the carriage movement direction, in order to minimize the adverse effects of this force upon the ink delivery from the ink container unit 200 to ink jet head unit 160, the direction of the fiber strands in the absorbent material pieces 130 and 140 and the direction in which the ink container unit 200 and negative pressure controlling chamber unit 100 are connected, are desired to coincide with the direction approximately perpendicular to the direction in which the plurality of the ink container units are arranged, that is, the direction of the line which connects the joint opening 230 of the ink container unit 200 and the ink outlet 131 of the negative pressure controlling chamber shell 110.

Next, referring to FIG. 4, the operation for installing the ink containing unit 200 into the integral combination of the negative pressure controlling chamber unit 100 and holder 150 will be described.

Figure 4:
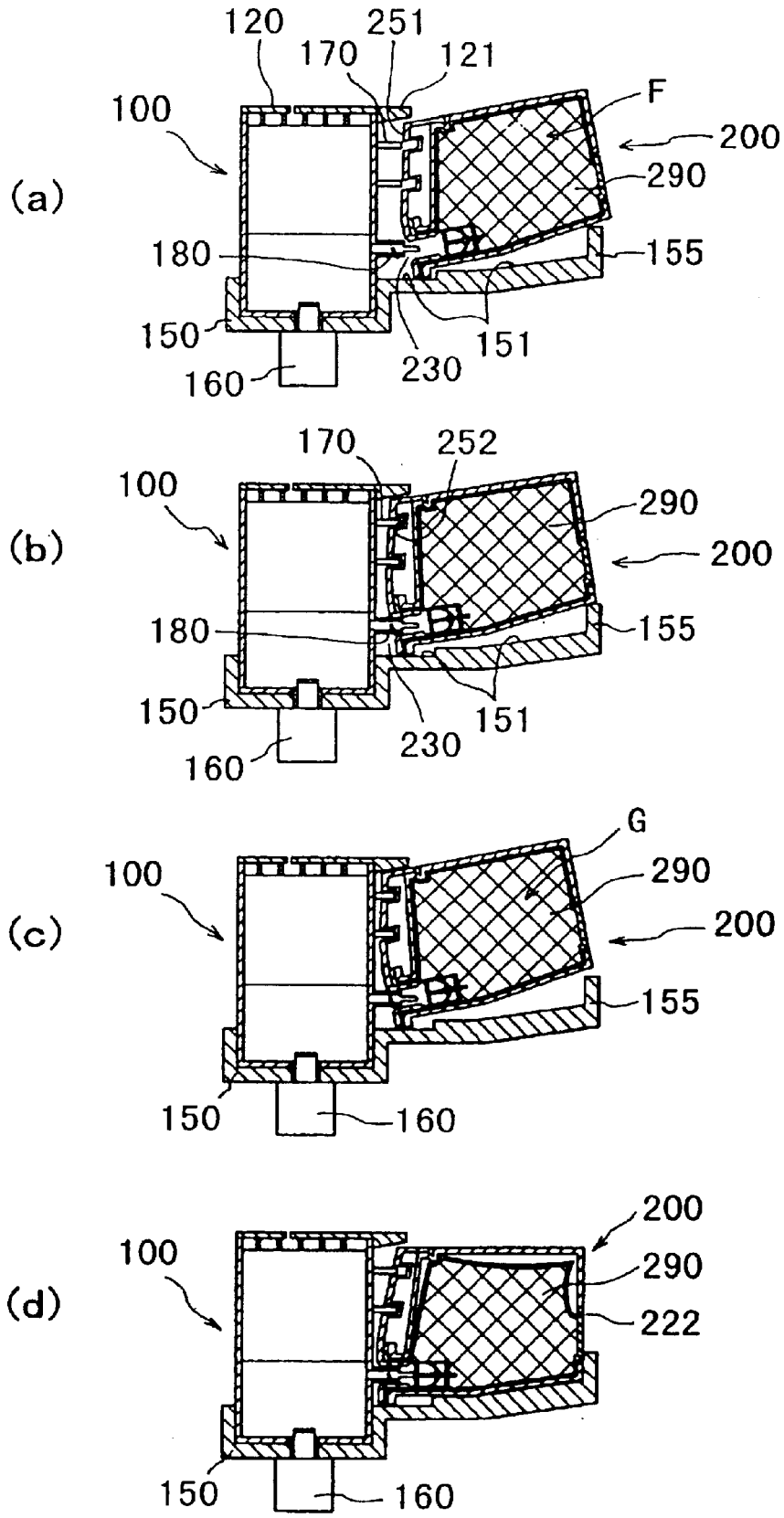
FIG. 4 is a sectional drawing for depicting the process in which the ink container is installed into a holder to which a negative pressure controlling chamber unit illustrated in FIG. 2 has been attached.

FIG. 4 is a sectional drawing for depicting the operation for installing the ink container unit 200 into the holder 150 to which the negative pressure controlling chamber unit 100 has been attached. The ink container unit 200 is instilled into the holder 150 by being moved in the direction F as well as the direction G, while being slightly rotated by being guided by the lateral guides (unillustrated), the bottom wall of the holder 150, the guiding portions 121 with which the negative pressure controlling chamber cover 120 of the negative pressure controlling chamber unit 100 is provided, and, the ink container engagement portion 155, that is, the rear end portion of the holder 150.

More specifically, the installation of the ink container unit 200 occurs as follows. First, the ink container unit 200 is moved to a point indicated in FIG. 4, (*a*), that is, the point at which the slanted surface 251 of the ink container unit 200 comes into contact with the ID members 170 with which the negative pressure controlling chamber unit 100 is provided to prevent the wrong installation of the ink container unit 200. The holder 150 and ink container unit 200 are structured so that at the point in time when the above described contact occurs, the joint pipe 180 has yet to enter the joint opening 230. If a wrong ink container unit 200 is inserted, the slanted surface 251 of the wrong ink container unit 200 collides with the ID members 170 at this point in time, preventing the wrong ink container unit 200 from being inserted further. With this structural arrangement of the ink jet head cartridge 70, the joint opening 230 of the wrong ink container unit 200 does not make contact with joint pipe 180. Therefore, the problems which occur at the joint portion as a wrong ink container unit 200 is inserted, for example, the mixture of inks with different color, and the solidification of ink in the absorbent material pieces 130 and 140 (anions in one type of ink react with cations in another type of ink), which might cause the negative pressure controlling chamber unit 100 to stop functioning, can be prevented, and therefore, it will never occurs that the head and ink containing portion of an apparatus, the ink containing portions of which are replaceable, needs to be replaced due to the occurrence of such problems. Further, since the ID portions of the ID member 250 are provided on the slanted surface of the ID member, the plurality of ID members 170 can be almost simultaneously fitted into the correspondent ID slots to confirm that a correct ink container unit 200 is being inserted; a reliable installation mistake prevention function is provided.

In the next step, the ink container unit 200 is moved toward the negative pressure controlling chamber unit 100 so that the ID members 170 and joint pipe 180 are inserted into the ID member slots 252 and joint opening 230, respectively, at the same time, as shown in FIG. 4, (*b*), until the leading end of the ink container unit 200 reaches the negative pressure controlling chamber unit 100 as shown in FIG. 4, (*c*).

Next, the ink container unit 200 is rotationally moved in the direction indicated by an arrow mark G. During the rotational movement of the ink container unit 200, the tip of the joint pipe 180 comes into contact with the valve plug 261 and pushes it. At a result, the valve mechanism opens, allowing the internal space of the ink container unit 200 to be connected to the internal space of the negative pressure controlling chamber unit 100, in other words, enabling the ink 300 in the ink container unit 200 to be supplied into the negative pressure controlling chamber unit 100. The detailed description of the opening or closing movement of this valve mechanism will be given later.

Next, the ink container unit 200 is further rotated in the direction of the arrow mark G, until the ink container unit 200 settles as shown in FIG. 2. As a result, the bottom rear end portion of the ink container unit 200 becomes engaged with the ink container engagement portion 155 of the holder 150; in other words, the ink container unit 200 is correctly placed in the predetermined space for the ink container unit 200. During this second rotational movement of the ink container unit 200, the ID members 170 slightly come out of the ID member slots 252. The rearward force for correctly retaining the ink container unit 200 in the ink container unit space is generated toward the ink container engagement portion 155 of the holder 150 by the resilient member 263 in the ink container unit 200 and the seal member 57 fitted around the joint pipe 180.

Since the ID member slots 252 are provided in the slanted front wall of the ink container unit 200 which is rotationally installed or removed, and also, the bottom wall of the ink container unit 200 is slanted, it is possible to minimize the space necessary to assure that the ink container unit 200 is installed or removed without making mistakes or mixing inks of different color.

As soon as the ink container unit 200 is connected with the negative pressure controlling chamber unit 100 as described above, the ink moves until the internal pressure of the negative pressure controlling chamber unit 100 and the internal pressure of the ink storing container 201 equalize to realize the equilibrium state illustrated in FIG. 4, (*d*), in which the internal pressure of the joint pipe 180 and joint opening 230 remains negative (this state is called "initial state of usage").

At this time, the ink movement which results in the aforementioned equilibrium will be described in detail.

The valve mechanism provided in the joint opening 230 of the ink storing container 201 is opened by the installation of the ink container unit 200. Even after the opening of the valve mechanism, the ink holding portion of the ink storage container 201 remains virtually sealed except for the small passage through the joint pipe 230. As a result, the ink in the ink storing container 201 flows into the joint opening 230, forming an ink path between the internal space of the ink storing container 201 and the absorbent material piece 140 in the negative pressure controlling chamber unit 100. As the ink path is formed, the ink begins to move from the ink storing container 201 into the absorbent material piece 140 because of the capillary force of the absorbent material piece 140. As a result, the ink-gas interface in the absorbent material piece 140 rises. Meanwhile, the internal pouch 220 begins to deform, starting from the center portion of the largest wall, in the direction to reduce the internal volume.

The external shell 210 functions to impede the displacement of the corner portions of the internal pouch 220, countering the deformation of the internal pouch 220 caused by the ink consumption. In other words, it works to preserve the pre-installation state of the internal pouch 220 (initial state illustrated in FIGS. 4, (*a*)–(*c*)). Therefore, the internal pouch 220 produces and maintains a proper amount of negative pressure correspondent to the amount of deformation, without suddenly deforming. Since the space between the external shell 210 and internal pouch 220 is connected to the outside through the air vent 222, air is introduced into the space between the external shell 210 and internal pouch 220 in response to the aforementioned deformation.

Even if air is present in the joint opening 230 and joint pipe 180, this air easily moves into the internal pouch 220 because the internal pouch 220 deforms as the ink in the internal pouch 220 is drawn out through the ink path formed as the ink from the ink storing container 201 comes into contact with the absorbent material piece 140.

The ink movement continues until the amount of the static negative pressure in the joint opening 230 of the ink storing container 201 becomes the same as the amount of the static negative pressure in the joint pipe 180 of the negative pressure controlling chamber unit 100.

As described above, the ink movement from the ink storing container 201 into the negative pressure controlling chamber unit 100, which is triggered by the connection of the ink storing container 201 with the negative pressure controlling chamber unit 100, continues without the introduction of gas into the ink storing container 201 through the absorbent material pieces 130 and 140. What is important to this process is to configure the ink storing container 201 and negative pressure controlling chamber unit 100 according to the type of a liquid jet recording means to which the ink container unit 200 is connected, so that the static negative pressures in the ink storing container 201 and negative pressure controlling chamber unit 100 reach proper values for preventing ink from leaking from the liquid jet recording means such as the ink jet head unit 160 which is connected to the ink outlet of the negative pressure controlling chamber unit 100.

The amount of the ink held in the absorbent material piece 130 prior to the connection varies. Therefore, some regions in the absorbent piece 140 remain unfilled with ink, These regions can be used as the buffering regions.

On the other hand, sometimes the internal pressures of the joint pipe 180 and joint opening 230 are caused to become positive due to the aforementioned variation. When there is such a possibility, a small amount of ink may be flowed out by performing a recovery operation with a suction-based recovering means, with which the main assembly of a liquid jet recording apparatus is provided, to deal with the possibility. This recovery means will be described later.

As described before, the ink container unit 200 in this embodiment is installed into the holder 150 through a movement which involves a slight rotation; it is inserted at an angle while resting on the ink container engagement portion 155 of the holder 150, by its bottom wall, and after the bottom rear end of the ink container unit 200 goes over the ink container engagement portion 155, it is pushed downward into the holder 150. When the ink container unit 200 is removed from the holder 150, the above described steps are reversely taken. The valve mechanism with which the ink container unit 200 is provided is opened or closed as the ink container unit 200 is installed or removed, respectively.

Figure 5:
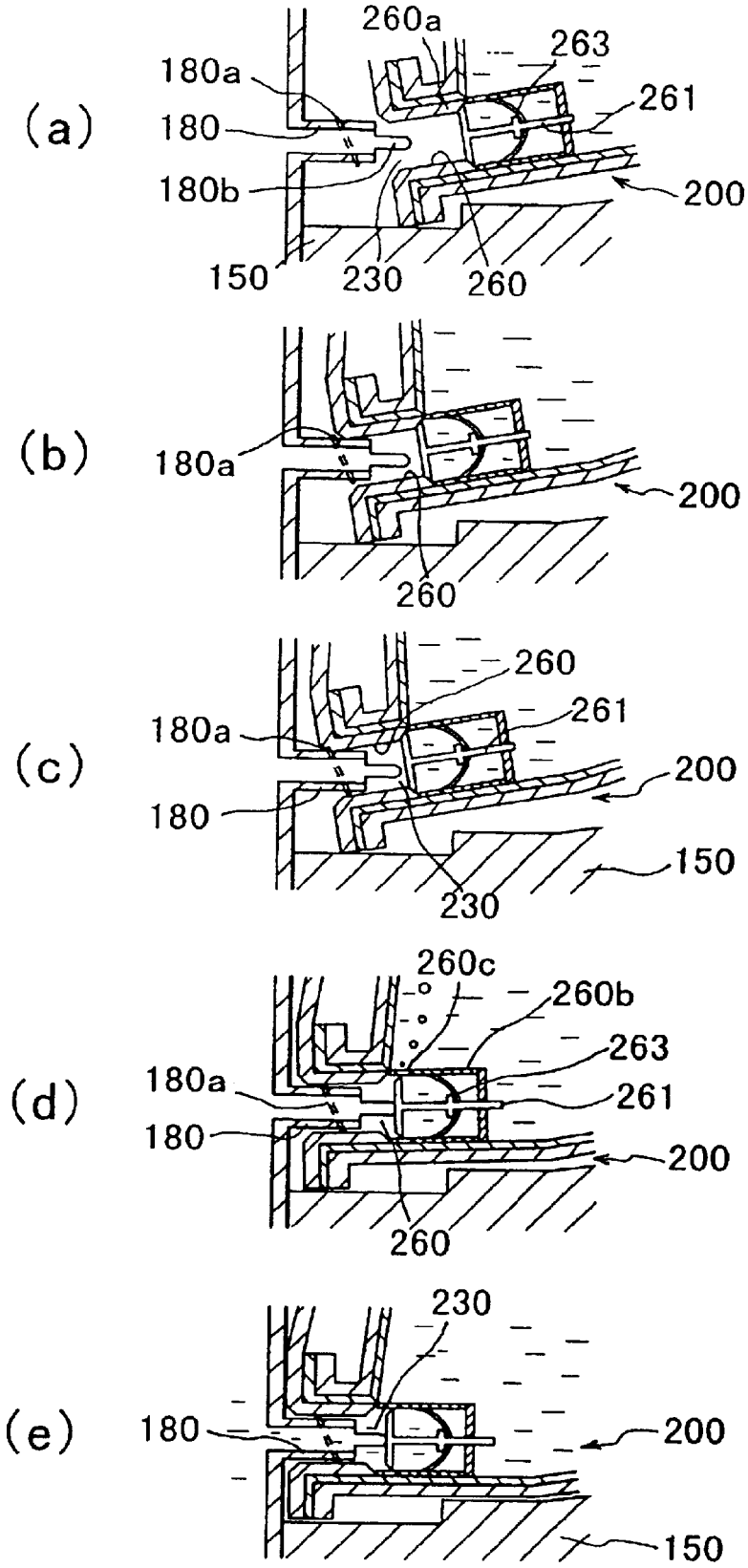
FIG. 5 is a drawing for depicting the opening and closing operation of a valve mechanism.

Hereinafter, referring to FIGS. 5, (*a*)–(*e*), the operation for opening or closing the valve mechanism will be described. FIG. 5, (*a*), shows the states of the joint pipe 180 and its adjacencies, and the joint opening 230 and its adjacencies, immediately before the joint pipe 180 is inserted into the joint opening 230, but after the ink container unit 200 was inserted into the holder 150 at an angle so that the joint opening 230 tilts slightly downward.

The joint pipe 180 is provided with a sealing projection 180*a*, which is integrally formed with the joint pipe 180, and extends on the peripheral surface of the joint pipe 180, encircling the peripheral surface of the joint pipe 180. It is also provided with a valve activation projection 180*b*, which forms the tip of the joint pipe 10. The sealing projection 180*a* comes into contact with the joint sealing surface 260 of the joint opening 230 as the joint pipe 180 is inserted into the joint opening 230. The sealing projection 180*a* extends around the joint pipe 180 at an angle so that the distance from the uppermost portion of the sealing projection 180*a* to the joint sealing surface 260 becomes greater than the distance from the bottommost portion of the sealing projection 180*a* to the joint sealing surface 260.

When the ink container unit 200 is installed or removed, the joint sealing surface rubs against the sealing projection 180*a*, as will be described later. Therefore, the material for the sealing projection 180*a* is desired to be such material that is slippery and yet capable of sealing between itself and an object it contacts. The configuration of the resilient member 263 for keeping the valve plug 261 pressed upon or toward the first valve body 260*a* does not need to be limited to a particular one; a springy member such as a coil spring or a plate spring, or a resilient member formed of rubber or the like, may be employed. However, in consideration of recycling, a resilient member formed of resin is preferable.

In the state depicted in FIG. 5, (*a*), the valve activation projection 180*b* is yet to make contact with the valve plug 261, and the tapered portion of the valve plug 261, provided at the periphery of the valve plug 261, is in contact with the tapered portion of the first valve body 260*a*, with the valve plug 261 being under the pressure from the resilient member 263. Therefore, the ink container unit 200 remains airtightly sealed.

As the ink container unit 200 is inserted further into the holder 150, the joint portion is sealed at the sealing surface 260 of the joint opening 230 by the sealing projection 180*a*. During this sealing process, first, the bottom side of the sealing projection 180*a* comes into contact with the joint sealing surface 260, as shown in FIG. 5, (*b*), gradually increasing the size of the contact area toward the top side of the sealing projection 180*a* while sliding against the joint sealing surface 260. Eventually, the top side of the sealing projecting 180*a* comes into contact with the joint sealing surface 260 as shown in FIG. 5, (*c*). As a result, the sealing projection 180*a* makes contact with the joint sealing surface 260, by the entire peripheral surface, sealing the joint opening 230.

In the state illustrated in FIG. 5, (*c*), the valve activation projection 180*b* is not in contact with the valve plug 261, and therefore, the valve mechanism is not open. In other words, before the valve mechanism is opened, the gap between the joint pipe 180 and joint opening 230 is sealed, preventing ink from leaking from the joint opening 230 during the installation of the ink container unit 200.

Further, as described above, the joint opening 230 is gradually sealed from the bottom side of the joint sealing surface 260. Therefore, until the joint opening 230 is sealed by the sealing projection 180*a*, the air in the joint opening 230 is discharged through the gap between the sealing projection 180*a* and joint sealing surface 260. As the air in the joint opening 230 is discharged as described above, the amount of the air remaining in the joint opening 230 after the joint opening 230 is sealed is minimized, preventing the air in the joint opening 230 from being excessively compressed by the invasion of the joint pipe 180 into the joint opening 230, in other words, preventing the internal pressure of the joint opening 230 from rising excessively. Thus, it is possible to prevent the phenomenon that before the ink container unit 200 is completely installed into the holder 150, the valve mechanism is inadvertently opened by the increased internal pressure of the joint opening 230, and ink leaks into the joint opening 230.

As the ink container unit 200 is further inserted, the valve activation projection 180*b* pushes the valve plug 261 against the resiliency of the resilient member 263, with the joint opening 230 remaining sealed by the sealing projection 180*a*, as shown in FIG. 5, (*d*). As a result, the internal space of the ink storing container 201 becomes connected to the internal space of the joint opening 230 through the opening 260*c* of the second valve body 26. Consequently, the air in the joint opening 230 is allowed to be drawn into the ink container unit 200 through the opening 260*c*, and the ink in the ink container unit 200 is supplied into the negative pressure controlling chamber shell 110 through the opening 260*d* and joint pipe 230 (FIG. 2).

As the air in the joint opening 230 is drawn into the ink container unit 200 as described above, the negative pressure in the internal pouch 220 (FIG. 2) is reduced, for example, when an ink container unit 200 the ink in which has been partially consumed is re-installed. Therefore, the balance in the internal negative pressure between the negative pressure controlling chamber shell 110 and internal pouch 220 is improved, preventing the ink from being inefficiently supplied into the negative pressure controlling chamber shell 110 after the re-installation of the ink container unit 200.

After the completion of the above described steps, the ink container unit 200 is pushed down onto the bottom wall of the holder 150 to finish installing the ink container unit 200 into the holder 150 as shown in FIG. 5, (*e*). As a result, the joint opening 230 is perfectly connected to the joint pipe 180, realizing the aforementioned state which assures that gas-liquid exchange occurs flawlessly.

Also in this embodiment, olefinic elastomer is used as the material for the joint sealing surface 260 and tapered portion of the first valve body 260*a*. With the use of elastomer as the material for the joint sealing surface 260, it is assured that because of the resilience of the elastomer, the joint between the joint sealing surface 260 and the sealing projection 180*a* of the joint pipe 180 is perfectly sealed, and also, the joint between the tapered portion of the first valve body 260*a* and the correspondent seal portion (tapered portion) of the valve plug 261 is perfectly sealed. In addition, the joint sealing surface 260, the material for which is elastomer, can be integrally formed with the first valve body 260*a*, making it possible to provide the above described effects without increasing the number of components. Elastomer usage does not need to be limited to the above described structure; elastomer may also be used as the material for the sealing projection 180*a* of the joint pipe 180, the seal (tapered) portion of the valve plug 261, and the like.

On the other hand, when the ink container unit 200 is removed from the holder 150, the above described installation steps occur in reverse, unsealing the joint opening 230, and allowing the valve mechanism to operate.

In other words, as the ink container unit 200 is pulled in the direction to remove it from the holder 150, while gradually rotating the ink container unit 200 in the direction opposite to the installation direction, first, the valve plug 261 moves forward due to the resiliency of the resilient member 263, and presses on the tapered portion of the first valve body 260*a* by its tapered portion to close the joint opening 230.

Then, as the ink container unit 200 is pulled out of the holder 150, the joint between the wall of the joint opening 230 and the joint pipe 180, which remained sealed by the sealing projection 180*a*, is unsealed. Since this joint is unsealed after the closing of the valve mechanism, it does not occur that ink is wastefully released into the joint opening 230.

In addition, since the sealing projection 180*a* is disposed at an angle as described before, the unsealing of the joint opening 230 occurs from the top side of the sealing projection 180*a*. Before the joint opening 230 is unsealed, ink remains in the joint opening 230 and joint pipe 180. However, it is at the top side where the unsealing starts. In other words, the bottom side remains sealed, preventing ink from leaking out of the joint opening 230. Further, the internal pressure of the joint opening 230 and joint pipe 180 is negative, and therefore, as the joint is unsealed from the top side of the sealing projection 180*a*, the outside air enters into the joint opening 230, causing the ink remaining in the joint opening 230 and joint pipe 180 to be drawn into the negative pressure controlling chamber shell 110.

By causing the joint opening 230 to be unsealed starting from the top side of the sealing projection 180*a* to make the ink remaining in the joint opening 230 move into the negative pressure controlling chamber shell 110, it is possible to prevent ink from leaking from the joint opening 230 as the ink container unit 200 is removed from the holder 150.

As described above, according to the structure of the junction between the ink container unit 200 and negative pressure controlling chamber shell 110 in this embodiment, the joint opening 230 is sealed before the valve mechanism of the ink container unit 200 is activated, and therefore, ink is prevented from inadvertently leaking from the joint opening 230. Further, since a time lag is provided between the top and bottom sides of the sealing projection 180*a* in terms of the sealing and unsealing timing, the valve plug 261 is prevented from inadvertently moving during the connection, and the ink remaining in the joint opening 230 is prevented from leaking during the removal.

Also in this embodiment, the valve plug 261 is disposed in the joint opening 230, at a point deeper inside the joint opening 230, away from the outside opening of the joint opening 230, and the movement of the valve plug 261 is controlled by the valve activation projection 180*b* provided at the projecting end of the joint pipe 180. Therefore, it does not occur that a user directly touches the valve plug 261. In other words, a use is prevented from being contaminated by the ink adhering to the valve plug 261.

Next, referring to FIG. 6, the ink supplying operation of the ink jet head cartridge illustrated in FIG. 2 will be described. FIG. 6 is a sectional drawing for describing the ink supplying operation of the ink jet head cartridge illustrated in FIG. 2.

By dividing the absorbent material in the negative pressure controlling chamber unit 100 into a plurality of pieces, and positioning the interface between the divided pieces of the absorbent material so that the interface will be positioned above the top end of the joint pipe 180 when the ink jet head cartridge is disposed in the attitude in which it is used, as described above, it becomes possible to consume the ink within the absorbent piece 140, or the bottom piece, after the ink within the absorbent material piece 130, or the top piece, if ink is present in both the absorbent material pieces 130 and 140 of the ink jet head cartridge illustrated in FIG. 2. Further, when the position of the gas-liquid interface L changes due to the ambient changes, ink seeps into the absorbent material piece 130 after filling up, first, the absorbent material piece 140 and the adjacencies of the interface 113*c* between the absorbent material pieces 130 and 140. Therefore, it is assured that buffering zone in addition to the buffering space 116 is provided in the negative pressure controlling chamber unit 100. Making the strength of the capillary force of the absorbent material piece 140 higher compared to that of the absorbent material piece 130 assures that the ink in the absorbent material piece 130 is consumed when the ink jet head cartridge is operating.

Further, in this embodiment, the absorbent material piece 130 remains pressed toward the absorbent material piece 140 by the ribs of the negative pressure controlling chamber cover 120, and therefore, the absorbent material piece 130 is kept in contact with the absorbent material piece 140, forming the interface 113*c*. The compression ratios of the absorbent material pieces 130 and 140 are higher adjacent to the interface 113*c* than those in the other portions, and therefore, the capillary force is greater adjacent to the interface 113*c* than that in the other portions. More specifically, representing the capillary force of the absorbent material piece 140, the capillary force of the absorbent material piece 130, and the capillary force of the area (border layer) adjacent to the interface 113*c* between the absorbent material pieces 130 and 140, with P1, P2, and PS, correspondingly, their relationship is: P2<P1<PS. Providing the area adjacent to the interface 113*c* between the absorbent material pieces 130 and 140 with such capillary force that is stronger than that in the other areas assures that the strength of the capillary force in the area adjacent to the interface 113*c* exceeds the strength necessary to meet the above described requirement, even if the ranges of the strengths of the P1 and P2 overlap with each other because of the unevenness of the absorbent material pieces 130 and 140 in terms of their density, or compression. Therefore, it is assured that the above described effects will be provided. Further, positioning the joint pipe 180 below, and adjacent to, the interface 113*c* between the absorbent material pieces 130 and 140 assures that the gas-liquid interface remains at this position, and therefore, is desired.

Accordingly, next, the method for forming the interface 113*c*, in this embodiment, will be described. In this embodiment, olefinic fiber (2 denier) with a capillary force of −110 mmAq (P1=−110 mmAq) is used as the material for the absorbent material piece 140 as a capillary force generating member. The hardness of the absorbent material pieces 130 and 140 is 0.69 kgf/mm. The method for measuring their hardness is such that, first, the repulsive force generated as a pushing rod with a diameter of 15 mm is pushed against the absorbent material placed in the negative pressure controlling chamber shell 110 is measured, and then, the hardness is obtained from the relationship between the distance the pushing rod was inserted, and the measured amount of the repulsive force correspondent to the distance. On the other hand, the same material as that for the absorbent material piece 140, that is, olefinic fiber, is used as the material for the absorbent material piece 130. However, compared to the absorbent material piece 140, the absorbent material piece 130 is made weaker in capillary force (P2=−80 mmAq), and is made larger in the fiber diameter (6 denier), making it higher in rigidity at 1.88 kgf/mm.

By making the absorbent material piece 130, which is weaker in capillary force than the absorbent material piece 140, greater in hardness than the absorbent material piece 140, placing them in combination, and in contact, with each other, and keeping them pressed against each other, causes the absorbent material piece 140 to be kept more compressed than the absorbent material piece 130, adjacent to the interface 113*c* between the absorbent material pieces 130 and 140. Therefore, the aforementioned relationship in capillary force (P2<P1<PS) is established adjacent to the interface 113*c*, and also it is assured that the difference between the P2 and PS remains always greater than the difference between the P2 and P1.

Figure 7:
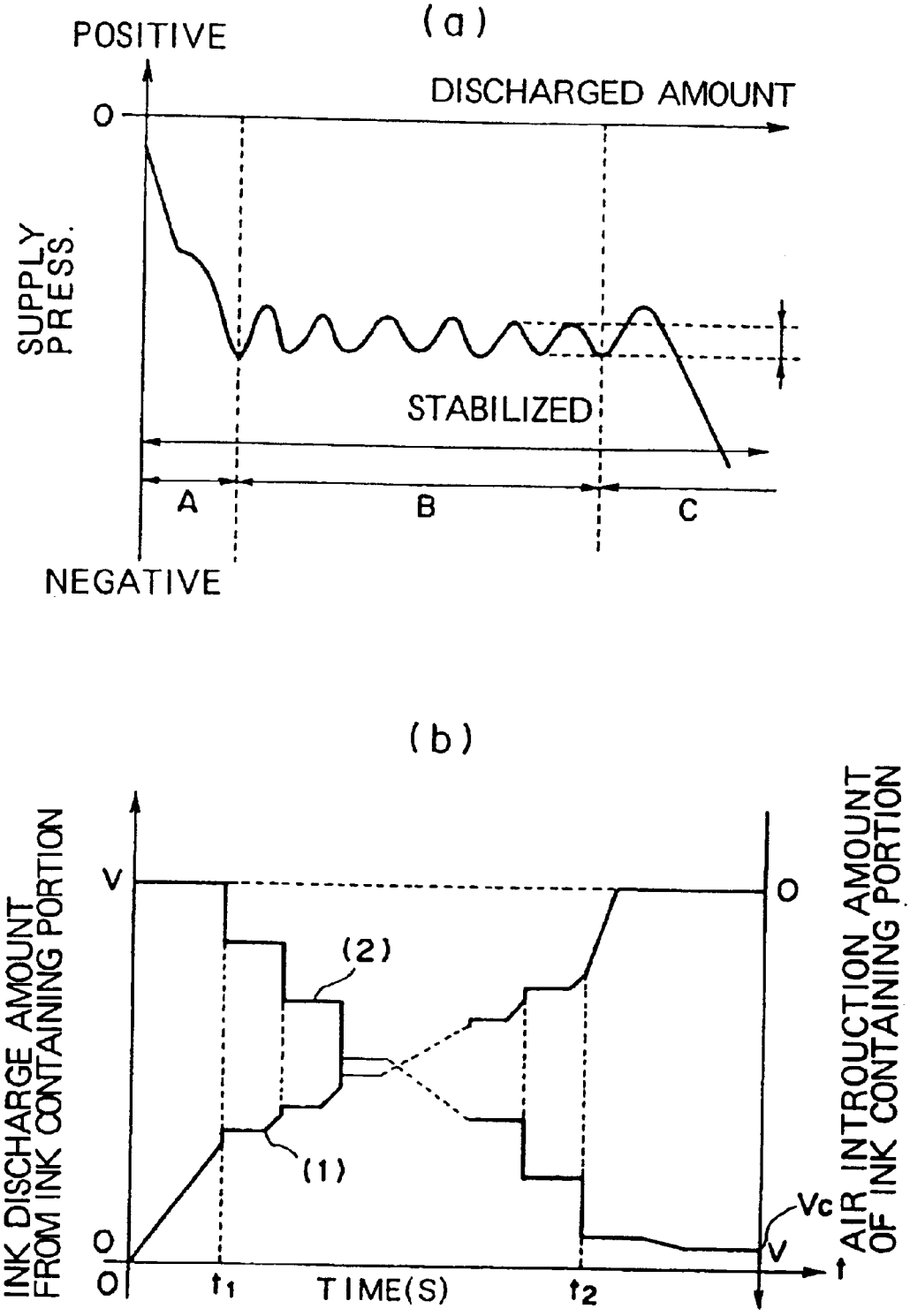
FIG. 7 is a graph for describing, based on FIG. 4, the state of ink during the ink consuming operation.
Figure 8:
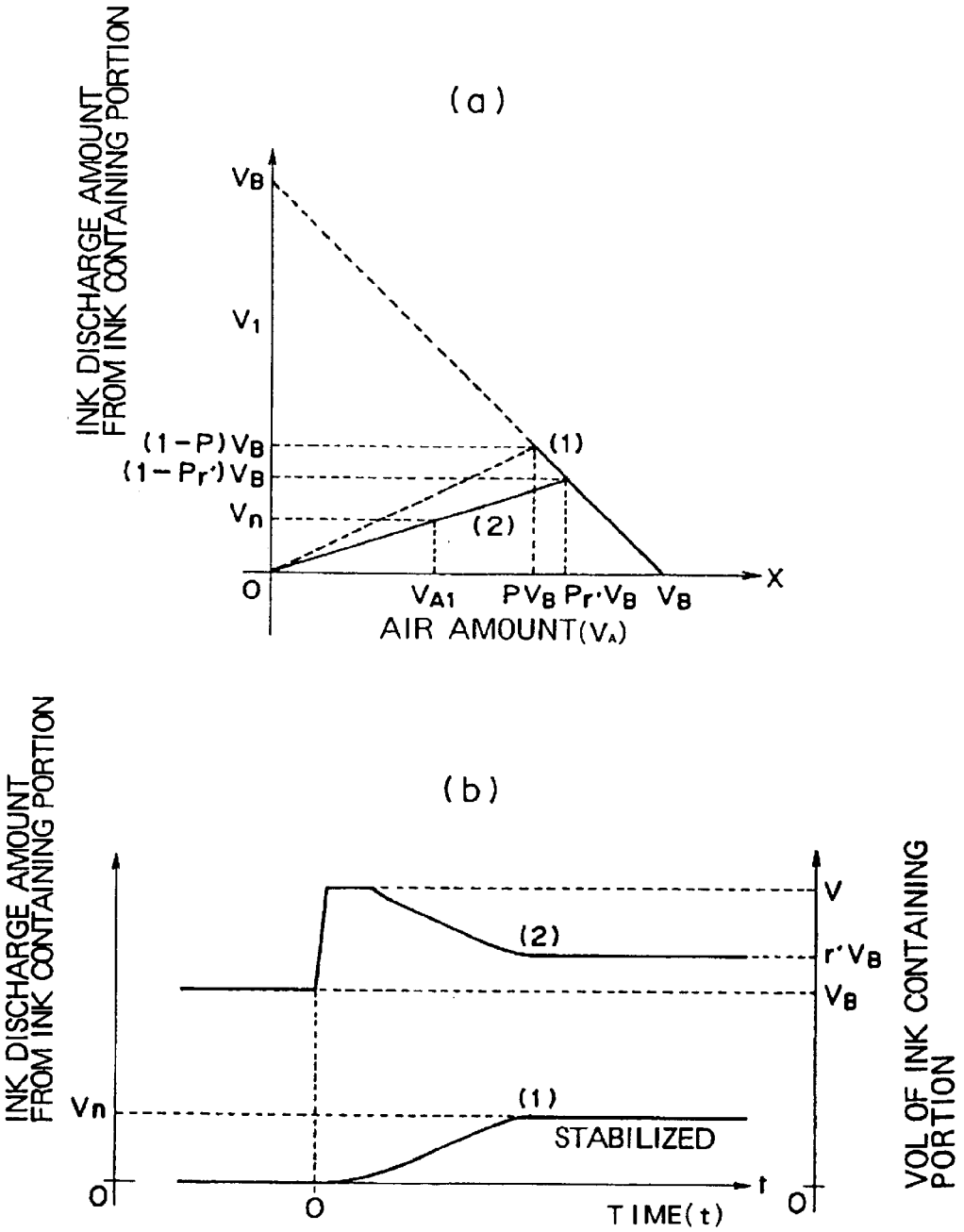
FIG. 8 is a graph for describing, based on FIG. 4, the effect of the deformation of the internal pouch which occurs during the ink consuming operation, upon the controlling of the internal pressure.

Next, referring to FIGS. 6–8, the outlines of the ink consuming process will be described from the time when the ink container unit 200 has been installed into the holder 150 and has become connected to the negative pressure controlling chamber unit 100, to the time when the ink in the ink storing container 201 begins to be consumed. FIG. 7 is a drawing for describing the state of the ink during the ink consumption described with reference to FIG. 6, and FIG. 8 is a graph for depicting the effects of the deformation of the internal pouch 220 upon the prevention of the internal pressure change in the ink container unit 200.

First, as the ink storing container 201 is connected to the negative pressure controlling chamber unit 100, the ink in the ink storing container 201 moves into the negative pressure controlling chamber unit 100 until the internal pressure of the negative pressure controlling chamber unit 100 becomes equal to the internal pressure of the ink storing container 201, readying the ink jet head cartridge for a recording operation. Next, as the ink begins to be consumed by the ink jet head unit 160, both the ink in the internal pouch 220 and the ink in the absorbent material piece 140 are consumed, maintaining such a balance that the value of the static negative pressure generated by the internal pouch 220 and absorbent material piece 140 increases (first state: range A in FIG. 7, (*a*)). In this state., when ink is in the absorbent material piece 130, the ink in the absorbent material piece 130 is also consumed. FIG. 7, (*a*) is a graph for describing one of the examples of the rate at which the negative pressure in the ink delivery tube 165 varies. In FIG. 7, (*a*), the axis of abscissa represents the rate at which the ink is drawn out of the negative pressure controlling chamber shell 110 through the ink delivery tube 165, and the axis of ordinates represents the value of the negative pressure (static negative pressure) in the ink delivery tube 165.

Next, gas is drawn into the internal pouch 220, allowing ink to be consumed, that is, drawn out, through gas-liquid exchange while the absorbent material pieces 130 and 140 keep the position of the gas-liquid interface L at about the same level, and keep the internal negative pressure substantially constant (second state: range B in FIG. 7, (*a*)). Then, the ink remaining in the capillary pressure generating member holding chamber 110 is consumed (range C in FIG. 7, (*a*)).

As described above, the ink jet head cartridge in this embodiment goes through the stage (first stage) in which the ink in the internal pouch 220 is used without the introduction of the outside air into the internal pouch 220. Therefore, the only requirement to be considered regarding the internal volume of the ink storing container 201 is the amount of the air introduced into the internal pouch 220 during the connection. Therefore, the ink jet head cartridge in this embodiment has merit in that it can compensate for the ambient changes, for example, temperature change, even if the requirement regarding the internal volume of the ink storing container 201 is relaxed.

Further, in whichever period among the aforementioned periods A, B, and C, in FIG. 7, (*a*), the ink storing container 201 is replaced, it is assured that the proper amount of negative pressure is generated, and therefore, ink is reliably supplied. In other words, in the case of the ink jet head cartridge in this embodiment, the ink in the ink storing container 201 can be almost entirely consumed. In addition, air may be present in the joint pipe 180 and/or joint opening 230 when the ink container unit 200 is replaced, and the ink storing container 201 can be replaced regardless of the amounts of the ink retained in the absorbent material pieces 130 and 140. Therefore, it is possible to provide an ink jet head cartridge which allows the ink storing container 201 to be replaced without relying on an ink remainder amount detection mechanism; in other words, the ink jet head cartridge in this embodiment does not need to be provided with an ink remainder amount detection mechanism.

At this time, the aforementioned ink consumption sequence will be described from a different viewpoint, referring to FIG. 7, (*b*).

FIG. 7, (*b*) is a graph for describing the above described ink consumption sequence. In FIG. 7, (*b*), the axis of abscissas represents the elapsed time, and the axis of ordinates represents the cumulative amount of the ink drawn out of the ink storing container, and the cumulative amount of the air drawn into the internal pouch 220. It is assumed that the rate at which the ink jet head unit 160 is provided with ink remains constant throughout the elapsed time.

The ink consumption sequence will be described from the angles of the cumulative amount of the ink drawn out of the ink containing portion, and the cumulative amount of the air drawn into the internal pouch 220, shown in FIG. 7, (*b*). In FIG. 7, (*b*), the cumulative amount of the ink drawn out of the internal pouch 220 is represented by a solid line (1), and the cumulative amount of the air drawn into the ink containing portion is represented by a solid line (2).

A period from a time t0 to t1 corresponds to the period A, or the period before the gas-liquid exchange begins, in FIG. 7, (*a*). In this period A, the ink from the absorbent material piece 140 and internal pouch 220 is drawn out of the head while balance is maintained between the absorbent material piece 140 and 220, as described above.

Next, the period from time t1 to time t2 corresponds to the gas-liquid exchange period (period B) in FIG. 7, (*b*). In this period B, the gas-liquid exchange continues according to the negative pressure balance, as described above. As air is introduced into the internal pouch 220 (which corresponds to the stepped portions of the solid line (2)), as indicated by the solid line (1) in FIG. 7, (*b*), ink is drawn out of the internal pouch 220. During this process, it does not occur that ink is immediately drawn out of the internal pouch 220 by an amount equal to the amount of the introduced air after the air introduction. For example, sometimes, ink is drawn out of the internal pouch 220 a certain amount of time after the air introduction, by an amount equivalent to the amount of the introduced air. As is evident from FIG. 7, (*b*), the occurrence of this kind of reaction, or the timing lag, characterizes the ink jet head cartridge in this embodiment in comparison to an ink jet head cartridge which does not have an internal ink pouch 220, and the ink containing portion of which does not deform. As described above, this process is repeated during the gas-liquid exchange period. As the ink in the internal pouch 220 continues to be drawn out, the relationship between the amounts of the air and ink in the internal pouch 220 reverses at a certain point in time.

The period after the time t2 corresponds to the period (range C) after the gas-liquid exchange period in FIG. 7, (*a*). In this range C, the internal pressure of the internal pouch 220 becomes substantially the same as the atmospheric pressure as stated before. As the internal pressure of the internal pouch 220 gradually changes toward the atmospheric pressure, the initial state (pre-usage state) is gradually restored by the resiliency of the internal pouch 220. However, because of the so-called buckling, it does not occur that the state of the internal pouch 220 is completely restored to its initial state. Therefore the final amount Vc of the air drawn into the internal pouch 220 is smaller than the initial internal volume of the internal pouch 220 (V>Vc). Even in the state within the range C, the ink in the internal pouch 220 can be completely consumed.

As described above, the structure of the ink jet head cartridge in this embodiment is characterized in that the pressure fluctuation (amplitude $\gamma$ in FIG. 7, (*a*)) which occurs during the gas-liquid exchange in the ink jet head cartridge in this embodiment is greater compared to that in an ink jet head cartridge which employs a conventional ink container system in which gas-liquid exchange occurs.

The reason for this characteristic is that before the gas-liquid exchange begins, the internal pouch 220 is deformed, and kept deformed, by the drawing of the ink from inside the internal pouch 220. Therefore, the resiliency of the internal pouch material continuously generates such force that works in the direction to move the wall of the internal pouch 220 outward. As a result, the amount of the air which enters the internal pouch 220 to reduce the internal pressure difference between the absorbent material piece 140 and internal pouch 220 during the gas-liquid exchange often exceeds the proper amount, as described, increasing the amount of the ink flowing out of the internal pouch 220 into the external shell 210. On the contrary, if the ink container unit 200 is structured so that the wall of the ink containing portion does not deform as does the wall of the internal pouch 220, ink is immediately drawn out into the negative pressure controlling chamber unit 100 as soon as a certain amount of air enters the ink containing portion.

For example, in 100% duty mode (solid mode), a large amount of ink is ejected all at once from the ink jet head unit 160, causing ink to be rapidly drawn out of the negative pressure controlling chamber unit 100 and ink storing container 201. However, in the case of the ink jet head cartridge in this embodiment, the amount of the ink drawn out through gas-liquid exchange is relatively large, improving the reliability, that is, eliminating the concern regarding the interruption of ink flow.

Also, according to the structure of the ink jet head cartridge in this embodiment, ink is drawn out with the internal pouch 220 remaining deformed inward, providing thereby an additional benefit in that the structure offers a higher degree of buffering effect against external factors, for example, the vibration of the carriage, ambient changes, and the like.

As described above, according to the structure of the ink jet head cartridge in this embodiment, the slight changes in the negative pressure can be eased by the internal pouch 220, and even when air is present in the internal pouch 220, for example, during the second stage in the ink delivery, the ambient changes such as temperature change can be compensated for by a method different from the conventional methods.

Next, referring to FIG. 8, a mechanism for assuring that even when the ambient condition of the ink jet head cartridge illustrated in FIG. 2 changes, the liquid within the unit remains stable will be described. In the following description, the absorbent material pieces 130 and 140 may be called a capillary force generating member.

As the air in the internal pouch 220 expands due to decrease in the atmospheric pressure and/or increase in the temperature, the walls or the like portions of the internal pouch 220, and the liquid surface in the internal pouch 220, are subjected to pressure. As a result, not only does the internal volume of the internal pouch 220 increase, but also a portion of the ink in internal pouch 220 flows out into the negative pressure controlling chamber shell 110 from the internal pouch 220 through the joint pipe 180. However, since the internal volume of the internal pouch 220 increases, the amount of the ink that flows out into the absorbent material piece 140 in the case of this embodiment is substantially smaller compared to a case in which the ink storage portion is undeformable.

As described above, the aforementioned changes in the atmospheric pressure ease the negative pressure in the internal pouch 220 and increase the internal volume of the internal pouch 220. Therefore, initially, the amount of the ink which flows out into the negative pressure controlling chamber shell through the joint opening 230 and joint pipe 180 as the atmospheric pressure suddenly changes is substantially affected by the resistive force generated by the internal pouch wall as the inward deformation of the wall portion of the internal pouch 220 is eased, and by the resistive force for moving the ink so that the ink is absorbed by the capillary force generating member.

In particular, in the case of the structure in this embodiment, the flow resistance of the capillary force generating members (absorbent material pieces 130 and 140) is greater than the resistance of the internal pouch 220 against the restoration of the original state. Therefore, as the air expands, initially, the internal volume of the internal pouch 220 increases. Then, as the amount of the air expansion exceeds the maximum amount of the increase in the internal volume of the internal pouch 220 afforded by the internal pouch 220, ink begins to flows from within the internal pouch 220 toward the negative pressure controlling chamber shell 110 through the joint opening 230 and joint pipe 180. In other words, the wall of the internal pouch 220 functions as the buffer against the ambient changes, and therefore, the ink movement in the capillary force generating member calms down, stabilizing the negative pressure adjacent to the ink delivery tube 165.

Also according to this embodiment, the ink which flows out into the negative pressure controlling chamber shell 110 is retained by the capillary force generating members. In the aforementioned situation, the amount of the ink in the negative pressure controlling chamber shell 110 increases temporarily, causing the gas-liquid interface to rise, and therefore, in comparison to when the internal pressure is stable, the internal pressure temporarily becomes slightly positive, as it is initially. However, the effect of this slightly positive internal pressure upon the characteristics of a liquid ejection recording means such as the ink let head unit 160, in terms of ejection, is small, and therefore, creates no practical problem. As the atmospheric pressure returns to the normal level (base unit of atmospheric pressure), or the temperature returns to the original level, the ink which leaked out into the negative pressure controlling chamber shell 110 and has been retained in the capillary force generating members, returns to the internal pouch 220, and the internal pouch 220 restores its original internal volume.

Next, the basic action in the stable condition restored under such atmospheric pressure that has changed after the initial operation will be described.

What characterizes this state is the amount of the ink drawn out of the internal pouch 220, as well as that the position of the interface of the ink retained in the capillary force generating member changes to compensate for the fluctuation of the negative pressure resulting from the fluctuation of the internal volume of the internal pouch 220 itself. Regarding the relationship between the amount of the ink absorbed by the capillary force generating member and the ink storing container 201, all that is necessary from the viewpoint of preventing ink from leaking from the air vent or the like during the aforementioned decrease in the atmospheric pressure and temperature change, is to determine the maximum amount of the ink to be absorbed by the negative pressure controlling chamber shell 110 in consideration of the amount of the ink which flows out of the ink storage container 201 under the worst conditions and the amount of the ink to be retained in the negative pressure controlling chamber shell 100 while the ink is supplied from the ink storage container 201, and then, to give the negative pressure controlling chamber shell 110 an internal volume sufficient for holding the capillary force generating members, the sizes of which match the aforementioned amount of ink under the worst conditions, and the maximum amount of the ink to be absorbed.

In FIG. 8, (*a*), the initial volume of the internal space (volume of the air) of the internal pouch 220 before the decrease in the atmospheric pressure, in a case in which the internal pouch 220 does not deform at all in response to the expansion of the air, is represented by the axis of abscissas (X), and the amount of the ink which flowed out as the atmospheric pressure decreased to a value of P (0<P<1) is represented by the axis of ordinates (Y), and their relationship is depicted by a dotted line (1) The amount of the ink which flows out of the internal pouch 220 under the worst conditions may be estimated based on the following assumption. For example, a situation in which the amount of the ink which flows out of the internal pouch 220 becomes the maximum when the lowest level to which the value of the atmospheric pressure decreases is 0.7, is when the volume of the ink remaining in the internal pouch 220 equals 30% of the volumetric capacity VB of the internal pouch 220. Therefore, presuming that the ink below the bottom end of the wall of the internal pouch 220 is also absorbed by the capillary force generating members in the negative pressure controlling chamber shell 110, it may be expected that the entirety of the ink remaining in the internal pouch 220 (equals in volume to 30% of the volumetric capacity VB) leaks out.

On the contrary, in this embodiment, the internal pouch 220 deforms in response to the expansion of the air. In other words, compared to the internal volume of the internal pouch 220 before the expansion, the internal volume of the internal pouch 220 is greater after the expansion, and the ink level in the negative pressure controlling chamber shell 110 changes to compensate for the fluctuation of the negative pressure in the internal pouch 220. Under the stable condition, the ink level in the negative pressure controlling chamber shell 110 changes to compensate for the decrease in the negative pressure in the capillary force generating members, in comparison to the negative pressure in the capillary force generating members before the change in the atmospheric pressure, caused by the ink from the internal pouch 220. In other words, the amount of the ink which flows out decreases in proportion to the amount of the expansion of the internal pouch 220, as depicted by a solid line (2). As is evident from the dotted line (1) and solid line (2), the amount of the ink which flows out of the internal pouch 220 may be estimated to be smaller compared to that in the case in which the internal pouch 220 does not deform at all in response to the expansion of the air. The above described phenomenon similarly occurs in the case of the change in the temperature of the ink container, except that even if the temperature increases approximately 50 degrees, the amount of the ink outflow is smaller than the amount of the ink outflow in response to the aforementioned atmospheric pressure decrease.

As described above, the ink container in accordance with the present invention can compensate for the expansion of the air in the ink storing container 201 caused by the ambient changes not only because of the buffering effect provided by the negative pressure controlling chamber shell 110, but also because of the buffering effect provided by the ink storing container 201 which is enabled to increase in its volumetric capacity to the maximum value at which the shape of the ink storing container 201 becomes substantially the same as the shape of the internal space of the external shell 210. Therefore, it is possible to provide an ink supplying system which can compensate for the ambient changes even if the ink capacity of the ink storing container 201 is substantially increased.

FIG. 8, (*b*) schematically shows the amount of the ink drawn out of the internal pouch 220 and the internal volume of the internal pouch 220, in relation to the length of the elapsed time, when the ambient pressure is reduced from the normal atmospheric pressure to the pressure value of P (0<P<1). In FIG. 8, (*b*), the initial volume of the air is VA1, and a time t0 is a point in time at which the ambient pressure is the normal atmospheric pressure, and from which the reduction in the ambient pressure begins. The axis of abscissas represents time (t) and the axis of ordinates represents the amount of the ink drawn out of the internal pouch 220 and the internal volume of the internal pouch 220. The changes in the amount of the ink drawn out of the internal pouch 220 in relation to the elapsed time is depicted by a solid line (1), and the change in the volume of the internal pouch 220 in relation to the elapsed time is depicted by a solid line (2).

As shown in FIG. 8, (*b*), when a sudden ambient change occurs, the compensation for the expansion of the air is made mainly by the ink storing container 201 before the normal state, in which the negative pressure in the negative pressure controlling chamber shell 110 balances with the negative pressure in the ink storing container 201, is finally restored. Therefore, at the time of sudden ambient change, the timing with which the ink is drawn out into the negative pressure controlling chamber shell 110 from the ink storing container 201 can be delayed.

Therefore, it is possible to provide an ink supplying system capable of supplying ink under the stable negative pressure condition during the usage of the ink storing container 201, while compensating the expansion of the air introduced in the ink storing container 201 through gas-liquid exchange, under various usage conditions.

According to the ink jet head cartridge in this embodiment, the volumetric ratio between the negative pressure controlling chamber shell 110 and internal pouch 220 can be optimally set by optionally selecting the material for the capillary force 2 generating members (ink absorbent pieces 130 and 140), and the material for the internal pouch 220; even if the ratio is greater than 1:2, practical usage is possible. In particular, when emphasis needs to be placed on the buffering effect of the internal pouch 220, all that is necessary is to increase, within the range in which the elastic deformation is possible, the amount of the deformation of the internal pouch 220 during the gas-liquid exchange, relative to the initial state.

As described above, according to the ink jet head cartridge in this embodiment, although the capillary force generating members occupies only a small portion of the internal volume of the negative pressure controlling chamber shell 110, it is still effective to compensate for the changes in the ambient condition, by synergistically working with the structure of the negative pressure controlling chamber shell 110.

Next, the ink flow through the absorbent material piece 140, from the opening of the joint pipe 180, or the opening of the connecting path, to the ink delivery opening 131, will be described.

The ink from the ink container unit 200 flows from the connective opening 230 to the delivery opening 131, through a path K, that is, the shortest distance path, which is a straight path connecting the joint pipe 180 to the delivery opening 131, or a path L which passes through the adjacencies of the interface 113*c*, and therefore, is longer than the path K (FIG. 2).

The joint opening (connective opening) 230 in this embodiment is also located above the delivery opening 131 as are the joint openings in the first to fourth embodiments, making it possible to reduce the difference in length between the paths K and L.

As described previously, in the negative pressure controlling chamber shell 110 of the ink jet head cartridge, the interface 113*c* which produces a capillary force of PS is formed by placing the absorbent material, piece 140 with a capillary force of P1 and the absorbent material piece 130 with a capillary force of P2 in the negative pressure controlling chamber shell 100, in the compressed state. The relationship among the above described capillary forces is: P2<P1<PS. In other words, the capillary force at the interface 113*c* is the strongest, the capillary force of the absorbing material piece 140 located on the bottom side is the next strongest, and the capillary force of the absorbent material piece 130 located on the top side is the weakest. Since the capillary force at the interface 113*c* is the strongest and the capillary force of the absorbent material piece 130 on the top side is the weakest, even if the ink which has been supplied through the joint pipe 180 flows into the absorbent material piece 130 on the top side, past the interface 113*c*, this ink is pulled toward the interface 113*c* with strong force, returning toward the interface 113*c*. As is evident from the above description, with the presence of the interface 113*c*, it does not occur that the path L forms a line which goes through both the absorbent material pieces 140 and 130. For this reason, along with the fact that the position of the connective opening 230 is located higher than the position of the delivery opening 131, it is possible to reduce the difference in length between the paths K and L. Therefore, it is possible to reduce the difference, in the effect which the ink receives from the absorbent material piece 140, which occurs as the ink path through the absorbent material piece 140 varies.

As described above, with the use of the ink jet head cartridge in this embodiment, it is possible to control the phenomena caused by the change in the ink ingredients effected by the absorbent material piece 140, for example, the unevenness of color tone in the same image, bleeding, and change in the adherence to recording paper, that is, recording medium. Thus, it is possible to form image with stable quality.

It is desired that the joint pipe 180 and joint opening 230 are positioned as high as possible. However, in order to secure the buffering function, it is desired that their positions are within a certain range as they are in this embodiment. Those positions may be optimally chosen according to various factors, for example, the characteristics of the absorbent material pieces 130 and 140, and ink, the amount by which ink is supplied, the amount of ink, and the like.

Further, in this embodiment, the ink absorbing member as the negative pressure generating member placed in the negative pressure controlling chamber shell 110 comprises two pieces 130 and 140 of absorbent material, which are different in capillary force. The piece with stronger capillary force is used as the piece for the bottom side. The positioning of the joint pipe 180 below, and adjacent to, the interface 113*c* between the absorbent material pieces 130 and 140 assures that the shifting of the ink path is controlled while providing a reliable buffering zone.

As for an ink delivery opening, the ink delivery opening 131 located at the approximate center of the bottom wall of the negative pressure controlling chamber shell 110 is described as an example. However, the choice is not limited to the ink delivery port 131; if necessary, an ink delivery opening may be moved away from the joint opening 230; in other words, it may be positioned at the left end of the bottom wall, or adjacent to the left sidewall. With such modifications, the position of the ink jet head unit 160, with which the holder 150 is provided, and the position of the ink delivery tube 165, may also be correspondingly altered to the left end of the bottom wall, or the adjacency of the left sidewall.

Next, referring to FIG. 9, the valve mechanism provided inside the joint opening 230 of the above described ink container unit 200 will be described.

Figure 9:
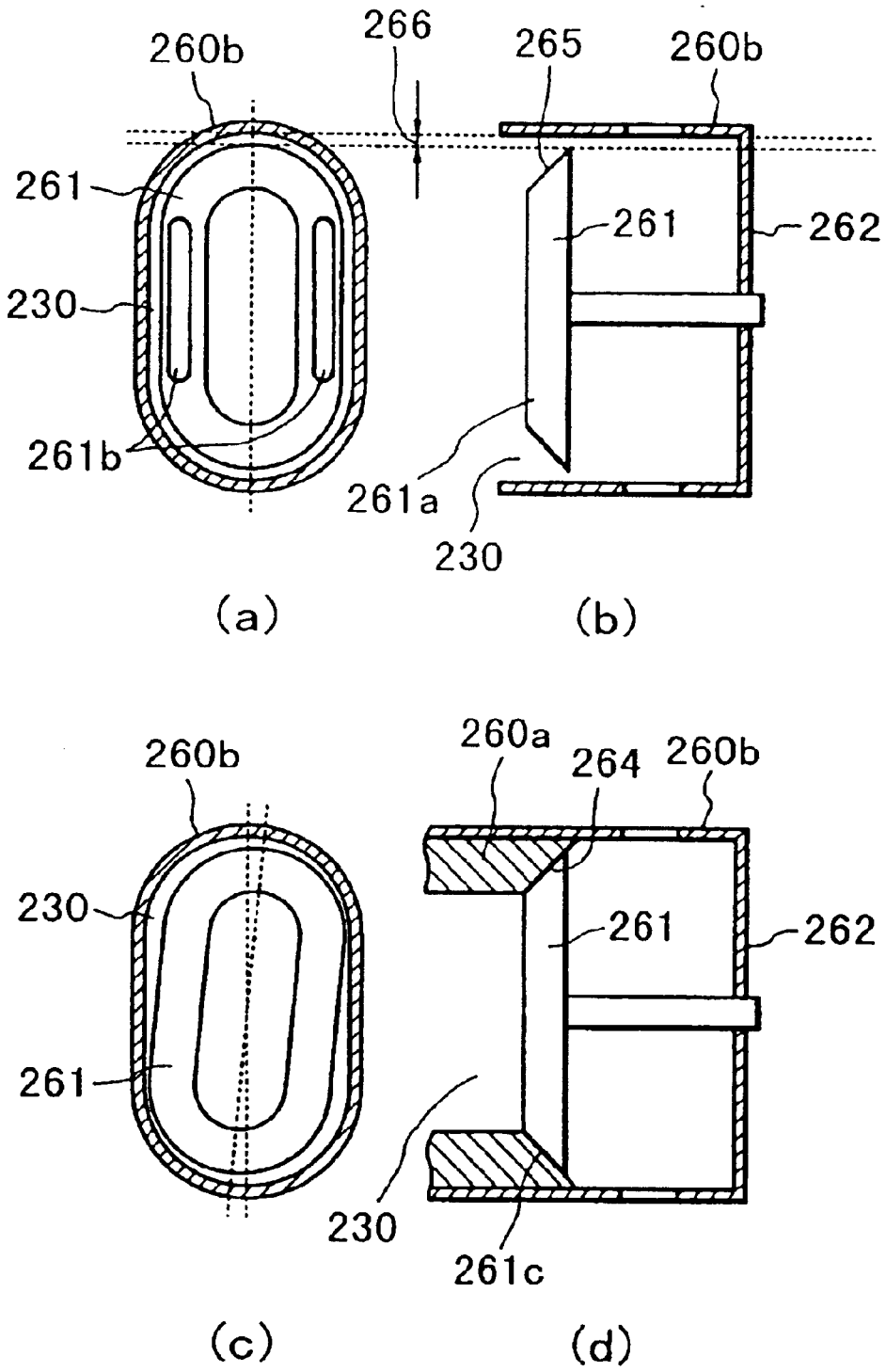
FIG. 9 is a drawing for depicting the valve mechanism provided within the joint opening of the ink container unit.

FIG. 9, (*a*), is a front view of the relationship between the second valve body 260*b* and valve plug 261; FIG. 9, (*b*), a lateral and vertically sectional view of the second valve body 260*b* and valve plug 261 illustrated in FIG. 9, (*a*); FIG. 9, (*c*), a front view of the relationship between the second valve body 260*b*, and the valve plug 260 which has slightly rotated; and FIG. 9, (*d*), is a lateral and vertically sectional view of the second valve body 260*b* and valve plug 260 illustrated in FIG. 9, (*c*).

As shown in FIG. 3, FIG. 9, (*a*), and FIG. 9, (*b*), the front end of the joint opening 230 is elongated in one direction, enlarging the cross-sectional area of the opening, to enhance the ink supplying performance of the ink storage container 201. However, if the joint opening 230 is widened in the width direction perpendicular to the lengthwise direction of the joint opening 230, the space which the ink storage container 201 occupies increases, leading to increase in the apparatus size. This configuration is particularly effective when a plurality of ink containers are placed side by side in terms of the widthwise direction (direction of the scanning movement of the carriage), in parallel to each other, to accommodate the recent trends, that is, colorization and photographic printing. Therefore, in this embodiment, the shape of the cross section of the joint opening 230, that is, the ink outlet of the ink storage container 201 is made oblong.

In addition, in the case of the ink jet head cartridge in this embodiment, the joint opening 230 has two roles: the role of supplying the external shell 210 with ink, and the role of guiding the atmospheric air into the ink storage container 201. Thus, the fact that the shape of the cross section of the joint opening 230 is oblong in the direction parallel to the gravity direction makes it easier to give the top and bottom sides of the joint opening 230 different functions, that is, to allow the top side to essentially function as the air introduction path, and the bottom side to essentially function as the ink supply path, assuring that gas-liquid exchange occurs flawlessly.

As described above, as the ink container unit 200 is installed, the joint pipe 180 of the negative pressure controlling chamber unit 100 is inserted into the joint opening 230. As a result, the valve plug 261 is pushed by the valve activation projection 180*b* located at the end of the joint pipe 180. Consequently, the valve mechanism of the joint opening 230 opens, allowing the ink in the ink storage container 201 to be supplied into the negative pressure controlling chamber unit 100. Even if the valve activation projection 180*b* misses the exact center of the valve plug 261 as it comes into contact with the valve plug 261 to push it, because of the attitude of the ink container unit 200 when the ink container unit 200 is engaged with the joint opening 230, the twisting of the valve plug 261 can be avoided because the cross section of the end portion of the sealing projection 180*a* placed on the peripheral surface of the joint pipe 180 is semicircular. Referring to FIGS. 9, (*a*) and (*b*), in order to allow the valve plug 261 to smoothly slide during the above process, a clearance 266 is provided between the joint sealing surface 260 in the joint opening 230, and the circumference of the first valve body side of the valve plug 261.

In addition, at the end of the joint pipe 180, at least the top portion has an opening, and therefore, when the joint pipe 180 is inserted into the joint opening 230, there is no hindrance to the formation of the essential air introduction path through the joint pipe 180 and the top side of the joint opening 230. Therefore, an efficient gas-liquid exchange is possible.

On the contrary, during the removal of the ink container unit 200, as the joint pipe 180 separates from the joint opening 230, the valve plug 261 is slid forward, that is, toward the first valve body 260*a*, by the resilient force which it receives from the resilient member 263. As a result, the tapered portion 264 of the first valve body 260*a* and the tapered portion 265 of the valve plug 261 engage with each other, closing the ink supply path, as shown in FIG. 9, (*d*).

In the case that the clearance 266 is provided between the valve plug 261 and second valve body 260*b* in the above structure, it sometimes occurs that the valve plug 261 rotates about its axis within the second valve body 260*b* as shown in FIG. 9, (*c*).

On the other hand, the value of the force applied to the first valve body 260*a* by the resilient member through the valve plug 261 is set up so that it is kept approximately constant even if a difference occurs between the internal and external pressures of the ink storage container 201 due to ambient change. If the ink storage container 201 configured as described above is carried into an environment in which the atmospheric pressure is 1.0 after it is used at a high altitude with an atmospheric pressure of 0.7 and the valve plug 261 is closed, the internal pressure of the ink storage container 201 becomes lower than the ambient pressure, or the atmospheric pressure, generating such a force that presses the valve pug 261 in the direction to open the valve mechanism. In this embodiment, the magnitude FA of the force by which the atmosphere presses the valve plug 261 is:

$FA=1.01\times10^5$ [N/m$^2$]

(atmospheric pressure: 1.0)

The magnitude FB of the force by which the gas in the ink container presses the valve plug 261 is:

$FB=0.709\times10^5$ [N/m$^2$]

(atmospheric pressure: 0.7)

The constant force FV necessary to be generated by the resilient member to keep the valve plug 261 in contact with the valve body must satisfy the following requirement:

$FV-(FA-FB)>0.$

In other words, in this embodiment, $FV>1.01\times10^5-0.709\times10^5$ $=0.304\times10^5$ [N/m$^2$].

This value applies to a situation in which the valve plug 261 is in contact with the first valve body 260*a*, under pressure. When the valve plug 261 is apart from the first valve body 260*a*, that is, after the amount of the deformation of the resilient member 263 for generating the force applied to the valve plug 261 has increased, the value of the force applied to the valve plug 261 by the resilient member 263 in the direction to push the valve plug 261 toward the first valve body 260*a* is greater, which is evident.

Defining as the maximum rotational angle, the angle by which the valve plug 261 rotates about is axis to come into contact with the second valve body 260*b*, when the valve plug 261 is kept in contact with the first valve body 260*a* by the pressure from the resilient member after rotating the maximum angle, there are two contact points between the tapered portion 264 of the valve body and the seal portion 261*c* of the valve plug 261, which are approximately symmetrically positioned with respect to the rotational axis. Since the valve plug 261 is under the pressure applied toward the first valve body 260*a*, restitutive force applied to the valve plug 261 in the direction opposite to the direction in which the valve plug 261 was rotated by the aforementioned maximum angle, stabilizing the tapered portion 264 of the valve body and the seal portion 261*c* of the valve plug, in the fully engaged state. Referring to FIG. 9, (*a*), in the state in which the tapered portion 264 of the valve body and the seal portion 261*b* of the valve plug are fully engaged, they are in contact with each other across the contact area 261*b*. However, as the valve plug 261 rotates, frictional force is generated at the contact point between the tapered portion 264 of the valve body and the seal portion 261*c* of the valve plug. Therefore, the smaller the rotational angle necessary to restitute the rotation, the smaller the amount of the work necessary for restitution, and therefore, the swifter the engagement between the first valve body 260*a* and valve plug 261.

The inventors of the present invention reached the conclusion, as a result of an experiment, that when the ratio of the clearance 266 to the measurement of the valve 261 in the widthwise direction was approximately 1:25, if the ratios in length of the major axes to the minor axes of the cross sections of the valve plug 261 and second valve body 260*b* at a plane perpendicular to the flow path direction, were greater than 3:2, the maximum rotational angle of the valve plug 261 was approximately 10 degrees, and that it was possible that even if the valve plug rotated as the valve mechanism opened, the valve plug 261 engaged with the first valve body 260*a* after the rotational angle of the valve plug 261 was restituted to 0 degree while the valve mechanism closed. In addition, when the ratios in length of the major axes of the cross sections of the valve plug 261 and second valve body 260*b* at a plane perpendicular to the flow path direction were no more than 3:2, the valve plug failed to restitute the maximum rotational angle while the valve mechanism closed. Therefore, the valve plug 261 remained twisted relative to the first valve body 260*a* as it engaged with the first valve body 260*a*. As a result, the valve mechanism failed to perfectly seal the joint opening 230.

In this embodiment, the ratios in length of the major axes to the minor axes of the cross sections of the valve plug 261 and second valve body 260*b* at a plane perpendicular to the flow path direction, were set at approximately 10:5, which was greater than 3:2. With this netting, the actually measured maximum rotational angle of the valve plug 261 was approximately 5 degrees, and when the valve mechanism closed with the valve plug 261 in the rotated state, the rotational angle of the valve plug 261 was restricted to 0 degree by the force which applied to the valve plug 261 in this embodiment. As a result, the valve plug 261 and first valve body 260*a* engaged with each other, closing the valve mechanism virtually airtightly.

Figure 10:
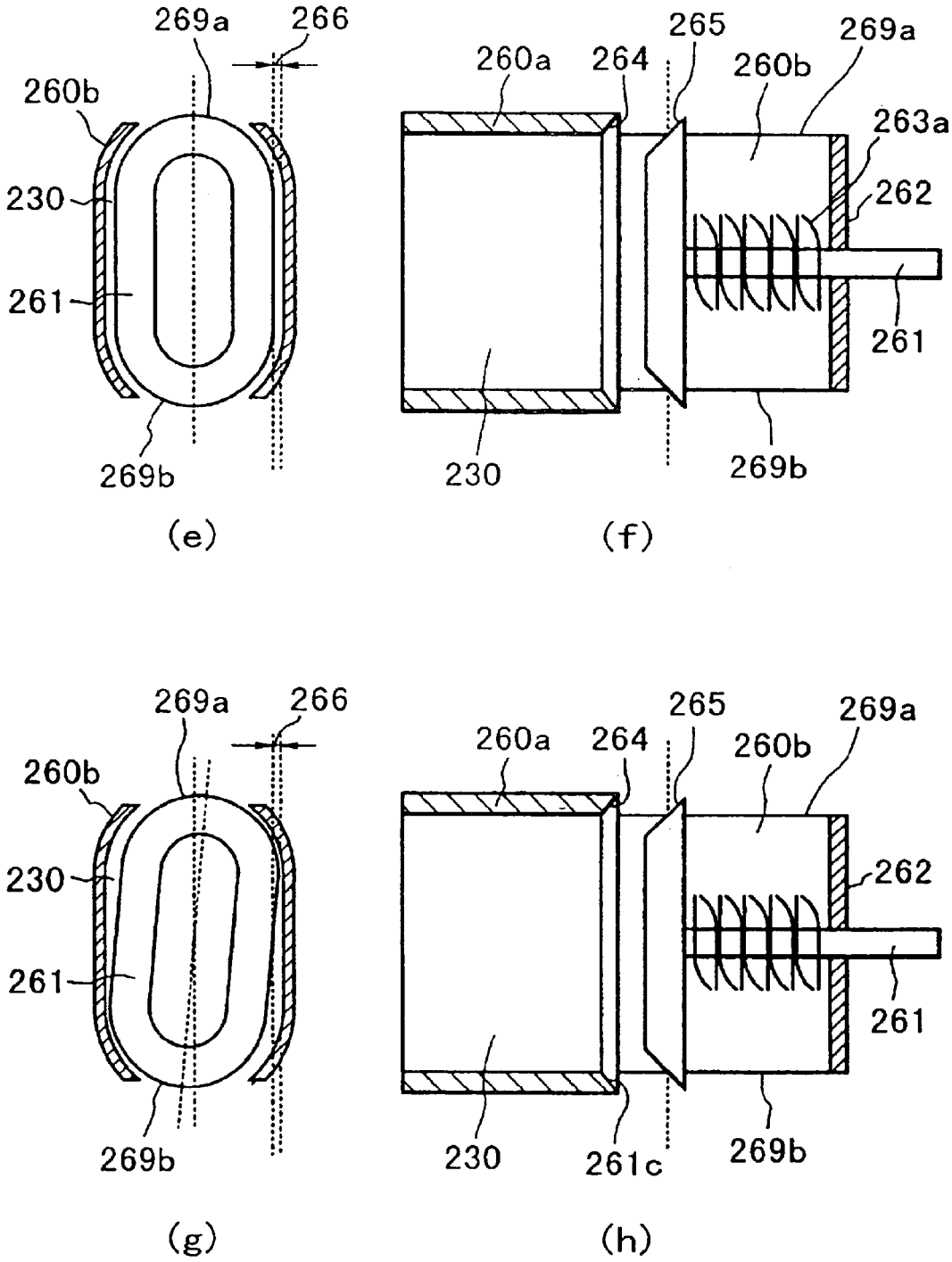
FIG. 10 is a drawing for depicting another example of the valve mechanism.

At this point in time, referring to FIGS. 10 and 11, other examples of the valve mechanism will be described. FIGS. 10, (*e*)–(*h*) correspond to FIGS. 9, (*a*)–(*d*).

Figure 11:
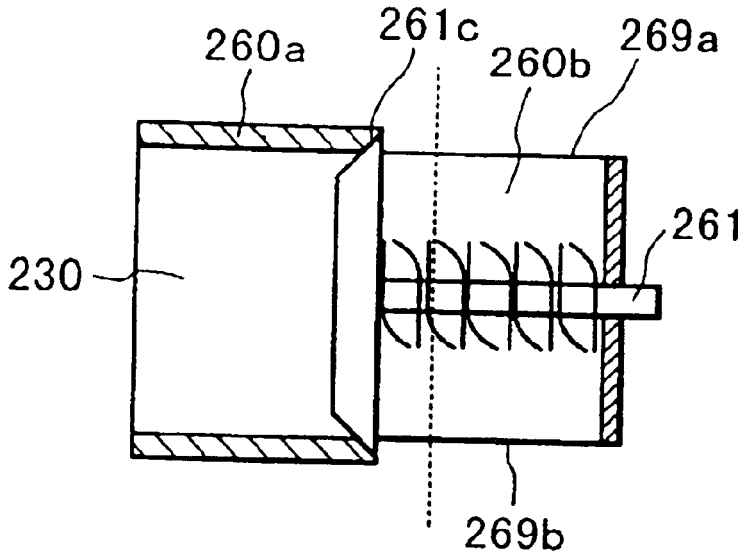
FIG. 11 is a drawing for depicting the open and closed state of the valve mechanism illustrated in FIG. 10.
Figure 11:
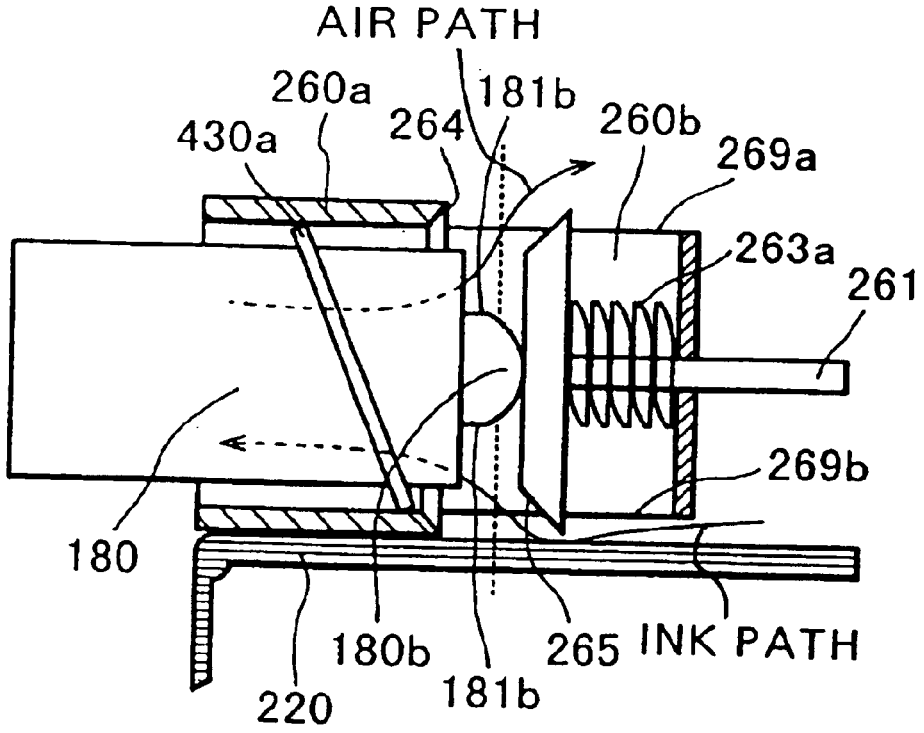

The valve mechanism shown in FIGS. 10 and 11 comprises the first valve body 260*a*, second valve body 260*b*, valve plug 261, resilient member 263*a*, and valve cover 262.

The valve plug 261 is under the pressure generated toward the first valve body 260*a* by the resilient member 263*a*. Referring to FIG. 11, (*i*), the valve mechanism is closed as the tapered portion 265 of the valve plug 261 comes into contact with the tapered portion 264 of the valve body 260*a*, keeping the ink container unit 200 airtightly sealed. As shown in FIG. 11, (*i*), the valve plug 261 is enabled to slide in the second valve body 260*b* so that as the valve plug 261 (under the pressure generated by a spring 263*a* similar to the aforementioned resilient member 263) is pressed by the valve activation projection 180*b* toward the valve cover 262, it slides in the second valve body 260*b* and unseals the ink unit 200 at the interface between the aforementioned two tapered portions. The second valve body 260*b* is provided with an opening 269*b*, which is located on the bottom side of the ink container, adjacent to the tapered portion of the valve body. According to the configuration of this opening 269*b*, during the process in which the valve mechanism is opened, the valve plug 261 moves toward the valve cover 262 by being pressed by the valve activation projection 180*b*, and as soon as the valve plug 261 begins to move, the ink in the ink container unit 200 begins to be supplied into the negative pressure controlling chamber unit 100, and the amount of the unusable body of ink which remains in the ink container when the usable body of ink in the ink container has been depleted can be minimized. Referring to FIG. 10, (*e*), the size of the opening 269*b* is such that the curved portion of the wall of the second valve body 260*b*, against which the valve plug 261 slides, partially remains, in terms of the thickness direction of the ink container. According to the above structure, the size of the opening 269*b* can be maximized without depriving the valve body 260*b* of the function to regulate the aforementioned twisting of the valve plug 261, making it possible to provide a reliably valve mechanism capable of dealing with a large amount of liquid flow.

In this embodiment, the second valve body 260*b* is provided with another opening 269*a*, which is symmetrical in terms of location with the opening 269*b*, with respect to the axis of the valve body 260*b*.

As described above, according to this structure, the large openings 269*a* and 269*b* are provided in the top and bottom portions of the second valve body 260*b*, respectively, and therefore, it is easy to separate the gas flow from the liquid flow during the gas-liquid exchange, in addition to the above described effects. In other words, the top opening 269*a* functions as an air introduction path to enhance the gas flow, and the bottom opening 269*b* functions as an ink flow path to enhance the liquid flow, which is preferable.

Next, referring to FIGS. 4 and 5, the relationship between the engagement or disengagement of the joint portion, and the ID, will be described. FIGS. 4 and 5 show steps for installing the ink container unit 200 into the holder 150, wherein FIGS. 4, (*a*)–(*c*) corresponds in timing to FIGS. 5, (*a*)–(*c*). FIG. 4 shows the state of the ID, and FIG. 5 shows in detail the joint portion.

In the first step, the ink container unit 200 is inserted up to the position illustrated in FIG. 4, (*a*) and FIG. 5, (*a*), at which the plurality of ID members 170 for preventing the ink container unit installation error make contact with the slanted wall 251 of the ink container. The holder 150 and ink container unit 200 are structured so that at this point in time, the joint opening 230 and joint pipe 180 absolutely do not make contact. If a wrong ink container unit 200 is inserted, the slanted surface 251 of the wrong ink container unit 200 collides with the ID members 170 at this point in time, preventing the wrong ink container unit 200 from being inserted further. With this structural arrangement, the joint opening 230 of the wrong ink container unit 200 never makes contact with joint pipe 180. Therefore, the problems which occur at the joint portion as a wrong ink container unit 200 is inserted, for example, the mixture of inks with different color, ink solidification, production of incomplete images, and breaking down of the apparatus, can be prevented, and therefore, it never occurs that the head and ink containing portion of an apparatus, the ink containing portions of which are replaceable, will be replaced due to the occurrence of such problems.

If the inserted ink container unit 200 is a correct one, the positions of the ID members 170 match the positions of the ID member slots 252 as shown in FIG. 4, (*b*), and FIG. 5, (*b*). Therefore, the ink container unit 200 is inserted a little deeper toward the negative pressure controlling chamber unit 100 to a position shown in FIG. 4, (*b*) At this position, the joint sealing surface 260 of the joint opening 230 of the ink container unit 200 has come into contact with the bottom side of the sealing projection 180*a* of the joint pipe 180.

Thereafter, the both sides are completely joined through the steps described before, providing a passage between the internal space of the ink container unit 200 and the internal space of the negative pressure controlling chamber unit 100.

In the above described embodiment, the sealing projection 180*a* is an integral part of the joint pipe 180. However, the two components may be separately formed. In such a case, the sealing projection 180*a* is fitted around the joint pipe 180, being loosely held by a projection formed on the peripheral surface of the joint pipe 180, or a groove provided in the peripheral surface of the joint pipe 180, so that the sealing projection 180*a* is allowed to move on the peripheral surface of the joint pipe 180. However, the joint portion is structured so that within the moving range of the independent sealing projection 180*a*, the valve action controlling projection 180*b* does not make contact with the valve plug 261 until the sealing projection 180*a* comes into contact with the joint sealing surface 260.

In the above description of this embodiment, it is described that as the ink container unit 200 is further inserted, the bottom side of the sealing projection 180*a* comes into contact with the joint sealing surface 260, and the sealing projection 180*a* slides on the joint sealing surface 260, gradually expanding the contact range between the sealing projection 180*a* and the joint sealing surface 260, upward toward the top side of the sealing projection 180*a*, until the top end of the sealing projection 180*a* finally comes into contact with the joint sealing surface 260. However, the installation process may be such that, first, the top side of the sealing projection 180*a* comes into contact with the joint sealing surface 260, and as the ink container unit 200 is further inserted, the sealing projection 180*a* slides on the joint sealing surface 260, gradually expanding the contact range between the sealing projection 180*a* and the joint sealing surface 260, downward toward the bottom end of the sealing projection 180*a*, until the bottom end of the sealing projection 180*a* finally makes contact with the joint sealing surface 260*a*. Further, the contact between the sealing projection 180*a* and joint sealing surface 260 may occur simultaneously at both the top and bottom sides. During the above process, if the air present between the joint pipe 180 and valve plug 261 opens the valve mechanism by pushing the valve plug 261 inward of the joint opening 230, the ink 300 within the ink storage container 201 does not leak outward, because the joint opening 230 has been completely sealed at the joint between the sealing projection 180*a* and joint sealing surface 260. In other words, the essential point of this invention is that the valve mechanism is opened only after the joint between the joint pipe 180 and joint opening 230 is completely sealed. According to this structure, it does not occur that the ink 300 within the ink container unit 200 leaks out during the installation of the ink container unit 200. In addition, the air pushed into the joint opening 230 enters the ink container unit 200, and pushes out the ink 300 in the ink storage container 201 into the joint opening 230, contributing to smoothly supplying ink from the ink storage container 201 into the absorbent material piece 140.

Figure 12:
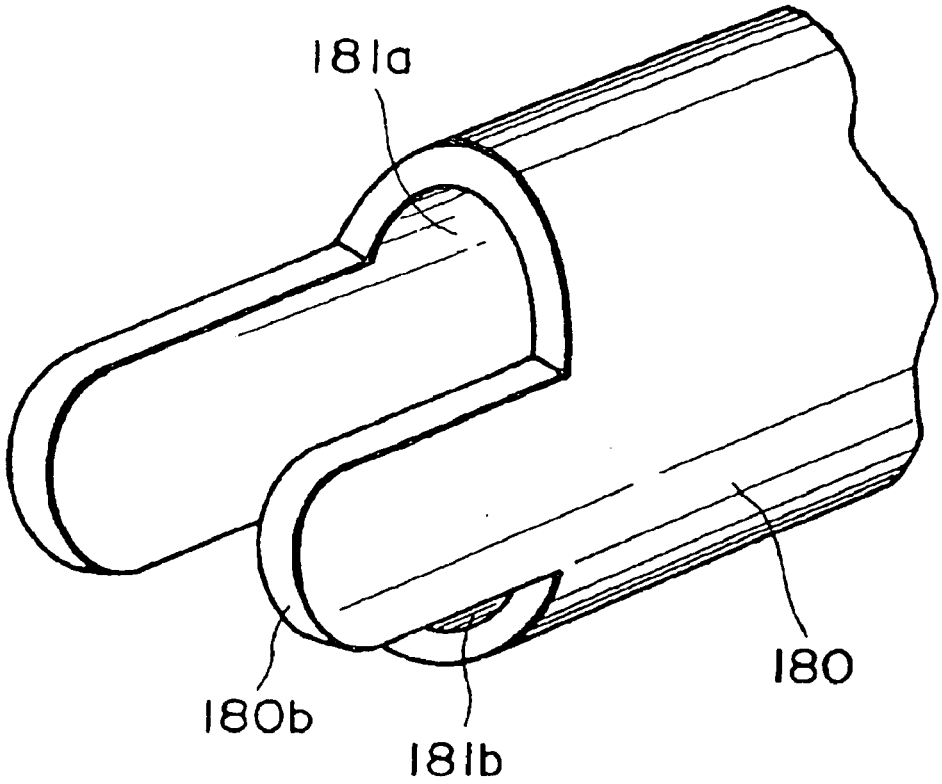
FIG. 12 is a perspective view for showing the shape of the end portion of the joint pipe.

FIG. 12 is a perspective view of the end portion of the joint pipe 180, and depicts an example of the shape of the end portion. As shown in FIG. 12, the top side of the end portion of the joint pipe 180 is provided with an opening 181*a*, and the bottom side of the end portion of the joint pipe 180 is provided with an opening 181*b*. The bottom side opening 181*b* is an ink path, and the top side opening 181*a* is an air path, although ink is occasionally passed through the top side opening 181*a*.

The measurements of the components which constitute the valve mechanism of the joint pipe 180 are as follows: the measurement of the valve plug 261 in the lengthwise direction is 9.5 mm; the measurement of the valve plug 261 in the widthwise direction is 5.0 mm; the measurement of the second valve body 260*b* in the lengthwise direction is 5.4 mm and the clearance 266 between the valve 261 and second valve body 260*b* is 0.2 mm. When the valve plug 261 and first valve body 260*a* are in contact with each other, the distance from the engagement region 261*b* of the valve pug 261 from the valve cover 262 is approximately 15.5 mm. The angle by which the valve plug 261 rotates about the contact point between the valve cover 262 and the sliding shaft of the valve plug 261, in the vertical plane which is approximately parallel to the flow path direction, is approximately 0.7 degree, which is negligible.

By shaping the joint opening 230 and valve mechanism so that their cross sections become oblong, the rotational angle of the valve plug 261 during the sliding of the valve plug 261 can be minimized, and also, the valve response can be improved. Therefore, it is possible to assure that the valve mechanism of the joint opening 230 flawlessly functions in terms of sealing performance. Further, with the joint opening 230 and valve mechanism being shaped so that their cross sections become oblong, the projection 180*a* for sealing, provided on the peripheral surface of the joint opening 230, and the valve plug 261, swiftly slide through the joint opening 230 during the installation or removal of the ink container unit 200, assuring that the connecting operation ensues smoothly.

Next, referring to FIG. 13, a method for manufacturing the ink containers in this modification will be described.

Figure 13:
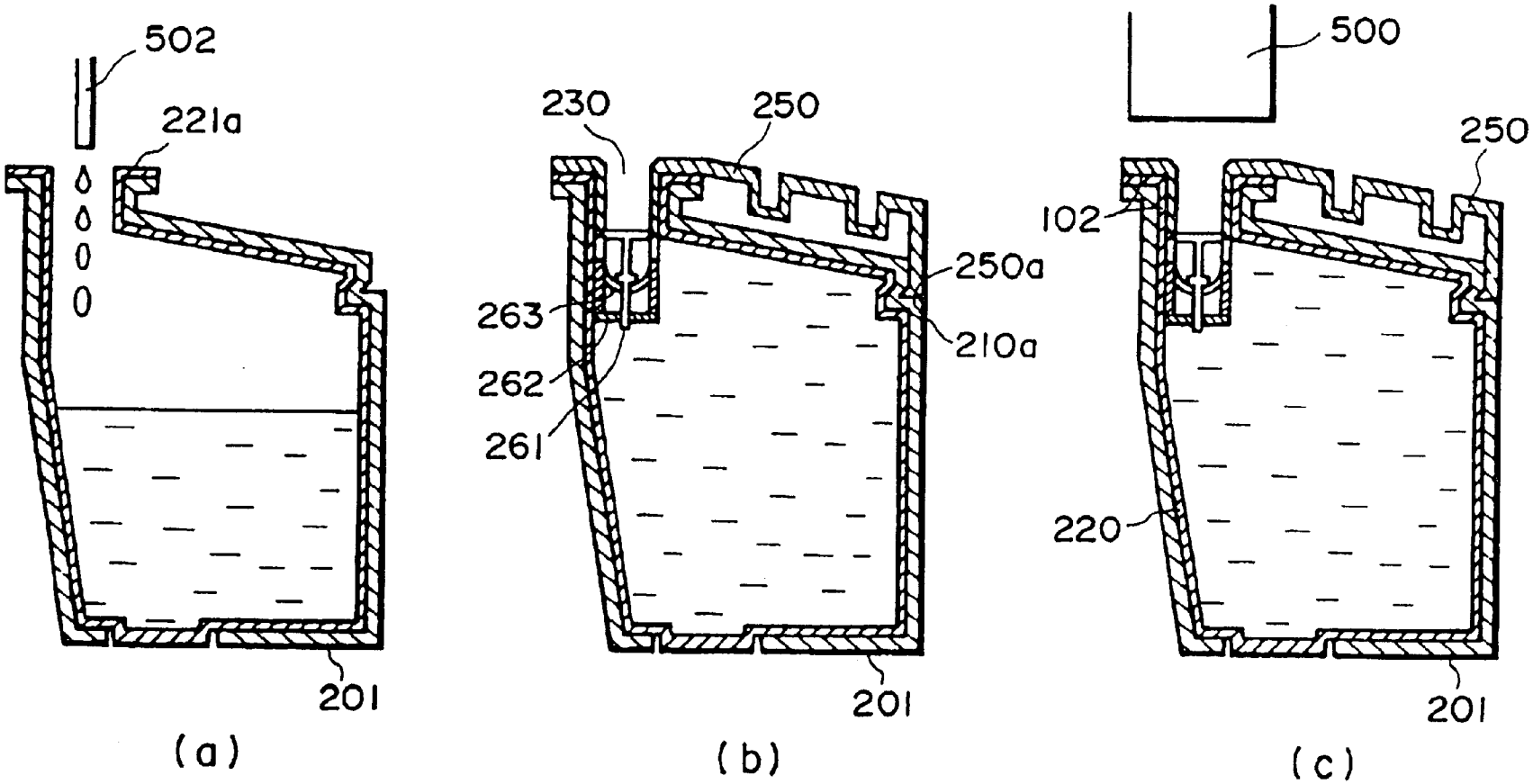
FIG. 13 is a drawing for describing the general concept of an example of a manufacturing method for the ink container unit illustrated in FIG. 2.

First, referring to FIG. 13, (*a*), the exposed portion 221*a* of the internal pouch 220 of the ink storage container 201 is directed upward, and the ink 501 is injected into the ink storage container 201 with the use of an ink injection nozzle 502. In the case of the structure in accordance with the present invention, ink injection can be performed under the atmospheric pressure.

Next, referring to FIG. 13, (*b*), the ID member 250 into which the valve plug 261, valve cover 262, and resilient member 263, has been assembled, is placed in a manner to cover the ink storage container 201. During this process, the engagement portions 210*a* with which the external shell of the ink storage container 201 is provided are engaged with the click portions 250*a* of the ID member 250, accurately fixing the positional relationship between the ink storage container 201 and the ID member 250.

After the above described temporary fixing, the above described welding encircling the joint opening is carried out. By temporarily fixing the ID member 250, the joining of the ID member 250 becomes easy, and it becomes possible to simply increase the positional accuracy. Referring to FIG. 13, (*c*), the welding horn 500 is placed from above, in contact with, the periphery of the joint opening 230 of the ID member 250, so that the ID member 250 and the internal pouch 220 are welded to each other at the sealing surface 102. The present invention is applicable to a production method which uses ultrasonic welding or vibration welding, as well as a production method which uses thermal welding, adhesive, or the like.

Next, the detection of the ink remainder amount in the ink container unit will be described.

Referring to FIG. 2, below the region of the holder 150 where the ink container unit 200 is installed, the electrode 270 in the form of a piece of plate with a width narrower than the width of the ink storing container 201 (depth direction of the drawing) is provided. This electrode 270 is fixed to the carriage (unillustrated) of the printer, to which the holder 150 is attached, and is connected to the electrical control system of the printer through the wiring 271.

On the other hand, the ink jet head unit 160 comprises: an ink path 162 connected to the ink delivery tube 165; a plurality of nozzles (unillustrated) equipped with an energy generating element (unillustrated) for generating the ink ejection energy; and a common liquid chamber 164 for temporarily holding the ink supplied through the ink path 162, and then, supplying the ink to each nozzle. Each energy generating element is connected to a connection terminal 281 with which the holder 150 is provided, and as the holder 150 is mounted on the carriage, the connection terminal 281 is connected to the electrical control system of the printer. The recording signals from the printer are sent to the energy generating elements through the connection terminal 281, to give ejection energy to the ink in the nozzles by driving the energy generating elements. As a result, ink is ejected from the ejection orifices, or the opening ends of the nozzles.

Also, in the common liquid chamber 164, an electrode 280 is disposed, which is connected to the electrical control system of the printer through the same connection terminal 281. These two electrodes 270 and 280 constitute the ink remainder amount detecting means in the ink storing container 201.

Further, in this embodiment, in order to enable this ink remainder amount detecting means to detect more accurately the ink remainder amount, the joint opening 230 of the ink container unit 200 is located in the bottom portion, that is, the bottom portion when in use, in the wall of the ink storage container 201, between the largest walls of the ink storage container 261 illustrated in FIG. 2. Further, a part of the bottom wall of the ink supplying container 201 is slanted so that the bottom surface holds an angle relative to the horizontal plane when the ink storage container 201 is in use. More specifically, referring to the side, where the joint opening 230 of the ink container unit 200 is located, as the front side, and the side opposite thereto, as the rear side, in the adjacencies of the front portion in which the valve mechanism is disposed, the bottom wall is rendered parallel to the horizontal plane, whereas in the region therefrom to the rear end, the bottom wall is slanted upward toward the rear. In consideration of the deformation of the internal pouch 220, which will be described later, it is desired that this angle at which the bottom wall of the ink storage container 201 is obtuse relative to the rear sidewall of the ink container unit 200. In this embodiment, it is set to be no less than 95 degrees.

The electrode 270 is given a shape which conforms to the shape of the bottom wall of the ink storage container 201, and is positioned in the area correspondent to the slanted portion of the bottom wall of the ink storage container 201, in parallel to the slanted portion.

Hereinafter, the detection of the ink remainder amount in the ink storage container 201 by this ink remainder amount detecting means will be described.

The ink remainder amount detection is carried out by detecting the capacitance (electrostatic capacity) which changes in response to the size of the portion of the electrode 270 correspondent to where the body of the remaining ink is, while applying pulse voltage between the electrode 270 on the holder 150 side and the electrode 280 in the common liquid chamber 164. For example, the presence or absence of ink in the ink storage container 201 can be detected by applying between the electrodes 270 and 280, such pulse voltage that has a peak value of 5V, a rectangular waveform, and a pulse frequency of 1 kHz, and computing the time constant and gain of the circuit.

As the amount of the ink remaining in the ink storage container 201 reduces due to ink consumption, the ink liquid surface descends toward the bottom wall of the ink storage container 201. As the ink remainder amount further reduces, the ink liquid surface descends to a level correspondent to the slanted portion of the bottom wall of the ink storage container 201. Thereafter, as the ink is further consumed (the distance between the electrode 270 and the body of the ink remains approximately constant), the size of the portion of the electrode 270 correspondent to where the body of ink remains, gradually reduces, and therefore, capacitance begins to reduce.

As the ink is further consumed, the size of the body of ink becomes so small that it corresponds to only the horizontal portion 270*a* of the electrode 270. This horizontal portion 270*a* is located adjacent to the position of the valve mechanism, and the size of the portion of the electrode 270, which corresponds to the remaining body of ink, is extremely small, and therefore, the capacitance is virtually zero, indicating that the ink has been almost completely consumed.

Eventually, the ink will disappear from the area which corresponds with the position of the electrode 270. Thus, the decrease of the gain, and the increase in electrical resistance caused by the ink, can be detected by computing the time constant by changing the pulse width of the applied pulse or changing the pulse frequency. With this, it is determined that the ink in the ink storage container 201 is extremely small has been used up.

The above is the general concept of the ink remainder amount detection. In reality, in this embodiment, the ink storage container 201 comprises the internal pouch 220 and external shell 210, and as the ink is consumed, the internal pouch 220 deforms inward, that is, in the direction to reduce its internal volume, while allowing gas-liquid exchange between the negative pressure controlling chamber shell 110 and ink storage container 201, and the introduction of air between the external shell 210 and internal pouch 220 through the air vent 222, so that balance is maintained between the negative pressure in the negative pressure controlling chamber shell 110 and the negative pressure in the ink storage container 201.

Referring to FIG. 6, during this deformation, the internal pouch 220 deforms while being controlled by the corner portions of the ink storage container 201. The amount of the deformation of the internal pouch 220, and resultant partial or complete separation of the walls of the internal pouch 220 from the external shell 210, are the largest at the two walls having the largest size (walls approximately parallel to the plane of the cross sectional drawing in FIG. 6), and is small at the bottom wall, or the wall adjacent to the above two walls. Nevertheless, with the increase in the deformation of the internal pouch 220, the distance between the body of the ink and the electrode 270 increases, and the capacitance decreases in reverse proportion to the distance. However, in this embodiment, the main area of the electrode 270 is in a plane approximately perpendicular to the deformational direction of the internal pouch 220, and therefore, even when the internal pouch 220 deforms, the electrode 270 and the wall of the bottom portion of the internal pouch 220 remain approximately parallel to each other. As a result, the surface area directly related to the electrostatic capacity is secured in terms of size, assuring accuracy in detection.

Further, as described before, In this embodiment, the ink storage container 201 is structured so that the angle of the corner portion between the bottom wall and the rear sidewall becomes obtuse, more specifically, no less than 95 degrees. Therefore, it is easier for the internal pouch 220 to separate from the external shell 210 at this corner compared to the other corners. Thus, even when the internal pouch 220 deforms toward the joint opening 230, it is easier for the ink to be discharged toward the joint opening 230.

Hereinbefore, the structural aspects of this embodiment were individually described. These structures may be employed in optional combinations, and the combinations promise a possibility of enhancing the aforementioned effects.

For example, combining the oblong structure of the joint portion with the above described valve structure stabilizes the sliding action during the installation or removal, assuring that the value is smoothly open or closed. Giving the joint portion the oblong cross section assures an increase in the rate at which ink is supplied. In this case, the location of the fulcrum shifts upward, but slanting the bottom wall of the ink container upward makes possible stable installation and removal, that is, the installation and removal during which the amount of twisting is small. In addition, as described above, by forming the ID member inclusive of a part of the valve body as an independent member, it becomes possible to attach the valve to the ID member, without attaching the valve directly to the blow tank, improving the valve portion in terms of the integrity against the force generated during the installation or removal, and also in terms of operational accuracy during the installation or removal.

As described above, the above structure in this embodiment is a structure not found among the conventional recording apparatuses. Not only do the aforementioned substructures of this structure individually contribute to the effectiveness and efficiency, but also contribute cooperatively, rendering the entirety of the structure organic. In other words, the above described substructures are excellent inventions, whether they are viewed individually or in combination; disclosed above are examples of the preferable structure in accordance with the present invention (Embodiment 2)

Figure 18:
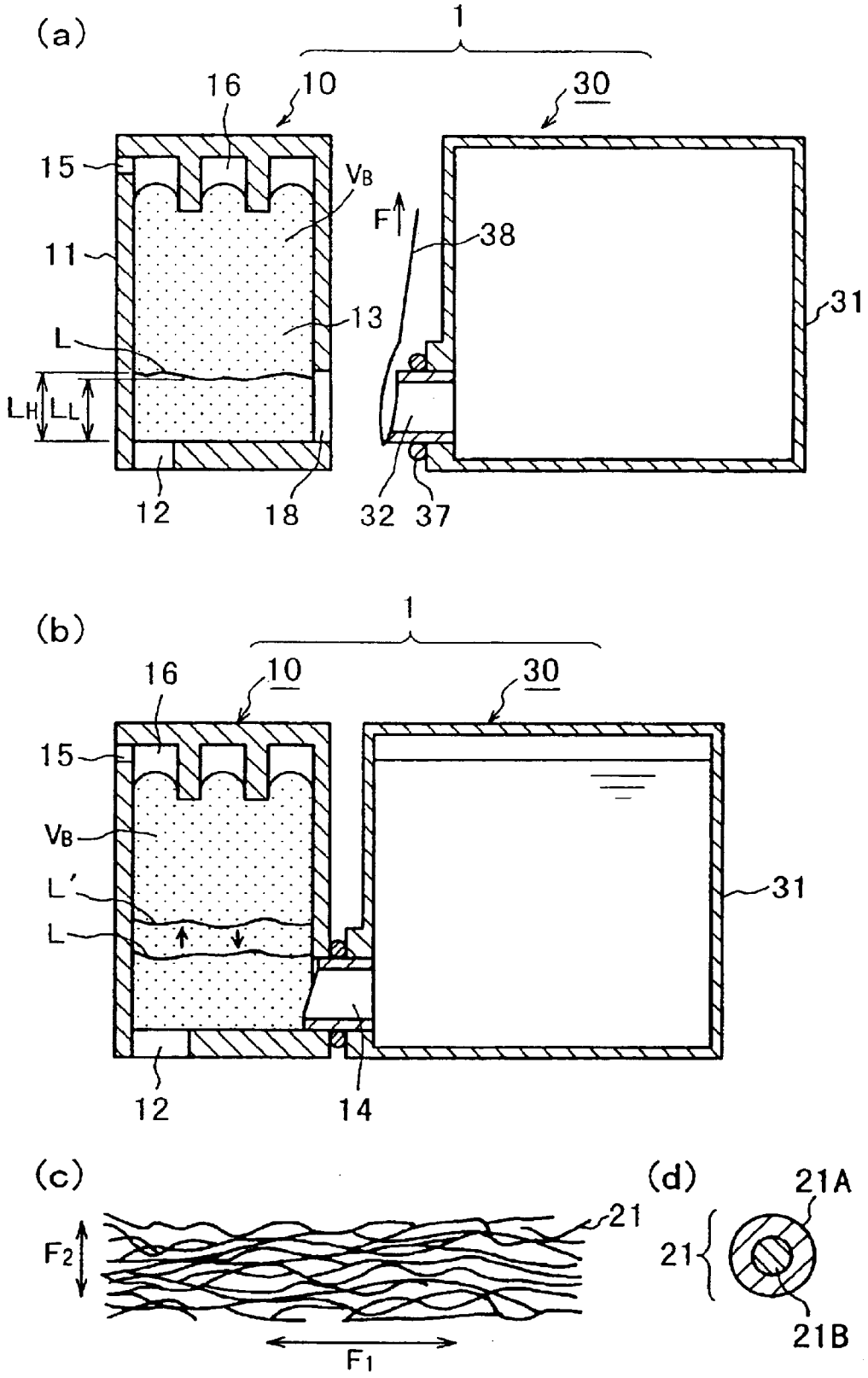
FIG. 18 is a schematic drawing of the liquid supplying system in the second embodiment of the present invention, wherein (*a*) shows the state in which the capillary force generating member storage chamber has been removed from the liquid supply container; (*b*) shows the state in which both the containers are in connection with each other, and (*c*) is an enlarged view of the fiber strands in the capillary force generating member; and (*d*) is a further enlarged sectional view of a fiber strand.

FIGS. 18, (*a*) and (*b*), are schematic drawings for depicting an ink container compatible with a liquid supplying system in accordance with the present invention. In this embodiment, a liquid supplying system for accomplishing the aforementioned second object of the present invention is presented.

An ink container 1 comprises a capillary force generating member storage container 10 as a capillary force generating member storage chamber, and a liquid supply container 30 as an ink storage chamber. The liquid supply container 30 is structured so that it can be separated from the capillary force generating member storage container 10 at a gas-liquid exchange path 14. In FIG. 18, (*a*) shows the state before the capillary force generating member storage container 10 and liquid supply container 30 are connected to each other, and (*b*) shows their state after their connection.

The capillary force generating member storage container 10 comprises a shell 11 provided with an ink delivery opening 12 through which ink (inclusive of processing liquid and the like) is supplied outward to a recording head portion or the like which records images by ejecting liquid from an ejection orifice 61, and a capillary force generating member 13 which is formed of mixed strands of polypropylene fiber and polyethylene fiber, and the like, and is stored in the shell 11; and a connective opening 18 which is in contact with the capillary force generating member and through which the liquid is introduced from the liquid supply container. The shell 11 is provided with an air vent 15 through which the capillary force generating member stored in the shell is exposed to the ambient air. Adjacent to this air vent 15, a buffer space 16 is provided by the ribs which project from the inward surface of the shell.

On the other hand, the liquid supply container 30 directly holds ink in the shell 11, and is provided with an ink delivery opening 32 which is connected to the connective opening 18 of the capillary force generating member storage container 10 so that the liquid stored in the shell 31 (liquid storage portion) is drawn out into the capillary force generating member storage container 10. In this embodiment, the ink delivery opening 32 projects from the shell 31, and is connected to the aforementioned connective opening 18 to form a path between the liquid supply container 30 and capillary force generating member storage container 10. The liquid storage portion of the liquid storage container 30 constitutes a space virtually sealed from the ambient air, although there is this path. The joint portion between the ink delivery portion 32 and connective opening 18 is provided with a sealing member 34, for example, an O-ring, preventing ink leakage from the joint, and air introduction through the joint. A referential numeral 38 designates a sealing means, such as a piece of film, for preventing the ink stored in the liquid supply container 30 from leaking from the ink delivery opening before the liquid supply container 30 is connected to the capillary force generating member storage container 10. This means can be peeled away from the ink delivery opening by pulling it in the direction F in the drawing.

At this point, the capillary force generating member 13 in this embodiment will be described in further detail. The capillary force generating member 13 in this embodiment is formed of mixed strands of polypropylene fiber and polyethylene fiber. The length of each of the fiber strands which constitute the capillary force generating member 13 in this embodiment is approximately 60 mm. Referring to FIG. 18, (*d*), which shows the cross section of a fiber strand 21, the each fiber strand comprises a sheath layer 21A and a core portion 21B, which are concentric. The sheath layer 21A is formed of polyethylene, which has relatively low melting point, and the core portion 21B is formed of polypropylene which has relatively high melting point. The capillary force generating member 13 in this embodiment is manufactured through the following steps. First, a wad of such short strands is put through a carding machine to parallel the strands, is heated (heating temperature is desired to be set higher than the melting point of polyethylene, which is relatively low, and lower than the melting point of polypropylene, which is relatively high), and then, is cut to a desired length.

Therefore, the fiber strands are arranged in a continuous manner mainly in their longitudinal direction (F1) in which they are paralleled by a carding machine. In terms of the direction perpendicular to the longitudinal direction (F1), they are partially fused, that is, connected, to the adjacent strands, at their intersections, during the thermal molding process. Therefore, the capillary force generating member 13 is difficult to tear when tension is applied in the direction F1 in the drawing, but can be easily torn by applying tension in the direction F2 in the drawing because the fused intersections are destroyed by the tension applied in such a direction. In the capillary force generating member 13 formed of fiber strands, capillary force is generated by the presence of gaps among the strands. In the capillary force generating member in this embodiment, the fiber strands possess directionality: the major fiber strand direction (F1) and the fiber strand direction (F2) perpendicular to the major fiber strand direction (F1), creating differences between the major fiber strand directions (F1) and (F2) in terms of how ink flows through them, and how ink is statically retained.

In this embodiment, the capillary force generating member 13 is positioned so that its major fiber strand direction (F1) becomes substantially parallel to the horizontal direction and the line leading from the joint portion to the ink delivery opening 12. Thus, after the connection of the liquid supply container 30, the gas-liquid interface L in the capillary force generating member 13 becomes more or less parallel to the major fiber strand direction (F1), which is parallel to the horizontal direction. THerefore, even if the level of the gas-liquid interface L changes to a level L' as shown in FIG. 8, (*b*), due to the ambient changes, the gas-liquid interface L remains horizontal, and as the ambience settles, it moves back to the level L, or the original level. In other words, in the case of the capillary force generating member in this embodiment, the deviation of the gas-liquid interface L in the gravity direction does not increase in proportion to the number of the ambient change cycles, unlike in the case of a capillary force generating member based on the background arts, illustrated in FIG. 1. Therefore, when the liquid in the liquid supply container 30 is used up, and the liquid depleted container is replaced with a fresh liquid supply container 30, the gas-liquid interface L is kept approximately horizontal as shown in FIG. 8, (*a*), allowing no possibility that the buffering space VB reduces in volume due to the increase in the number of times the liquid supply container 30 is replaced.

All that is necessary to keep stable the position of the gas-liquid interface L, regardless of the ambient changes, during the gas-liquid exchange, is that the fiber strands in the region immediately above the joint as a connective path portion (connective opening 18 in this embodiment), preferably inclusive of the adjacencies of the region immediately above the joint, are extended in the more or less horizontal direction (inclusive of the direction perpendicular to the plane of the surface of FIG. 18). From a different viewpoint, all that is necessary is that the above described region is between the ink delivery opening 12 and the top end portion of the connective opening 18. From another viewpoint, all that is necessary is that the position of this region is above the gas-liquid interface L while gas-liquid exchange is occurring. To analyze the latter viewpoint with reference to the functionality of this region in which the fiber strands possess the above described directionality, this region contributes to keeping horizontal the gas-liquid interface L in the capillary force generating member 13, and is provided with such a function that regulates the change in the movement of the gas-liquid interface L in the vertical direction in the capillary force generating member 13, which occurs in response to the liquid movement from the liquid supply container 30.

The provision of the above described region or layer in the capillary force generating member 13 makes it possible to reduce the deviation of the gas-liquid interface L in terms of the gravity direction. Further, it is desired that the fiber strands in the aforementioned region or layer be arranged so that they appear to extend in parallel in the aforementioned primary direction even at a horizontal sectional plane, because such an arrangement enhances the effect of the directional arrangement of the fiber strands in the more or less parallel manner in their longitudinal direction.

Regarding the direction in which the fiber strands are extended, theoretically, as long as the general direction in which the fiber strands are extended is angled, even slightly, relative to the vertical direction, the above described effect can be provided, although the amount of effect may be small if the angle is small. In practical terms, as long as the above described angle was in a range of ±30 deg. relative to the horizontal direction, the effect was clearly confirmed. Thus, the term "more or less" in the phrase "more or less horizontal" in this specification includes the above range.

In this embodiment, the fiber strands are extended more or less in parallel in the primary direction, also in the region below the top end of the connective opening 18, preventing therefore the gas-liquid interface L from unpredictably deviating in the region below the top end of the connective opening 18. Therefore, it does not occur that the ink jet head cartridge fails to be supplied with a proper amount of ink due to the interruption of ink delivery.

In addition, in this embodiment, the longitudinal direction at a cross section of the capillary force generating member 13, parallel to a horizontal plane, coincides with the line connecting the connective opening 18 and ink delivery opening 12. Therefore, even when ink is drawn out through the ink delivery opening 12 at a high rate, ink can be reliably supplied, without interruption, because ink can flow more easily in the longitudinal direction of fiber strands.

(Embodiment 3)

Figure 19:
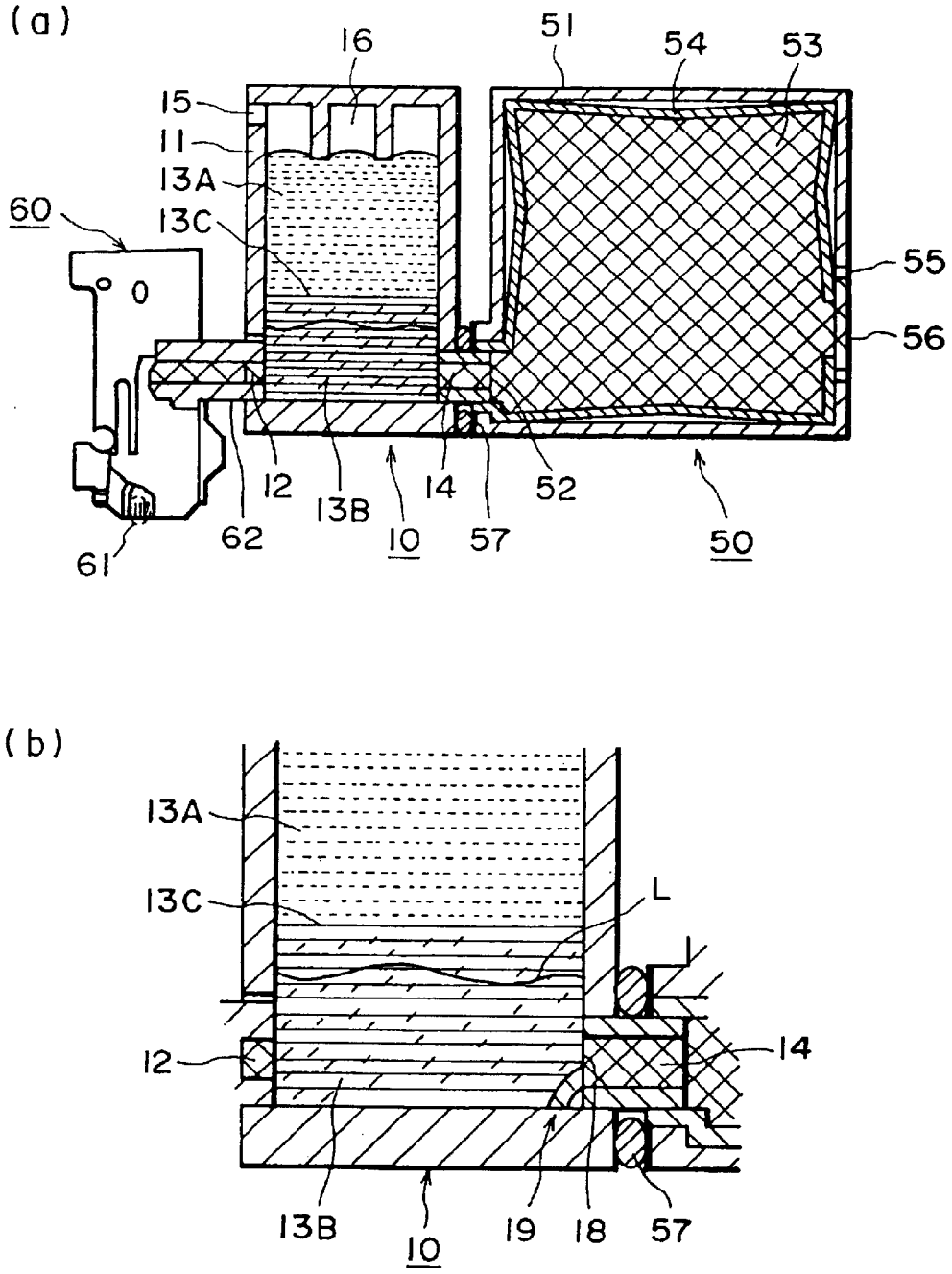
FIG. 19 is a schematic drawing of the liquid supplying system in the third embodiment of the present invention, wherein (*a*) shows the general structure, and (*b*) shows the structure of the adjacencies of the joint portion between the capillary force generating member storage container 10 and liquid supply container 30.

FIG. 19 is a schematic sectional drawing for depicting the ink container in the third embodiment of the present invention, compatible with an exchangeable liquid supplying system in accordance with the present invention. FIG. 3, (*a*) is a schematic sectional view of the liquid supplying system in the third embodiment of the present invention, and FIG. 3, (*b*) is a schematic sectional view of the essential portion of the modified version. The embodiment also presents a liquid supplying system for accomplishing the aforementioned second object as does the above described second embodiment.

Compared to the above described second embodiment, this embodiment is different in that the liquid supplying container is modified. Referring to FIG. 19, a liquid supply container 50 comprises a shell (external shell) 51 which constitutes a container, and an ink storage portion 53, which comprises a shell 54 (internal shell) identical, or similar, in internal shape to the external shell 51, and which stores ink in the internal shell 54, and an ink delivery opening 52, which is connected to the gas-liquid exchange path 14 of the capillary force generating member storage container 10 to allow the liquid in the liquid storage portion 53 to be drawn out into the capillary force generating member storage container 10. In this embodiment, a sealing member 57, for example, an O-ring, is provided at the joint portion between the ink delivery opening 52 and gas-liquid exchange path 14, preventing ink leakage from the joint portion and introduction of the atmospheric air through the joint. The internal shell 54 is given flexibility, being enabled to deform as the ink stored therein is drawn out. Also, the internal shell 54 has a welding seam (pinch-off portion) 56. The internal shell 54 is joined with the external shell 51 at this welding seam, being thereby supported by the external shell 51. The external shell 51 is provided with an air vent 55, through which the atmospheric air can be introduced into the space between the internal and external shells 54 and 51.

Regarding the capillary force generating member storage container 10, the capillary force generating member 13 comprises a first capillary force generating member 13A which faces the air vent 55, and a second capillary force generating member 13B, which is disposed tightly in contact with the first capillary force generating member 13A, and in which the fiber strands are arranged in the same manner as those in the second embodiment. The interface 13C between the two members 13A and 13B is positioned so that when the attitude to be assumed in usage is assumed, the interface 13C will be above the top end of the connective opening 18 as the connective path.

By dividing the capillary force generating member 13 into a plurality of pieces, and positioning the interface between the divided pieces so that the interface will be positioned above the top nd of the connective opening 18 when the ink jet head cartridge is disposed in the attitude in which it is used, it becomes possible to consume the ink within the second capillary generating member 13 or the bottom piece, after the ink within the first capillary force generating member 13A, or the top piece, is consumed, if ink is present in both the capillary force generating members 13A and 13B. Further, when the position of the gas-liquid interface L changes due to the ambient changes, ink seeps into the first capillary force generating member 13A after filling up, first, the second capillary force generating member and the adjacencies of the interface 13C between the first and second capillary force generating members 13A and 13B. Therefore, it is assured by this division as well as by the directionality or the fiber strands in the second capillary force generating member 13B that a buffering zone, in addition to the buffering space 16 in the capillary force generating member storage container 10, is provided. Further, making the strength of the capillary force of the capillary force generating member 13B higher compared to that of the first capillary force generating member 13A assures that the ink in the capillary force generating member 13A is consumed when the ink jet head cartridge is operating.

Further, in this embodiment, the first capillary force generating member 13A remains pressed toward the second capillary force generating member 13B, forming the interface 13C. The compression ratios of the first and second capillary force generating members 13A and 13B are higher adjacent to the interface 13C than those in the other portions, and therefore, the capillary force is greater adjacent to the interface 13C than that in the other portions. More specifically, representing the capillary force of the first capillary force generating member 13A, the capillary force of the second capillary force generating member 13B, and the capillary force of the area (border layer) adjacent to the interface 13C between the first and second capillary force generating members 13A and 13B, with P1, P2 and PS, correspondingly, their relationship is: $P2<P1<PS$. Providing the area with such strong capillary force assures that the strength of the capillary force in the area adjacent to the interface 13C exceeds the strength necessary to meet the above described requirement, even if the ranges of the strengths of the P1 and P2, which are set in consideration of the unevenness of density, overlap with each other because of the unevenness of the capillary force generating members 13A an 13B in terms of their density, or compression. Therefore, it is assured that the above described effects will be provided.

Accordingly, next, the method for forming the interface 13C, in this embodiment, will be described. In this embodiment, olefinic fiber (6 denier) with a capillary force of P1 (P1=−80 mmAq) is used as the material for the first capillary force generating member 13A. Its hardness is 1.88 kgf/mm. The method for measuring its hardness is such that, first, the repulsive force generated as a pushing rod with a diameter of 15 mm, is pushed against the capillary force generating member placed in the capillary force generating member storage chamber., is measured, and then, the hardness is obtained from the inclination of the measured amount of the repulsive force relative to the distance the pushing rod was inserted. On the other hand, the same material as that for the first capillary force generating member 13A, that is, olefinic fiber, is used as the material for the second capillary force generating member 13B. However, compared to the first capillary force generating member 13A, the second capillary force generating member 13B is made stronger in capillary force P2 (P2=−110 mmAq), and is made smaller in the fiber diameter (2 denier), making it lower in rigidity (0.69 kgf/mm).

Making a capillary force generating member which is weaker in capillary force than another capillary force generating member which is higher in capillary force than the first capillary force generating member, placing them in combination, and in contact, with each other, and keeping them pressed against each other, causes the first capillary force generating member 13A to be kept more compressed than the second capillary force generating member 13B, adjacent to the interface 13C between the two capillary force generating members. Therefore, the relationship in capillary force (P1<P2<PS) is established, and also it is assured that the difference between the P1 and PS remains always greater than the difference between the P1 and P2. Regarding the capillary force generating member, a space 19 may be formed as the capillary force generating member partially separates at the bottom end of the portion facing the connective tube as shown in FIG. 19, (*b*).

In this embodiment, even if the capillary force generating member 13 occupies only a small space, the configuration of the capillary force generating member 13 and the configuration of the capillary force generating member storage chamber 10 provide synergistic effects to compensate for the ambience changes, as in the first embodiment.

(Embodiment 4)

Figure 20:
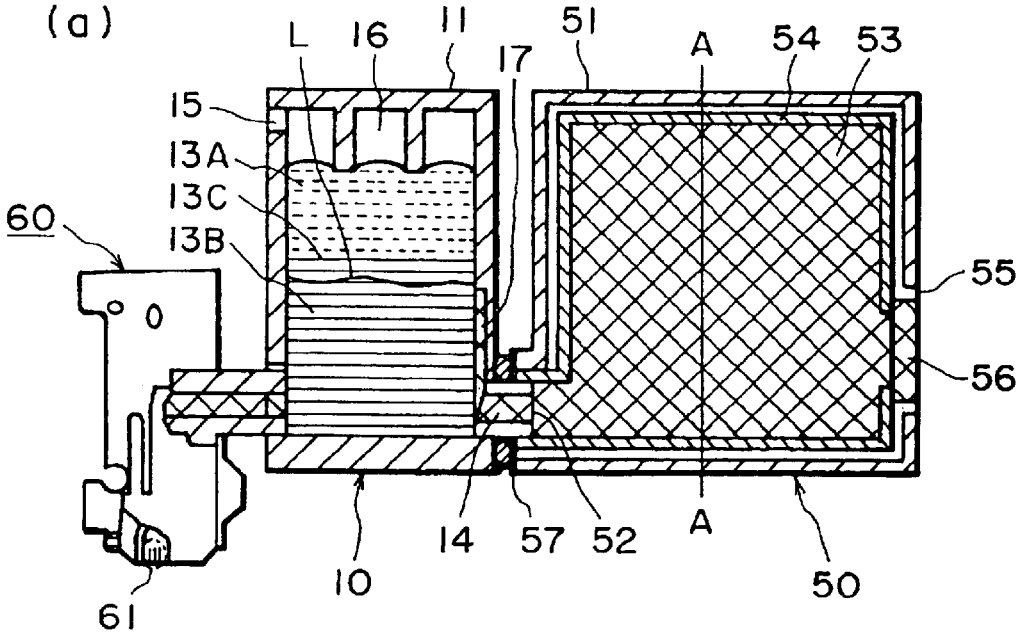
FIG. 20 is a schematic drawing of the liquid supplying system in the fourth embodiment of the present invention.
Figure 20:
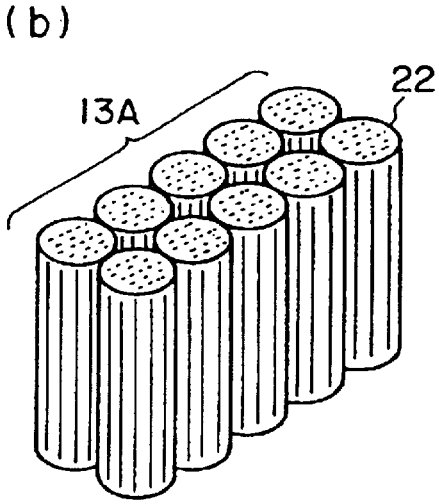
Figure 20:
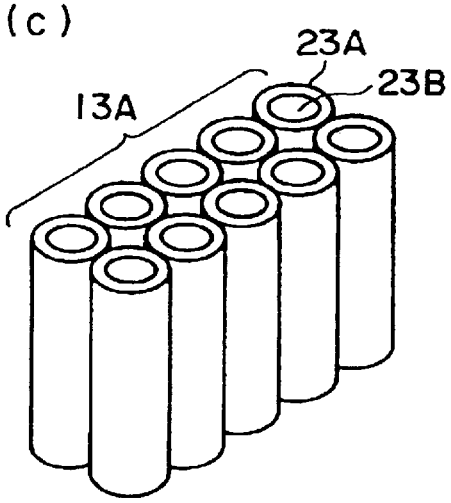

FIG. 20 is a schematic sectional drawing for depicting the ink container in the fourth embodiment of the present invention, compatible with an exchangeable liquid supplying system in accordance with the present invention. Also in this embodiment, a liquid supplying system for accomplishing the second object is presented as in the second and third embodiments.

This embodiment is different from the above described third embodiment in that an air introduction groove 17 for enhancing gas-liquid exchange is provided.

The capillary force generating member storage container 10 in this embodiment is provided with the air introduction groove 17 for enhancing gas-liquid exchange. The gas-liquid exchange path 14 is disposed in contact with the capillary force generating member 13, and is connected to the air introduction groove 17 at one end, so that the liquid supplying operation ensues smoothly.

In this embodiment, the fiber strand layers, correspondent to those in each of the preceding embodiments, are located in the region adjacent to the top end of the air introduction groove 14, that is, where the gas-liquid interface is formed during the gas-liquid exchange. The provision of an air introduction groove such as the air introduction groove 14 is effective not only to stabilize the position of the gas-liquid interface L during the gas-liquid exchange, but also to assure that the fiber strand layers located in the region adjacent to the top end of the air introduction groove function properly.

Although a plurality of capillary force generating members 13 were employed in the above described third and fourth embodiment, the capillary force generating member 13A positioned on the top side may be an assembly of a plurality of cylindrical bundles 22 of fiber strands, as shown in FIG. 20, (*b*), or an assembly of a plurality of tubular members 23A with a hole 23B, as shown in FIG. 20, (*c*).

(Embodiment 5)

Figure 21:
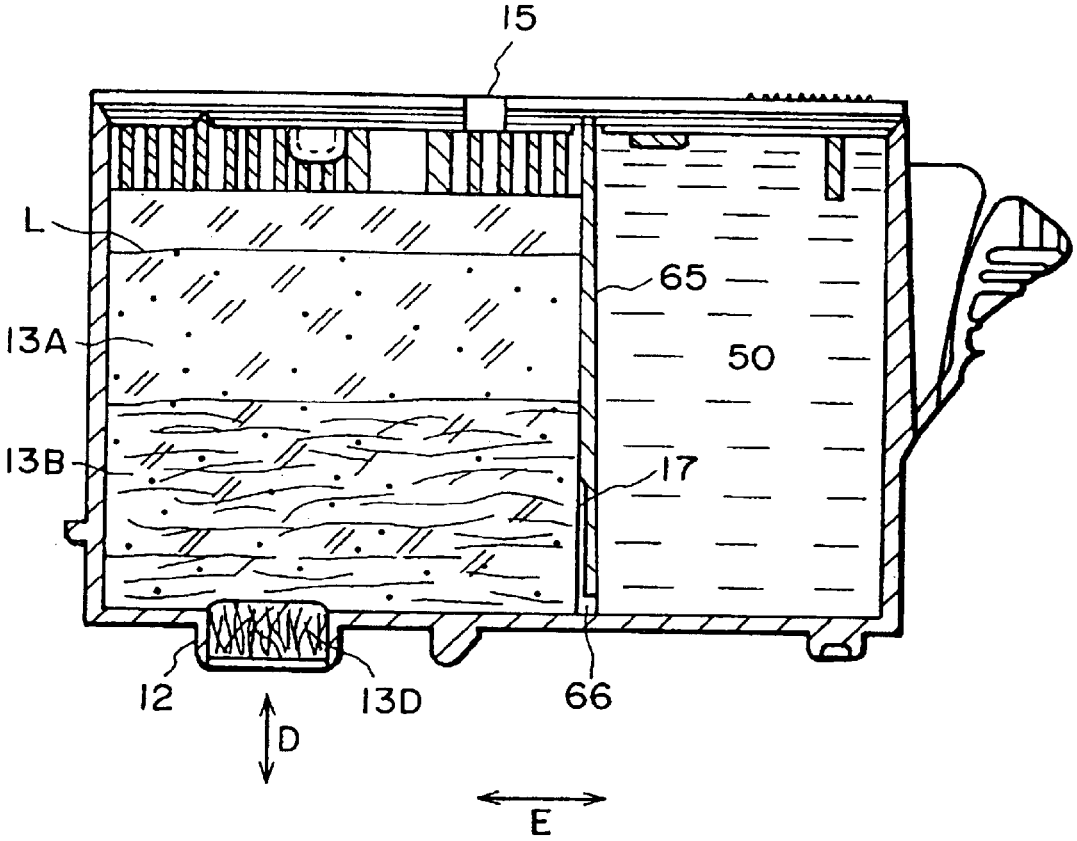
FIG. 21 is a schematic drawing for depicting the structure of the liquid supplying system in the fifth embodiment of the present invention.

FIG. 21 is a schematic sectional view of the ink container in the fifth embodiment of the present invention. In FIG. 21, the portions identical to those in the first to fourth embodiments are given an identical referential code to omit their descriptions. This embodiment presents a liquid supplying system for accomplishing the aforementioned second object as do the first to fourth embodiments.

In this embodiment, the capillary force generating member storage container 10 and liquid supply container 50 in the second to fourth embodiments are formed as a single component. More specifically, the capillary force generating member storage container 10 and liquid supply container 50 are different portions of a single component, being separated by a partition wall 65 disposed in a single shell. Ink is supplied from the liquid supply container 50 to the capillary force generating member storage container 10 through a path 66.

With this structural arrangement, the gas-liquid exchange path 14, which was present in the first embodiment, is not present between the liquid supply container 50 and capillary force generating member storage container 10. Therefore, there is no possibility that the air path which developed at the gas-liquid exchange path 14 due to the ambient changes will develop. Therefore, it is possible to stabilize the gas-liquid exchange.

In the capillary force generating member storage container 10 in this embodiment, an atmospheric air introduction groove 17 for enhancing gas-liquid exchange is provided. One end of the path 66 is in contact with the capillary force generating member 13, and the other end is connected to the atmospheric air introduction groove 17, allowing the liquid supplying operation to ensure smoothly.

Further, the position where the gas-liquid interface L is formed during the gas-liquid exchange is located in the region adjacent to the top end of the atmospheric air introduction groove. The provision of an air introduction groove such as the one described above is effective not only to stabilize the position of the gas-liquid interface L during the gas-liquid exchange, but also to assure that the fiber strand layers located in the region adjacent to the top end of the air introduction groove function properly.

(Embodiment 6)

Figure 22:
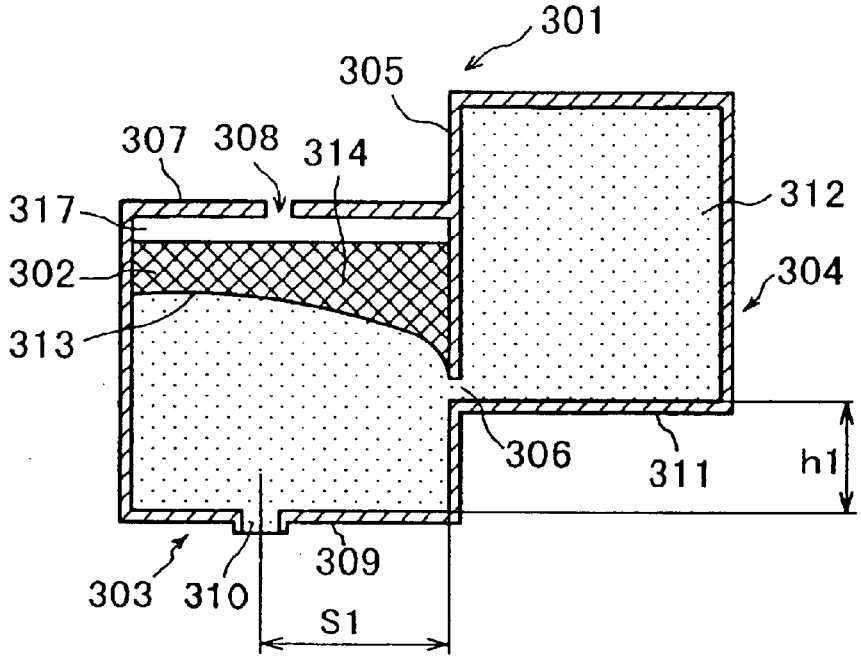
FIG. 22 is a schematic sectional view of the ink container in the sixth embodiment of the present invention, at a plane parallel to the lateral walls of the ink container.
Figure 23:
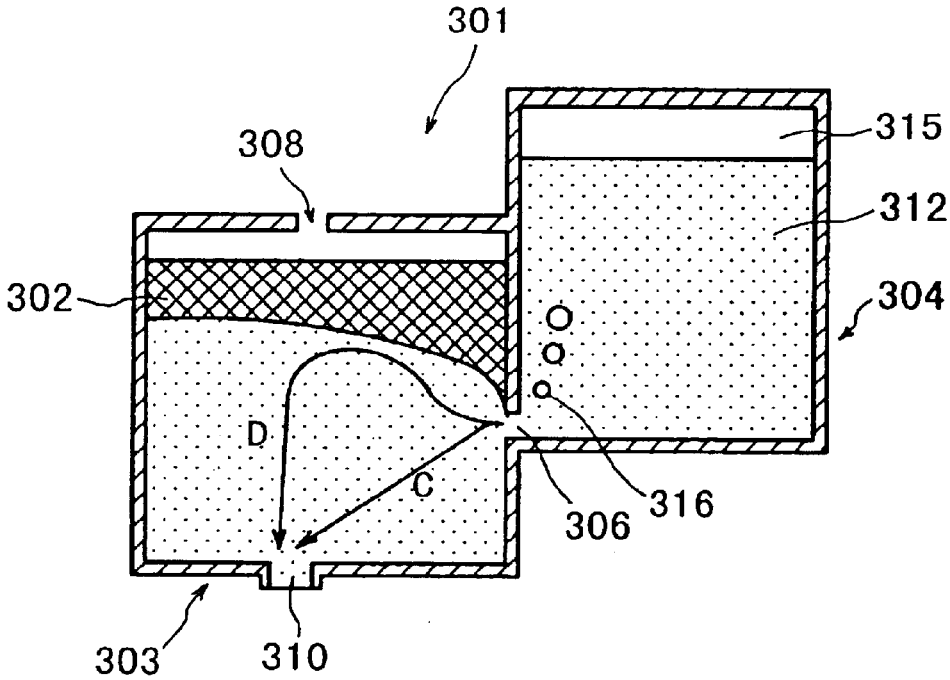
FIG. 23 is a drawing for describing the process in which ink is supplied to the ink storage chamber to the ink delivery opening, and which is accompanied by the gas-liquid exchange process in the ink container illustrated in FIG. 21.

FIG. 22 is a schematic sectional view of the ink container 301 in the sixth embodiment of the present invention, at a plane parallel to the sidewalls of the container. FIG. 23 is a drawing for depicting the ink delivery from an ink storage chamber 304 to an ink delivery opening 310, which involves the gas-liquid exchange in the ink container in this embodiment. This embodiment presents a liquid supplying system for accomplishing the aforementioned third object of the present invention. FIG. 22 shows the state in which ink 312 has permeated into an absorbent material piece 302 in a negative pressure controlling chamber 303, up to the position of an interface 313.

The ink container 301 is provided with the negative pressure controlling chamber 303 which stores the absorbent material piece 302 for generating negative pressure, and an ink storage chamber 304 for containing ink. The two chambers are different parts of a single component, being arranged so that the ink storage chamber 304 is positioned higher than the negative pressure controlling chamber 303, with an offset of h1.

A path 306 is formed in the partition wall 305; more specifically, it is formed between the partition wall 305 and the second bottom wall 311. In other words, the second bottom wall 311 is positioned higher than the first bottom wall 309 by the height of h1. Thus, the height h1 equals the distance from the inward side of the supply delivery opening 310 of the negative pressure controlling chamber 303 to the second bottom wall side of the path 306. A horizontal distance from the negative pressure controlling chamber side of the path 306 to the center of the supply delivery opening 310 is represented by S1.

The ink storage chamber 304 is virtually sealed, except for the presence of the path 306.

The top wall 307 of the negative pressure controlling chamber 303 is provided with an air vent 308 which connects to the atmospheric air. The first bottom wall 309 is provided with the supply delivery opening 310 for supplying ink to an unillustrated recording head which comprises energy generating elements for applying energy to ink, and ejection orifices from which ink is ejected. The portion of the absorbent material piece 302 above an interface 313, into which ink has not permeated, constitutes a buffer portion 314. This buffer portion 314 is a region which absorbs and retains the ink 312 forced out of the ink storage chamber 304 by the expansion of the air 315 introduced into the virtually sealed ink storage chamber through the gas-liquid exchange, which will be described later, to prevent ink from leaking from the recording head, in cooperation with the buffering space formed between the top wall 307 and the top surface of the absorbent material piece 302.

Next, referring to FIG. 23, the ink delivery from the ink storage chamber 304 to the delivery opening 310, which involves the gas-liquid exchange within the ink container 301 in this embodiment will be described.

As the recording on recording medium is started by an ink jet recording apparatus, which will be described later, as ink is ejected from the ejection orifices of the recording head, suction, which draws the ink 312 within the ink container 301, is generated. The ink 312 within the ink storage chamber 304 flows into the absorbent material piece 302 within the negative pressure controlling chamber 303 through the path 306 due to the presence of this suction. Then, the ink flows into the supply delivery opening 310 through the absorbent material piece 302, being thereby supplied to the recording head. With this ink movement, the internal pressure of the ink storage chamber 303, virtually sealed except for the presence of the path 306, reduces, creating a pressure difference between the ink storage chamber 304 and negative pressure controlling chamber 303. As the recording continues, the pressure difference continues to increase. However, the negative pressure controlling chamber 303 is open to the atmosphere through the air vent 308 formed in the top wall 307. Therefore, air passes through the absorbent material piece 302, and enters the ink storage chamber 304 through the path 306, creating air bubbles 316 illustrated in FIG. 23. At this point in time, the pressure difference between the ink storage chamber 304 and negative pressure controlling chamber 303 is eliminated. As long as the recording lasts, the above described process is repeated. Further, through this process, the volume of the ink 312 in the ink storage chamber 304 will reduce while the volume of the air 315 in the ink storage chamber will increase.

The ink 312 in the absorbent material piece 302 flows from the path 306 to the deliver opening 310 through a route C, the shortest path, which forms a straight line from the path 306 to the delivery opening 310, or a route D, which is longer than the route C, and forms a curved line from the path 306, to the delivery opening 310, through the region adjacent to the interface 313 of the ink 312 formed within the absorbent material piece 310.

The ink 312 is supplied to the recording head as described above. Regarding the ink route from the connective path portion 306 to the delivery opening 310, since the position of the connective path portion 306 is the height of h1 above that of the delivery opening 310, the difference in distance between route C, that is, the shortest route, and route D which is longer than route C, is smaller than the difference in distance between route A, that is, is the shortest route, and route B, which is longer than route A, in the conventional ink container illustrated in FIG. 1. Therefore, in comparison to the conventional ink container, the ink container 302 in this embodiment is smaller in terms of the fluctuation of the effects caused by the absorbent material piece 302 due to the change in the ink ingredients resulting from such phenomena as the absorption effected by filter trap, the absorption effected by the reaction among the ink ingredients, and the like.

Thus, it becomes possible to reduce the effects of the change in ink ingredients caused by the absorbent material piece 322, for example, the unevenness of color tone within the same image, bleeding, and the change in the adherence to recording paper as the recording medium. Therefore, it is possible to form images with stable quality.

In particular, if some of the components which constitute the ink to be stored are in the form of insoluble microscopic particles such as pigment (used as coloring agent in ink), these microscopic components sometimes begin to agglutinate or settle. In such a case, the ink becomes uneven in terms of coloring material density, raising the possibility that print quality will be reduced, and that pigments will precipitate at the ejection orifice portions, preventing the ink from being properly ejected.

As an ink container which directly holds ink is mounted in a recording apparatus, which will be described later, the ink in the ink storage container is stirred by the oscillating movement of the container resulting from the movement of the carriage during printing. Therefore, the coloring agents in the ink are dispersed again; in other words, the above described problems are solved. On the other hand, in the case of an ink container, which contains a piece of absorbent material as a capillary force generating member, and holds ink within this absorbent material piece, it is not likely that the ink will be stirred by the carriage movement, and therefore, the above described re-dispersion is not likely to occur.

However, the difference in the length of the ink flow route (D−C) can be reduced by making a positional arrangement such as the one in this embodiment, for an ink container of a type which comprises a capillary force generating member storage chamber, and an ink storage chamber disposed in contact with the capillary force generating member storage chamber as in this embodiment. In addition, regarding the ink delivery through the gas-liquid exchange, a body of ink with a proper coloring agent density flows from the ink storage chamber 304 into the negative pressure controlling chamber 303 in which the coloring agent density of the ink held therein is relatively uneven, and reduces the unevenness of the density. As a result, the ink to be delivered from the delivery opening 310 is more stabilized in coloring agent density.

(Embodiment 7)

Figure 24:
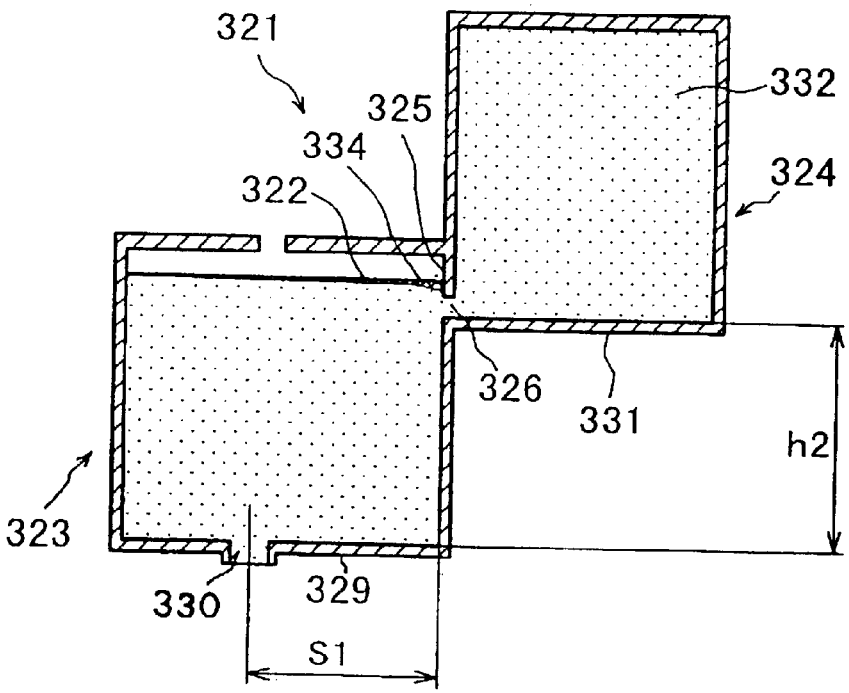
FIG. 24 is a schematic sectional view of the ink container in the seventh embodiment of the present invention, at a plane parallel to the sidewalls of the ink container.

Next, FIG. 24 presents a schematic sectional view of an ink container 321, which is the seventh embodiment of the present invention, at a plane parallel to the sidewalls of the container. The embodiment also presents a liquid supplying system for accomplishing the third object of the present invention as does the above described sixth embodiment.

The ink container 321 is basically the same in structure as the ink container 301 in the sixth embodiment, except that the height from the delivery opening 330 formed in the first bottom wall 329 of the negative pressure controlling chamber 323, to the connective path portion 326 formed between the partition wall 325 and the second bottom wall 331 of the ink storage chamber 324, is changed to a height of h2, which is greater than the height h1 in the sixth embodiment. Therefore, the detailed description of this container 321 will be omitted. Also, the ink container 321 is the same in gas-liquid exchange as the ink container 301 in the sixth embodiment, and therefore, its description will be also omitted.

The height h2 from the delivery opening 330 to the connective path portion 326 stands for the height limit for assuring that the size of the buffer portion 334 in the absorbent material piece 322 is minimized.

Figure 25:
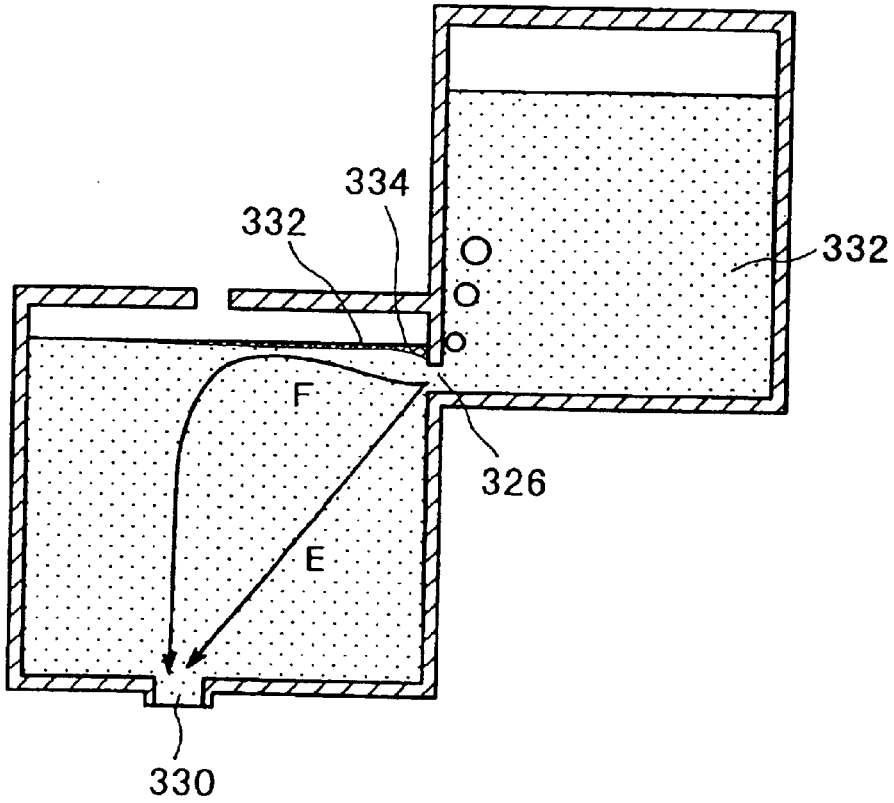
FIG. 25 is a drawing for describing the process in which ink is supplied to the ink storage chamber to the ink delivery opening, and which is accompanied by the gas-liquid exchange process in the ink container illustrated in FIG. 24.

FIG. 25 is a drawing which shows the route of the ink 332 from the connective path portion 326 to the delivery opening 330 through the absorbent material piece 322, while gas-liquid exchange is occurring in the ink container 321 in this embodiment.

Giving the height between the delivery opening 330 to the connective path portion 326 a value of h2 makes it possible to further reduce the difference in length between a route E, which constitutes the shortest route, and a route F which is longer than the route E. Therefore, it is possible to reduce the fluctuation in the magnitude of the effect of the ink absorbent material piece 322 to which the ink 332 is subjected, which occurs in response to the change in the route by which the ink 332 flows through the absorbent material piece 322.

As described above, the usage of the ink supplied from the ink container 321 in this embodiment makes it possible to reduce the effects of the change in ink ingredients caused by the absorbent material piece 322, for example, the unevenness of color tone within the same image, bleeding, and the change in the adherence to recording paper as the recording medium. Therefore, it is possible to form images with stable quality, as it is in the first and sixth embodiments.

(Embodiment 8)

Figure 26:
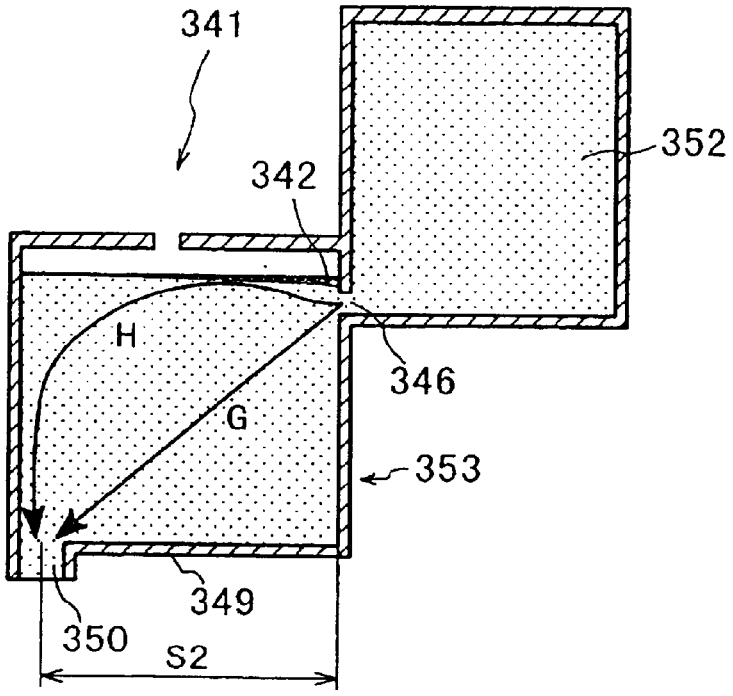
FIG. 26 is a schematic sectional view of the ink container in the eighth embodiment of the present invention, at a plane parallel to the sidewalls of the container.

Next, FIG. 26 is a schematic sectional view of an ink container 341, which is the eighth embodiment of the present invention, at a plane parallel to the sidewalls of the container. This embodiment also presents a liquid supplying system for accomplishing the aforementioned third object as to the sixth and seventh embodiments.

The ink container 341 is structured so that a distance S2 from the negative pressure controlling chamber side of a connective path portion 346 to the center of a delivery opening 350 becomes longer than a distance S1 from the negative pressure controlling chamber side of a connective path portion 326 to the center of a delivery opening 330, in the ink container 321 in the seventh embodiment. In other words, the ink container 341 in this embodiment is structured so that when the delivery opening 350 is formed in the bottom wall 349 of a negative pressure controlling chamber 353, the distance in a straight line between the connective path portion 346 and the delivery opening 350 becomes the longest. Except for the above described structural arrangement, the ink container 341 is the same as the ink container 321 in the seventh embodiment, and therefore, its detailed description will be omitted.

By making the distance between the connective path portion 346 to the delivery opening 350 the distance S2, it is possible to further reduce the difference in length between a route G, which is the shortest route, and a route H which is longer than the route G. Thus, it is possible to reduce the fluctuation in the difference in the effect of the absorbent material piece 342 to which the ink 352 is subjected, which occurs as the ink route through the absorbent material piece 342 changes.

As described above the usage of the ink supplied from the ink container 341 in this embodiment makes it possible to reduce the effects of the change in ink ingredients caused by the absorbent material piece 342, for example, the unevenness of color tone within the same image, bleeding, and the change in the adherence to recording paper as the recording medium. Therefore, it is possible to form images with stable quality, as it is in the seventh and eighth embodiments.

(Embodiment 9)

Figure 27:
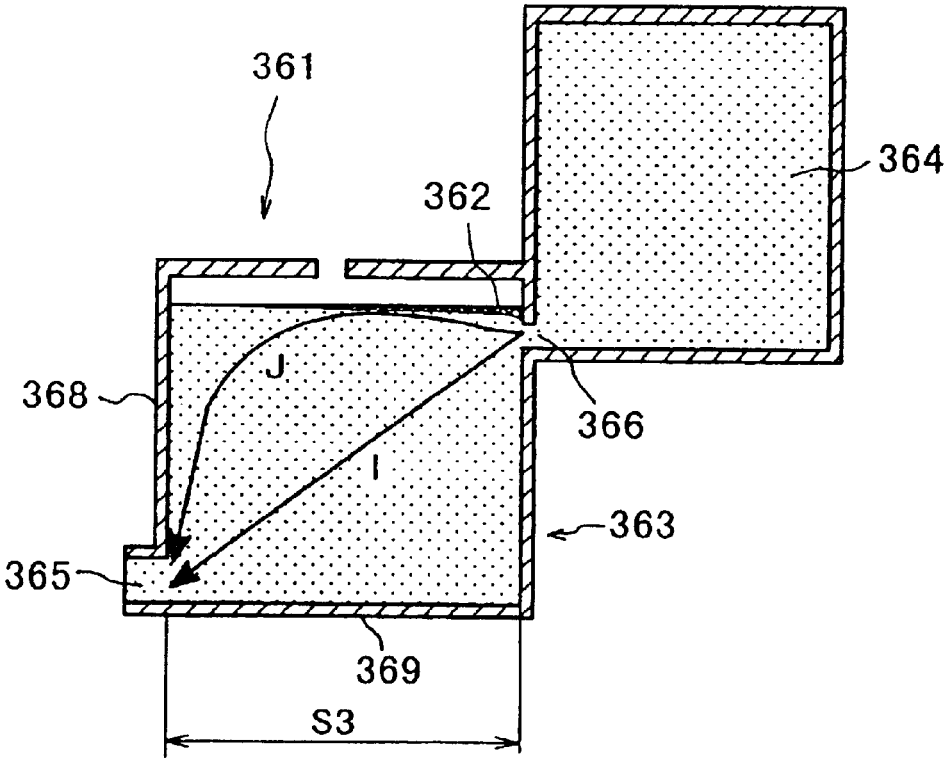
FIG. 27 is a schematic sectional view of the ink contained in the ninth embodiment of the present invention, at a plane parallel to the sidewalls of the container.

Next, FIG. 27 presents a schematic sectional view of an ink container 361, which is the ninth embodiment of the present invention, at a plane parallel to the sidewalls of the container. This embodiment also presents a liquid supplying system for accomplishing the third object as to the sixth to eighth embodiments.

In the ink container 361, a delivery opening 350 is formed in the sidewall 368, instead of the bottom wall 369, of a negative pressure controlling chamber 363. Otherwise, the ink container 361 is basically the same as the ink containers 321 and 341 in the seventh and eighth embodiments, respectively. Therefore, its detailed description will be omitted.

The ink container 361 in this embodiment is structured so that when the delivery opening 365 is formed in the sidewall 368 of the negative pressure controlling chamber 363, the distance in a straight line between a connective path portion 366 and the delivery opening 365 becomes the longest. The distance from the negative pressure controlling chamber side of the connective path portion 366 to the negative pressure controlling chamber side of the delivery opening 365 is a distance S3, which is rendered slightly longer than the distance S2 in the eighth embodiment illustrated in FIG. 26.

With the provision of the above described structural arrangement, it is possible to further reduce the difference in length between a route 1, which is the shortest route for the ink 364 to flow through the absorbent material piece 362, and a route J which is longer than the route 1. Thus, it is possible to reduce the fluctuation in the difference in the effect of the absorbent material piece 362 to which the ink 364 is subjected, which occurs as the ink route through the absorbent material piece 362 changes.

As described above, the usage of the ink supplied from the ink container 361 in this embodiment makes it possible to reduce the effects of the change in ink ingredients caused by the absorbent material piece 362, for example, the unevenness of color tone within the same image, bleeding, and the change in the adherence to recording paper as the recording medium. Therefore, it is possible to form images with stable quality, as it is in the sixth to eighth embodiments.

(Embodiment 10)

Figure 28:
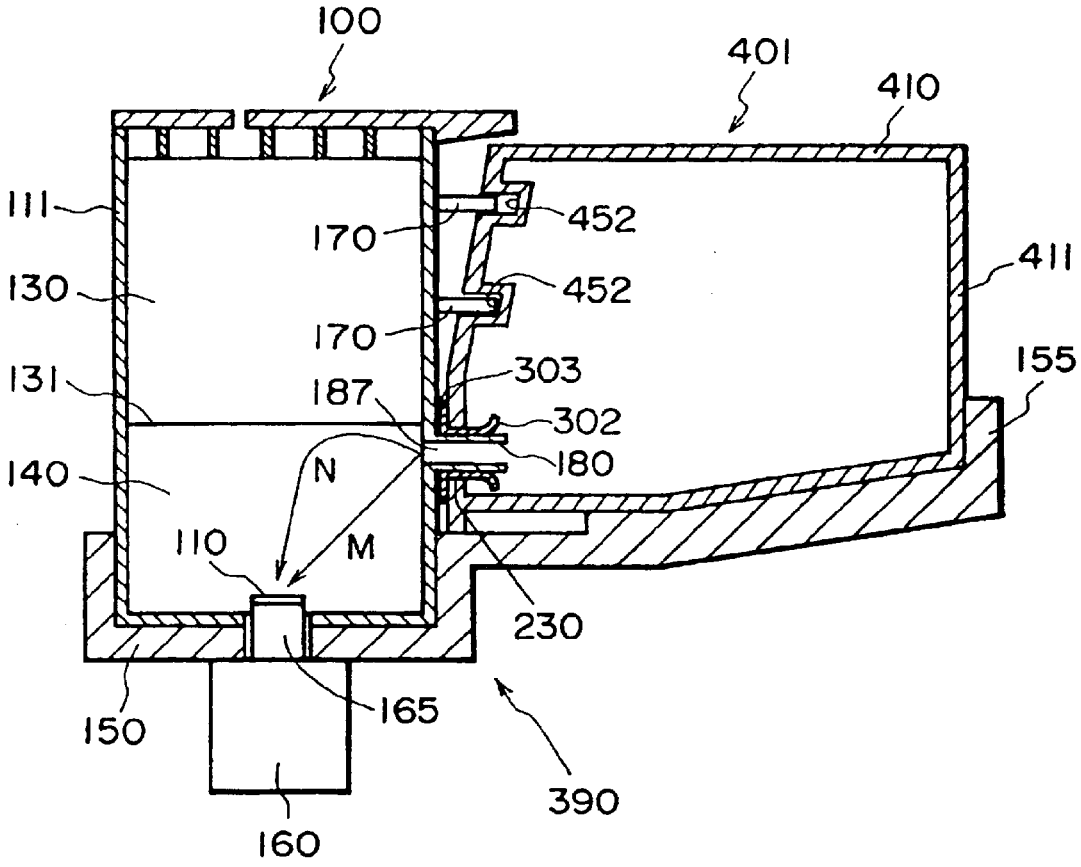
FIG. 28 is a sectional view of the ink jet head cartridge in the tenth embodiment of the present invention.

Next, FIG. 28 is a schematic sectional view of the ink jet head cartridge 390, which is the tenth embodiment of the present invention. FIG. 28 shows the state in which a removably installable ink storage container 401 is held by a holder which comprises the negative pressure controlling chamber unit 100.

The ink storage container 401 is provided with two ID member slots 452, which are located at different positions correspondent to the positions of the two ID members with which the negative pressure controlling chamber unit 100 is provided, and the joint opening 230 which engages with the joint pipe 180 of the negative pressure controlling chamber unit 100. It is a single piece shell 410 for containing ink. Prior to its installation into the holder 350, the joint opening 30 of the ink storage container 401 is sealed with a film seal 302, and therefore, the ink storage container 401 remains perfectly airtightly sealed.

In the negative pressure controlling chamber unit 100, the absorbent material pieces 130 and 140 are disposed in layers. The joint pipe of 180 of the negative pressure controlling chamber unit 100 is disposed adjacent to the top end of the absorbent material piece 140, or the bottom side piece; in other words, it is disposed adjacent to the interface 131 between the absorbent material pieces 130 and 140. Further, the joint pipe 180 is not so long as to become a hindrance when the ink container 401 is installed into the holder 150 from the right-hand side and above (top right corner in FIG. 17), but is long enough, in comparison to the thickness, around the joint pipe 180, of the wall of the shell 410 of the ink storage container 401, to assure that the film seal 302, which is sealing the joint opening 230, can be penetrated by the joint pipe 180 so that a path is established between the internal spaces of the ink storage container 401 and negative pressure controlling chamber unit 100. Further, an O-ring 303 is fitted around the base portion of the joint pipe 180. This O-ring 303 generates such force that keeps the bottom portion of the rear wall 411 of the ink storage container 401 pressed against the ink container engagement portion 355 of the holder 150 while and after the ink storage container 401 is connected to the negative pressure controlling chamber unit 100.

The relationship in terms of fit between the internal diameter of the joint opening 230 and the external diameter of the joint pipe 180 is such that the gap between the inward surface of the joint opening 230 and the outward surface of the joint pipe 180 becomes large enough to allow the film seal 302 to be folded inward of the shell 410 of the ink storage container 401, into the gap. Not only does the O-ring generate the above described force, but also prevents the ink held in the ink storage container 401 from leaking out through the gap formed between the inward surface of the joint opening 230 and the outward surface of the joint pipe 180.

The negative pressure controlling chamber unit 100 in this embodiment is the same as the negative pressure controlling chamber unit 100 in the first embodiment, except for the aspects of the joint pipe 180. Therefore, its detailed description will be omitted.

Unlike the ink storage container 201 in the first embodiment, the shell 410 of the ink storage container 401 does not have an internal pouch such as the internal pouch 220 which deforms in response to the negative pressure which occurs in the ink storage container 201. It is formed of such material that barely deforms if the magnitude of the negative pressure which occurs therein is no more than that in the ink storage containers 401 in the sixth to ninth embodiments. Therefore, even though, when the ink in the ink storage container 401 is supplied into the negative pressure controlling chamber unit 100 through the joint pipe 180, gas-liquid exchange occurs in the same manner as the gas liquid exchanges in the sixth to ninth embodiments, the description of the gas-liquid exchange will be omitted because the gas-liquid exchange has been described.

Also in this embodiment, the negative pressure controlling chamber unit 100 is structured so that the joint pipe 180, that is, where the connection is made, is positioned higher than the delivery opening 110, and the interface 131, that is, a discontinuity surface, is formed between the absorbent material pieces 130 and 140, to prevent the ink supplied through the joint pipe 180 from moving upward beyond the interface 131. With this arrangement, it is possible to reduce the difference in length between a route M, which is the shortest ink route from the joint pipe 180 to the delivery opening 110 through the absorbent material piece 140, and an ink route N which is longer than the ink route M. Therefore, it is possible to suppress the fluctuation in the effect of the absorbent material piece 140 to which ink is subjected, which results from the difference in the ink route.

Although the delivery opening 110 is described as a delivery opening provided at approximate center of the bottom wall of the negative pressure controlling chamber container 111, the present invention is not limited by this arrangement; if necessary, the delivery opening may be moved to a location further away from the connective opening 181, for example, at the left end of the bottom wall or in the left sidewall. With such positioning of the delivery opening, the ink jet head unit 160 with which the holder 150 is provided, and the ink delivery tube 160, may also be moved to the positions correspondent to the position of the delivery opening formed at the left end of the bottom wall or in the left sidewall.

As described above, using the ink jet head cartridge 390 in this embodiment makes it possible to suppress the phenomena caused by the change in the ink ingredients effected by the absorbent material piece 140, for example, the unevenness of color tone in the same image, bleeding, and change in the adherence to recording paper, that is, recording medium. Thus, it is possible to form image with stable quality.

(Embodiment 11)

Figure 29:
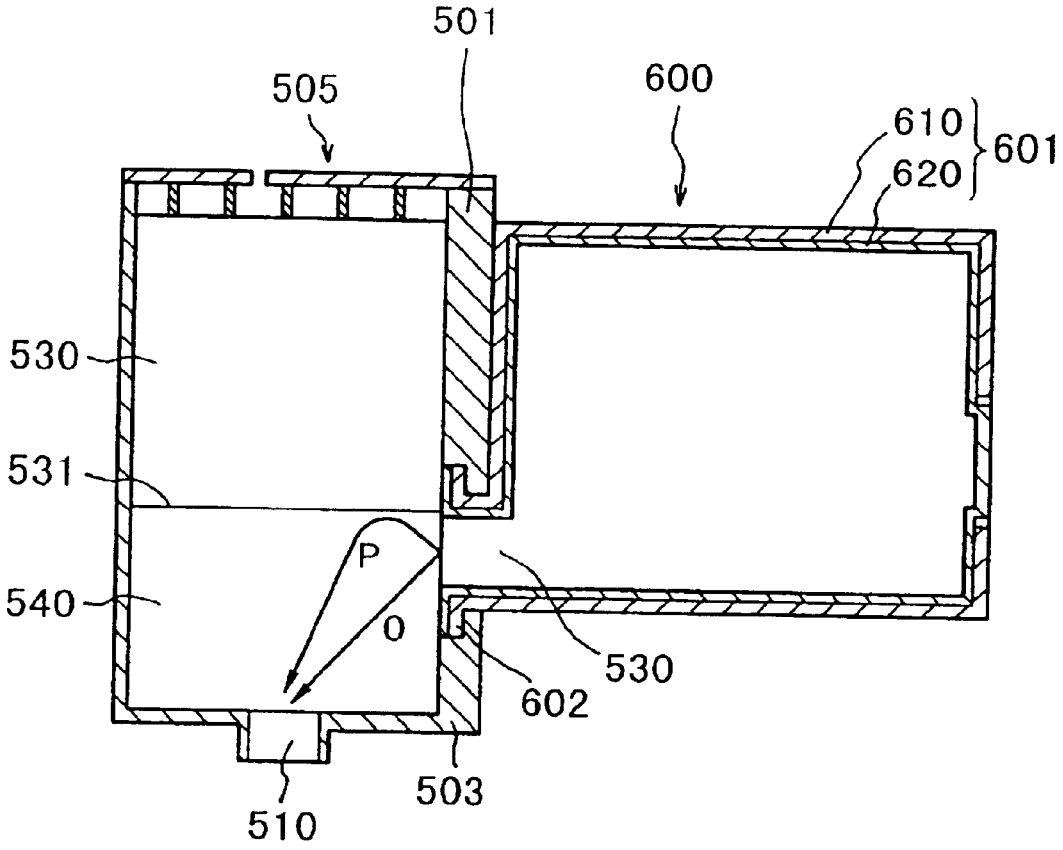
FIG. 29 in a sectional view of the ink container in the eleventh embodiment of the present invention.

Next, FIG. 29 is a schematic sectional view of the ink container 600, which is the eleventh embodiment of the present invention.

The ink container 600 has a negative pressure controlling portion 505 which containers absorbent material pieces 530 and 540, and an ink container storage portion 601 comprising an external shell 610 and an internal pouch 620. In this ink container 600, a second connective path portion 602 with a hole, with which the ink container storage portion 601 is provided, is joined with a first connective path portion 502 with a hole, provided in the connective surface 501 of the negative pressure controlling portion 505, to give the ink container 600 a single piece structure, and the joint portion between the two chambers functions as a connective path portion 530 between the negative pressure controlling portion 505 and ink container storage portion 601.

Figure 1:
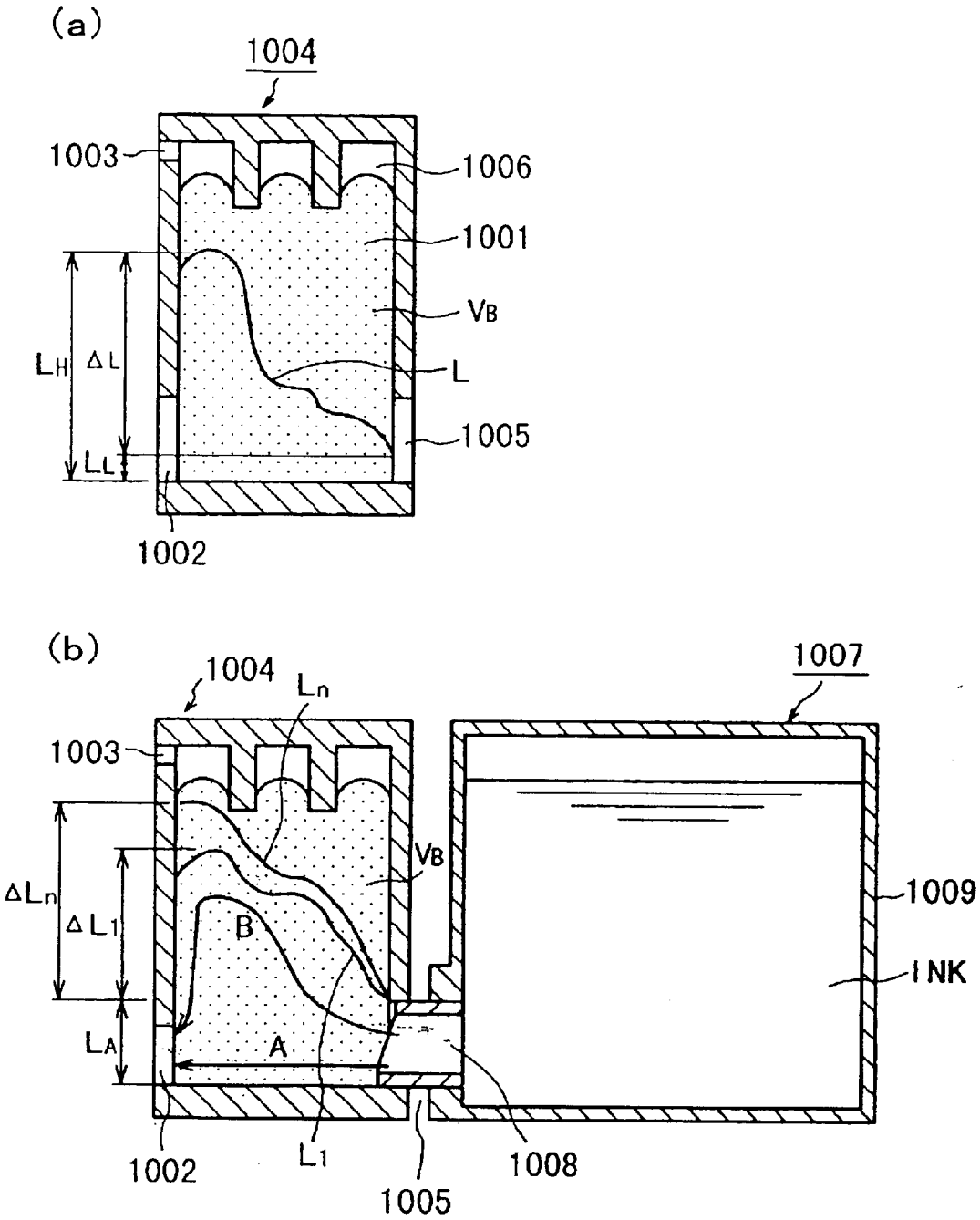
FIG. 1 is a schematic drawing of a conventional liquid supplying system, wherein (*a*) represents the state of the system after the removal of the liquid supply container from the capillary force generating member storage container, and (*b*) represents the state of the system in which the containers are connected to each other.

Except for the above structural arrangement, the basic structures in the ink container 600 are the same as those of the negative pressure controlling chamber unit 100 and ink container unit 200 of the ink jet head cartridge 70 illustrated in FIG. 1, and therefore, their detailed descriptions will be omitted.

Also in this embodiment, the negative pressure controlling portion 505 is structured so that the position of the connective path portion 530 becomes higher than that of the delivery 510, and the interface 531, that is, a discontinuity surface, is formed between the absorbent material pieces 530 and 540, to prevent the ink supplied through the connective path portion 530, from moving upward beyond the interface 531. With this arrangement, it is possible to reduce the difference in length between a route O, which is the shortest ink route from the connective path portion 530 to the delivery opening 510 through the absorbent material piece 540, and an ink route P which is longer than the ink route O. Therefore, it is possible to suppress the fluctuation in the effect of the absorbent material piece 540 to which ink is subjected, Which results from the difference in the ink route.

Although the delivery opening 510 is described as a delivery opening provided at the approximate center of the bottom wall of the negative pressure controlling portion 505, the present invention is not limited by this arrangement; if necessary, the delivery opening may be moved to a location further away from the connective path portion 530, for example, at the left end of the bottom wall or in the left sidewall in FIG. 20.

As described above, using the ink supplied from the ink container 600 in this embodiment makes it possible to suppress the phenomena caused by the change in the ink ingredients effected by the absorbent material piece 540, for example, the unevenness of color tone in the same image, bleeding, and change in the adherence to recording paper, that is, recording medium. Thus, it is possible to form image with stable quality.

(Embodiment 12)

Figure 30:
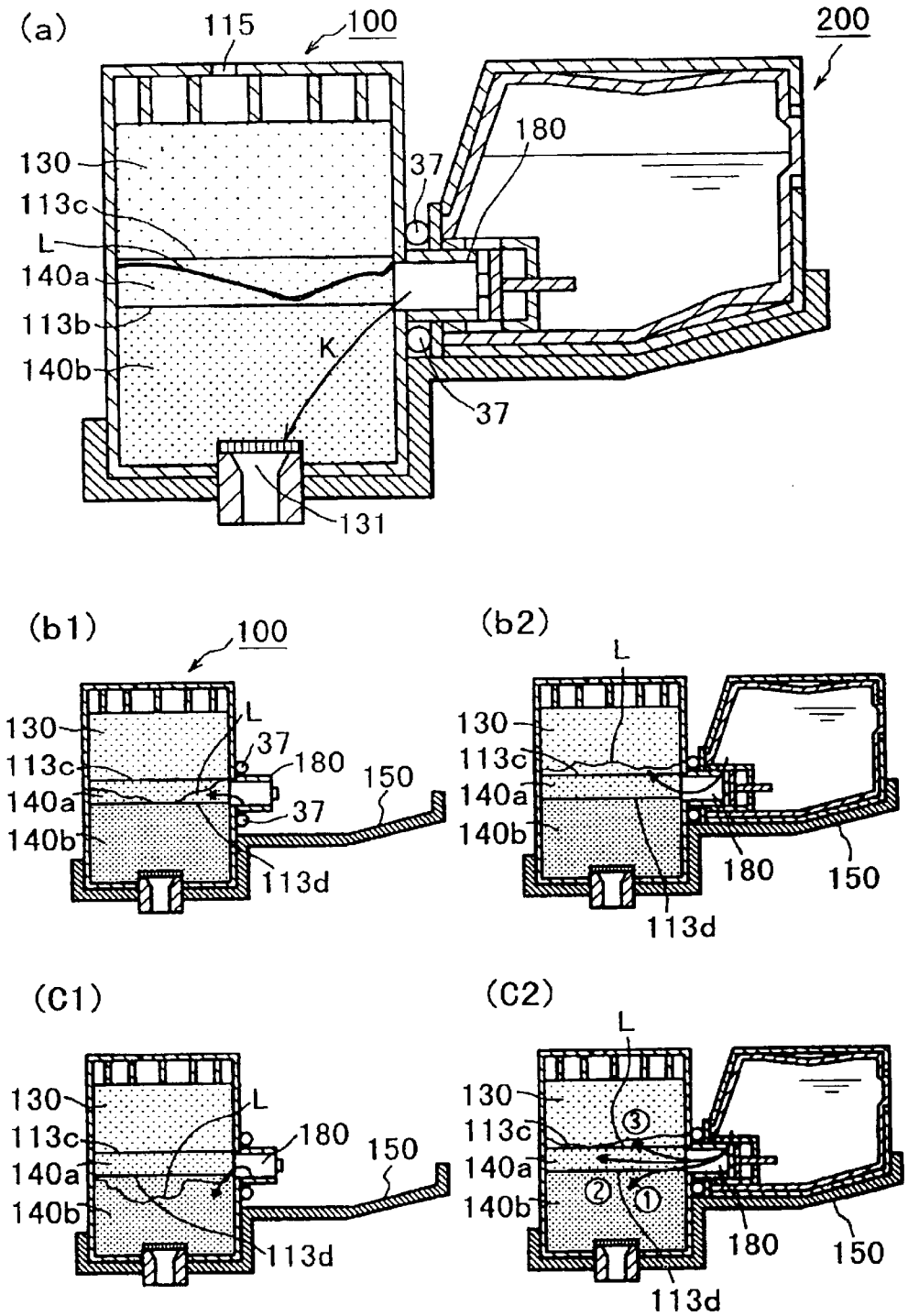
FIG. 30 is a sectional view of the ink container in the twelfth embodiment of the present invention.

FIG. 30, (*a*) is a schematic sectional drawing for describing the twelfth embodiment of the present invention. The twelfth embodiment of the present invention illustrated in FIG. 30, (*a*) is different from the first embodiment of the present invention illustrated in FIG. 2, in that the absorbent material piece 140 to be stored in the negative pressure controlling chamber unit 100 has two portions (140*a* and 140*b*), instead of being single piece, and an interface (113*d*) is formed between the portions 140*a* and 140*b*. Otherwise this embodiment is virtually the same as the first embodiment, and therefore, its description will be omitted.

In FIG. 30, (*a*), the interface 113*c* between the absorbent material piece 130 and absorbent material piece 140*a*, both of which are formed of the same fibrous material, is located adjacent to the top end of the joint pipe 180 with which the negative pressure controlling chamber unit 100 is provided (preferably, only slightly above the top end). On the other hand, the interface 113*d* between the absorbent material piece 140*a* and absorbent material piece 140*b* is located at the bottom end of the joint pipe 180 (preferably, only slightly above the bottom end, and below the top end). Although omitted in the drawing, the fiber strands in the absorbent material pieces 130 and 140*b* in this embodiment are parallelly arranged in the approximately horizontal direction as are the fiber strands in the first embodiment. On the other hand, the direction of the fiber strands in the absorbent material piece 140*a* is approximately perpendicular to the direction of the fiber strands in the adjacent two absorbent material pieces 130 and 140*b*, that is, approximately vertical.

The relationship among the strengths of the capillary forces of the absorbent material pieces 130, 140*a* and 140*b* is: (strength P2 of the capillary force of the absorbent material piece 130)<(strength P1*a* of the capillary force of the absorbent material piece 140*a*)<(strength P1*b* of the capillary force of the absorbent material piece 140*b*). More specifically, in this embodiment, when storing color inks, the capillary force P2 of the absorbent material piece 130=−90 mmAq; capillary force P1*a* of the absorbent material piece 140*a*=−120 mmAq, and capillary force P1*b* of the absorbent material piece 140*b*=−150 mmAq.

This embodiment is different from the above described first embodiment in that in the state in which an ink supplying operation is proceeding after the installation of the ink container unit 200 (FIG. 30, (*a*)), the interface L between the ink and air in the absorbent material pieces in the negative pressure controlling chamber unit 100 is formed in the absorbent material piece 140*a* due to the aforementioned difference in capillary force, instead of the higher capillary force at the interface. In this state, the absorbent material piece 140*b* is filled with ink. Therefore, the region of the absorbent material piece 140*a* above the interface L (in other words, the region which is not holding ink) functions as an air buffer region of the negative pressure controlling chamber unit, along with the absorbent material piece 130.

Also in this embodiment, it is easy to keep horizontal the gas-liquid interface, as it is in the first embodiment, by setting the relationship among the strengths of the capillary forces Psc and Psd at the interfaces 113*c* and 113*d*, respectively, in a manner to satisfy the following inequality: P1*a*<Psc, P1*b*<Psd.

As described above, compared to the first embodiment in which there are two piece of absorbent material, this embodiment can fill ink into a route K from the joint pipe 180 to the delivery opening 131, with more certainty, while liquid is supplied through the gas-liquid exchange. Therefore, also in comparison to the first embodiment, it is possible to more reliably deliver ink to a peripheral component (for example, recording head) through the delivery opening, without allowing large air bubbles to drift into the supply route. During this process, the absorbent material piece 140*a* carries out the role of smoothly supplying ink into the absorbent material piece 140*b*.

In addition, as the ink container unit is separated from the holder 150, with the interface L in the absorbent material piece 140*a* as shown in FIG. 30, (*b*1), to exchange the ink container unit after the consumption of the ink in the ink container unit, the ink adhering to the joint pipe 180 is quickly absorbed by the absorbent material piece 140*a* as indicated by an arrow mark in the drawing, being prevented from leaking from the joint pipe. Then, as a fresh ink container unit 200 is installed in this state, the ink in the ink container unit is drawn into the absorbent material piece 130 through the joint pipe 180 and absorbent material piece 140*a* as shown in FIG. 30, (*b*2).

Further, if the ink container unit is separated from the holder 150, with the interface L having descended into the absorbent material piece 140*b* as shown in FIG. 30, (*c*1), to exchange the ink container unit after the consumption of the ink in the ink container unit, the ink adhering to the joint pipe 180 is quickly absorbed by the absorbent material piece 140*a* as indicated by an arrow mark in the drawing, and then, the absorbed ink moves into the absorbent material piece 140*b*. Therefore, there will be no ink leakage from the joint pipe. Then, as a fresh ink container unit 200 is installed in this state, the in the ink container unit is drawn into the absorbent material piece 140*a* through the joint pipe 180, and then, first, the ink is drawn into the absorbent material piece 140*b* from the absorbent material piece 140*a* as indicated by (1) in FIG. 30, (*c*2). Then, the absorbent material piece 140*b* is filled with ink, and the interface L rises to the interface 113*d*. Thereafter, the interface rises in the absorbent material piece 140*a* as indicated by (2). If the ink keeps on moving even after filling the absorbent material piece 140*a*, ink is drawn into the absorbent material piece 130 from the absorbent material piece 140*a* as indicated by (3). FIG. 30, (*c*2) shows the state in which ink has been drawn into the absorbent material piece 130, and the interface L has been formed in the absorbent material piece 130.

In the above described embodiment, the fiber strand direction in the absorbent material piece 140*a* was set approximately vertical. This setting was for making the ink flow resistance in the absorbent material piece 140*b* higher than that in the absorbent material piece 140*a*, so that as a fresh replacement ink container unit is connected, ink is guided in the direction indicated by (1) to be drawn into the absorbent material piece 140*a*. Therefore, if emphasis is to be placed on the horizontality of the gas-liquid interface, the fiber strands in the absorbent material piece 140*a* may be parallelly arranged in the approximately horizontal direction. The present invention includes such a configuration.

Obviously, the negative pressure controlling chamber in this embodiment may be applied to the tenth embodiment of the present invention illustrated in FIG. 28. Further, according to the above description, fibrous absorbent material is used as the material for the absorbent material piece. However, urethane foam or the like may be employed. Further, when fibrous absorbent material is used, the direction of the fiber strands is desired to be horizontal when in use, as described regarding the other embodiments.

(Related Embodiments)

Next, examples of an ink jet head cartridge and ink jet recording apparatus, which employs an ink container in accordance with the present invention.

<Ink Jet Head Cartridge>

Figure 31:
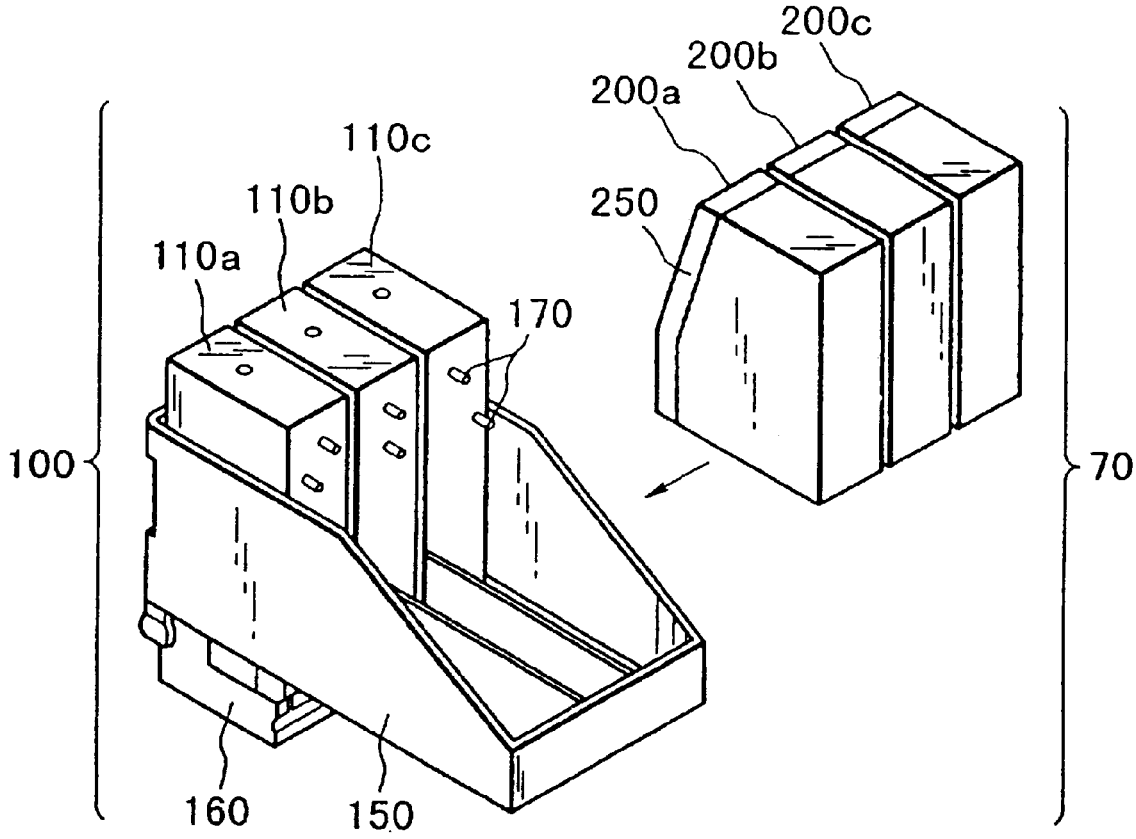
FIG. 31 is a drawing for depicting, in general terms, the ink jet head cartridge which employs the ink container in accordance with the present invention.

FIG. 31 is a schematic drawing of an ink jet head cartridge employing an ink container in accordance with the present invention.

The ink jet head cartridge 70 in this embodiment illustrated in FIG. 31 is provided with a negative pressure controlling chamber unit 100 which comprises an ink jet head unit 160 capable of ejecting a plurality of inks different in color (in this embodiment, three colors; yellow (Y), magenta (M), and cyan (C)), and a plurality of negative pressure controlling chamber containers 110*a*, 110*b* and 110*c*, which individually contain ink different from the ink in other negative pressure controlling chambers, and are integrally combined. To this negative pressure controlling chamber unit 100, a plurality of ink container units 200*a*, 200*b* and 200*c*, in which ink different from the ink in the other ink container units is stored, are removably connectable.

In this embodiment, in order to connect each of ink container units 200*a*, 200*b* and 200*c* to a correspondent negative pressure controlling chamber container 110*a*, 110*b* or 110*c*, without making an error, a holder 150, which partially covers the external surface of the ink container unit 200, is provided. Further, an ID member 250 having a plurality of slots in the front surface in terms of the ink container unit 200 installation direction is provided, and also, the negative pressure controlling chamber containing 110 is provided with a corresponding number of ID members 170 in the form of a projection.

In the present invention, the type of the liquid to be stored may be different from inks with Y, M or C color, which is obvious; the number or combination of liquid containers to be installed, may be optional (for example, black ink (Bk) is independently stored in a container dedicated therefor, and other inks (Y, M and C) and independently stored in the separate compartments combined in the form of a single piece unit), which is obvious.

<Recording Apparatus>

Lastly, referring to FIG. 32, an example of an ink jet recording apparatus in which the above described ink container unit or ink jet head cartridge is installable will be described.

Figure 32:
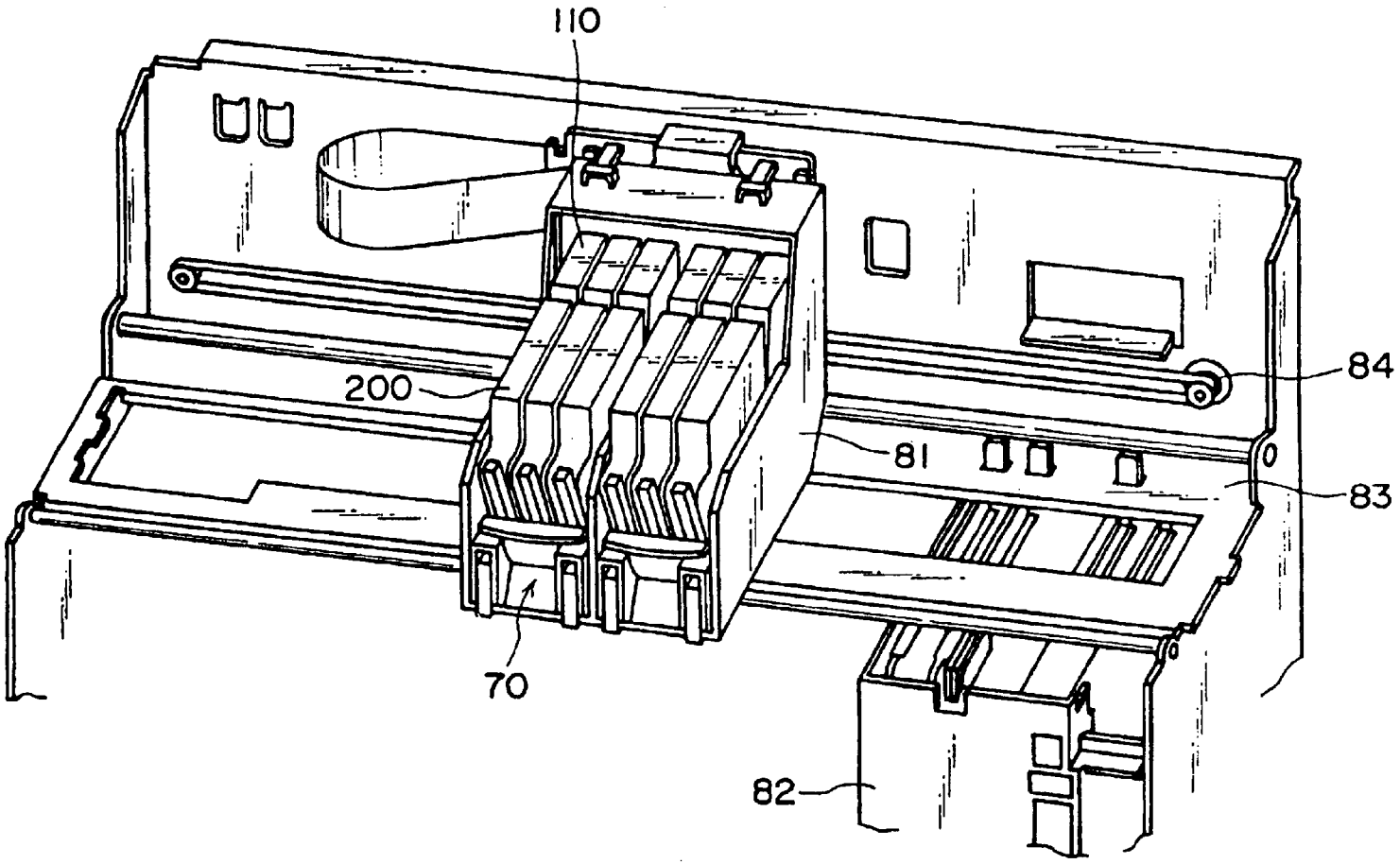
FIG. 32 is a schematic perspective view of the essential portion of an example of an ink jet recording apparatus in which the ink container unit or ink jet head cartridge in accordance with the present invention can be mounted.

The recording apparatus illustrated in FIG. 32 comprises: a carriage 81 on or into which the ink container unit 200 and an ink jet head cartridge 70 are removably installable; a head recovery unit 82 into which a head cap for preventing the ink from the plurality of orifices of the head from drying, and a suction pump for suctioning out ink from the plurality of the orifices when the head operation is not up to the standard; and a sheet supporting platen 83 onto which recording paper as recording medium is conveyed.

The carriage 81 uses a position above the recovery unit 82 as its home position, and is scanned in the leftward direction in the drawing as a belt 84 is driven by a motor or the like. Printing is performed by ejecting ink from the head toward the recording paper conveyed onto the platen 83 during this scanning movement.

In each of the above described embodiments, the material for the absorbent pieces may be conventional, known material such as foamed urethane, or may be a bundle of fiber strands, which was described regarding the fifth embodiment, as long as the material is capable of retaining ink against the weight of the ink itself, and in spite of the presence of vibrations of a small magnitude.

Also in each of the above described embodiments, the ink composition may be as follows:

| | |
|---|---|
| C.I. basic yellow | 2.5 parts |
| Ethyl alcohol | 1.0 part |
| Ethylene glycol | 10.0 parts |
| Benzalkonium chloride | 1.0 part |
| Ion exchange resin | 85.5 parts |

However, the composition does not need to be limited to the above.

While the invention has been described with reference to the structures disclosed herein, it is not confined to the details set forth and this application is intended to cover such modifications or changes as may come within the purposes of the improvements or the scope of the following claims.

What is claimed is:

1. A liquid supply system comprising:

a liquid supply container provided with a liquid reservoir portion for storing liquid in a substantially sealed space therein; and a capillary force generating member accommodating container, an internal space of which is connected to the sealed space of the liquid reservoir portion through a communication path portion of the liquid supply container, and in which a capillary force generating member is contained, wherein said communication path portion is constructed to supply liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container as liquid is expelled through a liquid supply portion;

wherein the capillary force generating member is provided with a layer of fiber strands in which a primary direction of the fiber strands therein is substantially horizontal, wherein the layer is at the interface between air and liquid in the capillary force generating member, the air-liquid exchange occurs for supplying liquid; and wherein the communication path portion is positioned at a level higher than the liquid supply portion, lower than a top surface of the capillary force generating member, and higher than a bottom surface of the capillary force generating member.

2. An ink jet recording apparatus comprising:

an ink jet head cartridge which records by ejecting liquid, and a carriage which removably holds the ink jet head cartridge supported for reciprocal movement along a surface of a recording medium;

wherein the ink jet head cartridge is provided with the liquid supply system claimed in claim 1, and a liquid ejection recording head portion which receives liquid from the liquid supply portion of the capillary force generating member accommodating container, and records by ejecting the liquid; and wherein the ink jet recording head cartridge is further provided with a head recovery unit for performing a recovery operation for the liquid ejection recording head portion.

3. A liquid supply system comprising:

a liquid supply container provided with a liquid reservoir portion for storing liquid in a substantially sealed space therein; and a capillary force generating member accommodating container, an internal space of which is connected to the sealed space of the liquid reservoir portion through a communication path portion which is formed as the liquid supply container is connected to the capillary force generating member accommodating container, and in which a capillary force generating member is contained, wherein said communication path portion is constructed to supply liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container as liquid is expelled from a liquid supply portion;

wherein the capillary force generating member is provided with a layer of fiber strands in which a primary direction of the fiber strands therein is substantially horizontal, wherein the layer is in a region adjacent to a top portion of the communication path portion; and wherein the communication path portion is positioned at a level higher than the liquid supply portion, lower than a top surface of the capillary force generating member, and higher than a bottom surface of the capillary force generating member.

4. A liquid supply system comprising:

a liquid supply container provided with a liquid reservoir portion for storing liquid in a substantially sealed space therein; and a capillary force generating member accommodating container, an internal space of which is connected to the sealed space of the liquid reservoir portion through a communication path portion of the liquid supply container, and in which a capillary force generating member is contained, wherein said communication path portion is constructed to supply liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container as liquid is expelled from a liquid supply portion;

wherein connection of the liquid supply container to the capillary force generating member accommodating container allows liquid to move from the liquid reservoir portion to the capillary force generating member;

wherein the capillary force generating member is provided with a layer of fiber strands in which a primary direction of the fiber strands therein is substantially horizontal, wherein the layer form a liquid movement controlling member for controlling liquid movement in the capillary force generating member resulting from liquid movement from the liquid reservoir portion to the capillary force generating member; and wherein the communication path portion is positioned at a level higher than the liquid supply portion, lower than a top surface of the capillary force generating member, and higher than a bottom surface of the capillary force generating member.

5. A liquid supply system comprising:

a liquid supply container provided with a liquid reservoir portion for storing liquid in a substantially sealed space therein; and a capillary force generating member accommodating container, an internal space of which is connected to the sealed space of the liquid reservoir portion through a communication path portion of the liquid supply container, and in which a capillary force generating member is contained, wherein said communication path portion is constructed to supply liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container as liquid is expelled from a liquid supply portion;

wherein the capillary force generating member is provided with a layer of fiber strands in which a primary direction of the fiber strands therein possess directionality in their arrangement, and the primary direction of the directionality is set so that the interface between the air and liquid in the capillary force generating member is kept horizontal while the liquid is supplied through the air-liquid exchange; and wherein the communication path portion is positioned at a level higher than the liquid supply portion, lower than a top surface of the capillary force generating member, and higher than a bottom surface of the capillary force generating member.

6. A liquid supply system comprising:

a liquid supply container provided with a liquid reservoir portion for storing liquid in a substantially sealed space therein; and a capillary force generating member accommodating container, an internal space of which is connected to the sealed space of the liquid reservoir portion through a communication path portion of the liquid supply container and in which a capillary force generating member is contained, wherein said communication path portion is constructed to supply liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container as liquid is expelled from a liquid supply portion;

wherein the capillary force generating member is provided with a layer of fiber strands in which a primary direction of the fiber strands therein is substantially horizontal, wherein the layer is in a region connecting the liquid supply portion and a top end of the communication path portion; and wherein the communication path portion is positioned at a level higher than the liquid supply portion, lower than a top surface of the capillary force generating member, and higher than a bottom surface of the capillary force generating member.

7. A liquid supply system comprising:

a liquid supply container provided with a liquid reservoir portion for storing, liquid in a substantially sealed space therein; and a capillary force generating member accommodating container, an internal space of which is connected to the sealed space of the liquid reservoir portion through a communication path portion of the liquid supply container, and in which a capillary force generating member is contained, wherein said communication path portion is constructed to supply liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container as liquid is expelled from a liquid supply portion;

wherein the capillary force generating member accommodating container is provided with an atmospheric air introduction path for introducing atmospheric air, the atmospheric air introduction path being in the internal space provided with the communication path portion;

wherein the capillary force generating member is provided with a layer of fiber strands in which a primary direction of the fiber strands therein is substantially horizontal, wherein the layer is at a top end of the atmospheric air introduction path; and wherein the communication path portion is positioned at a level higher than the liquid supply portion, lower than a top surface of the capillary force generating member, and higher than a bottom surface of the capillary force generating member.

8. A liquid supply container constructed for connection to a capillary force generating member accommodating container which has a liquid supply portion and a capillary force generating member provided with a layer of fiber strands in which a primary direction of the fiber strands is substantially horizontal, comprising:

a liquid reservoir portion forming a virtually sealed space therein for storing liquid;

a supply portion through which the liquid stored in the liquid reservoir portion is drawn out, and which constitutes a communication path portion at which the liquid supply container is connected to the capillary force generating member accommodating container; and a sealing means for airtightly sealing the supply portion;

wherein the communication path portion is constructed to supply liquid from said liquid reservoir portion to said capillary force generating member accommodating chamber by exchange of liquid and air flows with liquid flowing into said capillary force generating member accommodating container from said liquid reservoir portion and with air flowing into said liquid reservoir portion from said capillary force generating member accommodating container;

wherein the communication path portion is positioned at level below a top end of the layer of the capillary force generating member; and wherein the communication path portion is positioned at a level higher than the liquid supply portion, lower than a top surface of the capillary force generating member, and higher than a bottom surface of the capillary force generating member.

9. A liquid supply container according to claim 8, wherein said sealing means includes a sealing member for forming the communication path portion by becoming integral with the capillary force generating member accommodating container.

10. A liquid supply container according to claim 8, in which the liquid reservoir portion is deformable and generates negative pressure while deforming as the liquid stored therein is drawn out; and which further comprises an external shell, an internal shape of which corresponds to an external shape of the liquid reservoir portion.

11. A capillary force generating member accommodating container comprising:

a communication path portion for drawing liquid from an external liquid reservoir portion;

a liquid supply portion for supplying liquid to an external portion different from the liquid reservoir portion;

a capillary force generating member stored therein for temporarily retaining, liquid; and an air vent through which an internal space thereof is connected to atmospheric air;

wherein the communication path portion is constructed to supply liquid from said liquid reservoir portion to said capillary force generating member accommodating chamber by exchange of liquid and air flows with liquid flowing into said capillary force generating member accommodating container from said liquid reservoir portion and with air flowing into said liquid reservoir portion from said capillary force generating member accommodating container;

wherein the capillary force generating member is provided with a layer of fiber strands in which a primary direction of the fiber strands therein is substantially horizontal, wherein the layer is at an interface between air and liquid in the capillary force generating member, at which the air-liquid exchange occurs for supplying liquid; and wherein the communication path portion is positioned at a level higher than the liquid supply portion, lower than a top surface of the capillary force generating member, and higher than a bottom surface of the capillary force generating member.

12. An ink jet head cartridge comprising a capillary force generating member accommodating container which stores therein a capillary force generating member for retaining liquid, and which is provided with a liquid supply portion for outward supply of the liquid retained in the capillary force generating member, and an air vent through which the capillary force generating member is in fluid communication with ambience; and a liquid reservoir container which is provided with a liquid reservoir portion for storing therein liquid to be supplied to said capillary force generating member accommodating container, and a communication path portion for supplying the liquid from said liquid reservoir portion to said capillary force generating member accommodating container by exchange of liquid and air flows with liquid flowing into said capillary force generating member accommodating container from said liquid reservoir portion and with air flowing into said liquid reservoir portion from said capillary force generating member accommodating container, said liquid reservoir portion forming a virtually sealed space except for the communication path portion;

wherein said capillary force generating member is provided with a layer of fiber strands in which a primary direction of the fiber strands therein is substantially horizontal, wherein the layer is in a region connecting the liquid supply portion and the communication path portion;

wherein the communication path portion is positioned at a level higher than the liquid supply portion, lower than a top surface of the capillary force generating member, and higher than a bottom surface of the capillary force generating member; and a liquid ejection recording head portion which receives liquid is received from the liquid supplying system, and records by ejecting the liquid, wherein the recording head further receives liquid from the capillary force generating member accommodating container.

13. An ink jet head cartridge according to claim 12, wherein the capillary force generating member accommodating container and liquid ejection recording head portion are integrated, and the liquid reservoir container is removably connectable to the capillary force generating member accommodating container.

14. An ink container which comprises:

a capillary force generating member accommodating container which stores, therein a capillary force generating member for retaining liquid, and which is provided with a liquid supply portion for outward supply of the liquid retained in the capillary force generating member, and an air vent through which the capillary force generating member is in fluid communication with ambience;

wherein said capillary force generating member is provided with a layer of fiber strands in which a primary direction of the fiber strands therein is substantially horizontal, and wherein the layer is at an interface between air and liquid in the capillary force generating member, at which the air-liquid exchange occurs for supplying liquid;

said ink container further comprising a liquid reservoir container which is provided with a liquid reservoir portion for storing therein liquid to be supplied to said capillary force generating member storage chamber, and a communication path portion for supplying the liquid from said liquid reservoir portion to the capillary force generating member accommodating container by exchange of liquid and air flows with liquid flowing into said capillary force generating member accommodating container from said liquid reservoir portion and with air flowing into said liquid reservoir portion from said capillary force generating member accommodating container, said liquid reservoir portion forming a virtually sealed space except for the communication path portion;

wherein the communication path portion is positioned at a level higher than the liquid supply portion, lower than a top surface of the capillary force generating member, and higher than a bottom surface of the capillary force generating member.

* * * * *